US011817657B2

(12) United States Patent
Ellison et al.

(10) Patent No.: US 11,817,657 B2
(45) **Date of Patent: *Nov. 14, 2023**

(54) HIGH SPEED, HIGH DENSITY DIRECT MATE ORTHOGONAL CONNECTOR

(71) Applicant: FCI USA LLC, Etters, PA (US)

(72) Inventors: Jason John Ellison, Dillsburg, PA (US); Douglas M. Johnescu, York, PA (US); Gregory A. Hull, York, PA (US); Mark E. Lauermann, Harrisburg, PA (US); Scott Martin, Manchester, PA (US); Jan De Geest, Wetteren (BE); Scott Carbaugh, Orbisonia, PA (US); Steven E. Minich, York, PA (US); Mark R. Gray, York, PA (US); Charles Copper, Hummelstown, PA (US); William Tanis, Mechanicsburg, PA (US)

(73) Assignee: FCI USA LLC, Etters, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/894,944

(22) Filed: Aug. 24, 2022

(65) Prior Publication Data

US 2022/0407269 A1 Dec. 22, 2022

Related U.S. Application Data

(63) Continuation of application No. 17/158,543, filed on Jan. 26, 2021, now Pat. No. 11,469,554.
(Continued)

(51) Int. Cl.
*H01R 29/00* (2006.01)
*H01R 13/6587* (2011.01)
(Continued)

(52) U.S. Cl.
CPC ..... *H01R 13/6587* (2013.01); *H01R 12/716* (2013.01); *H01R 13/502* (2013.01);
(Continued)

(58) Field of Classification Search
CPC ..... H01R 13/6585; H01R 13/6586; H01R 13/6587; H01R 13/502; H01R 13/6477;
(Continued)

(56) References Cited

U.S. PATENT DOCUMENTS 2,124,207 A 7/1938 Carl
2,996,710 A 8/1961 Pratt
(Continued)

FOREIGN PATENT DOCUMENTS

CN 1075390 A 8/1993
CN 1098549 A 2/1995
(Continued)

OTHER PUBLICATIONS

Chinese communication for Chinese Application No. 201580014851.4, dated Jun. 1, 2020.
(Continued)

*Primary Examiner* — Khiem M Nguyen
(74) *Attorney, Agent, or Firm* — Wolf, Greenfield & Sacks, P.C.

(57) ABSTRACT

A direct mate orthogonal connector for a high density of high speed signals. The connector may include right angle leadframe assemblies with signal conductive elements and ground shields held by a leadframe housing. High frequency performance may be achieved with members on the leadframe that transfer force between a connector housing, holding the leadframe assemblies, and a portion of the leadframe housing holding the signal conductive elements and the shields near their mounting ends. Core members may be inserted into the housing and mating ends of the
(Continued)

conductive elements of ground shields may be adjacent the core members, enabling electrical and mechanical performance of the mating interface to be defined by the core members. The core members may incorporate insulative and lossy features that may be complex to form as part of the connector housing but may be readily formed as part of a separate core member.

20 Claims, 14 Drawing Sheets

Related U.S. Application Data

(60) Provisional application No. 63/076,692, filed on Sep. 10, 2020, provisional application No. 62/966,521, filed on Jan. 27, 2020, provisional application No. 62/966,528, filed on Jan. 27, 2020.

(51) Int. Cl.

| | |
|---|---|
| ***H01R 12/71*** | (2011.01) |
| ***H01R 13/502*** | (2006.01) |
| ***H01R 13/6477*** | (2011.01) |
| *H01R 12/72* | (2011.01) |
| *H01R 12/73* | (2011.01) |
| *H01R 13/518* | (2006.01) |
| *H01R 13/6594* | (2011.01) |

(52) U.S. Cl.
CPC ..... *H01R 13/6477* (2013.01); *H01R 12/724* (2013.01); *H01R 12/737* (2013.01); *H01R 13/518* (2013.01); *H01R 13/6594* (2013.01)

(58) Field of Classification Search
CPC ..... H01R 13/518; H01R 13/6594; H01R 12/716; H01R 12/724; H01R 12/737
USPC ..... 439/171, 67.05–67.7
See application file for complete search history.

(56) References Cited

U.S. PATENT DOCUMENTS 3,002,162 A 9/1961 Garstang
3,007,131 A 10/1961 Dahlgren et al.
3,134,950 A 5/1964 Cook
3,229,240 A 1/1966 Harrison et al.
3,243,756 A 3/1966 Ruete et al.
3,322,885 A 5/1967 May et al.
3,390,369 A 6/1968 Zavertnik et al.
3,390,389 A 6/1968 Bluish
3,505,619 A 4/1970 Bishop
3,573,677 A 4/1971 Detar
3,594,613 A 7/1971 Prietula
3,715,706 A 2/1973 Michel et al.
3,731,259 A 5/1973 Occhipinti
3,743,978 A 7/1973 Fritz
3,745,509 A 7/1973 Woodward et al.
3,786,372 A 1/1974 Epis et al.
3,825,874 A 7/1974 Peverill
3,848,073 A 11/1974 Simons et al.
3,863,181 A 1/1975 Glance et al.
3,999,830 A 12/1976 Herrmann, Jr. et al.
4,083,615 A 4/1978 Volinskie
4,155,613 A 5/1979 Brandeau
4,157,612 A 6/1979 Rainal
4,175,821 A 11/1979 Hunter
4,195,272 A 3/1980 Boutros
4,215,910 A 8/1980 Walter
4,272,148 A 6/1981 Knack, Jr.
4,276,523 A 6/1981 Boutros et al.
4,307,926 A 12/1981 Smith
4,371,742 A 2/1983 Manly
4,408,255 A 10/1983 Adkins
4,447,105 A 5/1984 Ruehl
4,457,576 A 7/1984 Cosmos et al.
4,471,015 A 9/1984 Ebneth et al.
4,472,765 A 9/1984 Hughes
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,571,014 A 2/1986 Robin et al.
4,605,914 A 8/1986 Harman
4,607,907 A 8/1986 Bogursky
4,615,578 A 10/1986 Stadler et al.
4,632,476 A 12/1986 Schell
4,636,752 A 1/1987 Saito
4,639,054 A 1/1987 Kersbergen
4,655,518 A 4/1987 Johnson et al.
4,674,812 A 6/1987 Thom et al.
4,678,260 A 7/1987 Gallusser et al.
4,682,129 A 7/1987 Bakermans et al.
4,686,607 A 8/1987 Johnson
4,697,862 A 10/1987 Hasircoglu
4,708,660 A 11/1987 Claeys et al.
4,724,409 A 2/1988 Lehman
4,728,762 A 3/1988 Roth et al.
4,737,598 A 4/1988 O'Connor
4,751,479 A 6/1988 Parr
4,761,147 A 8/1988 Gauthier
4,795,375 A 1/1989 Williams
4,806,107 A 2/1989 Arnold et al.
4,824,383 A 4/1989 Lemke
4,826,443 A 5/1989 Lockard
4,836,791 A 6/1989 Grabbe et al.
4,846,724 A 7/1989 Sasaki et al.
4,846,727 A 7/1989 Glover et al.
4,871,316 A 10/1989 Herrell et al.
4,876,630 A 10/1989 Dara
4,878,155 A 10/1989 Conley
4,889,500 A 12/1989 Lazar et al.
4,902,243 A 2/1990 Davis
4,913,667 A 4/1990 Muz
4,924,179 A 5/1990 Sherman
4,948,922 A 8/1990 Varadan et al.
4,949,379 A 8/1990 Cordell
4,970,354 A 11/1990 Iwasa et al.
4,971,726 A 11/1990 Maeno et al.
4,975,084 A 12/1990 Fedder et al.
4,984,992 A 1/1991 Beamenderfer et al.
4,990,099 A 2/1991 Marin et al.
4,992,060 A 2/1991 Meyer
5,000,700 A 3/1991 Masubuchi et al.
5,046,084 A 9/1991 Barrett et al.
5,046,952 A 9/1991 Cohen et al.
5,046,960 A 9/1991 Fedder
5,066,236 A 11/1991 Broeksteeg
5,135,405 A 8/1992 Fusselman et al.
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,176,538 A 1/1993 Hansell, III et al.
5,190,472 A 3/1993 Voltz et al.
5,197,893 A 3/1993 Morlion et al.
5,246,388 A 9/1993 Collins et al.
5,259,773 A 11/1993 Champion et al.
5,266,055 A 11/1993 Naito et al.
5,280,257 A 1/1994 Cravens et al.
5,281,762 A 1/1994 Long et al.
5,287,076 A 2/1994 Johnescu et al.
5,306,171 A 4/1994 Marshall
5,323,299 A 6/1994 Weber
5,332,979 A 7/1994 Roskewitsch et al.
5,334,050 A 8/1994 Andrews
5,335,146 A 8/1994 Stucke
5,340,334 A 8/1994 Nguyen
5,346,410 A 9/1994 Moore, Jr.
5,352,123 A 10/1994 Sample et al.
5,387,130 A 2/1995 Fedder et al.

(56) References Cited

U.S. PATENT DOCUMENTS

| | | | |
|---|---|---|---|
| 5,402,088 | A | 3/1995 | Pierro et al. |
| 5,403,206 | A | 4/1995 | McNamara et al. |
| 5,407,622 | A | 4/1995 | Cleveland et al. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,435,757 | A | 7/1995 | Fedder et al. |
| 5,441,424 | A | 8/1995 | Morlion et al. |
| 5,456,619 | A | 10/1995 | Belopolsky et al. |
| 5,461,392 | A | 10/1995 | Mott et al. |
| 5,474,472 | A | 12/1995 | Niwa et al. |
| 5,484,310 | A | 1/1996 | McNamara et al. |
| 5,487,673 | A | 1/1996 | Hurtarte |
| 5,490,372 | A | 2/1996 | Schlueter |
| 5,496,183 | A | 3/1996 | Soes et al. |
| 5,499,935 | A | 3/1996 | Powell |
| 5,509,827 | A | 4/1996 | Huppenthal et al. |
| 5,539,148 | A | 7/1996 | Konishi et al. |
| 5,551,893 | A | 9/1996 | Johnson |
| 5,554,038 | A | 9/1996 | Morlion et al. |
| 5,554,050 | A | 9/1996 | Marpoe, Jr. |
| 5,562,497 | A | 10/1996 | Yagi et al. |
| 5,564,949 | A | 10/1996 | Wellinsky |
| 5,571,991 | A | 11/1996 | Highum et al. |
| 5,597,328 | A | 1/1997 | Mouissie |
| 5,598,627 | A | 2/1997 | Saka et al. |
| 5,605,469 | A | 2/1997 | Wellinsky et al. |
| 5,620,340 | A | 4/1997 | Andrews |
| 5,632,634 | A | 5/1997 | Soes |
| 5,651,702 | A | 7/1997 | Hanning et al. |
| 5,660,551 | A | 8/1997 | Sakurai |
| 5,669,789 | A | 9/1997 | Law |
| 5,691,506 | A | 11/1997 | Miyazaki et al. |
| 5,702,258 | A | 12/1997 | Provencher et al. |
| 5,733,148 | A | 3/1998 | Kaplan et al. |
| 5,743,765 | A | 4/1998 | Andrews et al. |
| 5,755,597 | A | 5/1998 | Panis et al. |
| 5,781,759 | A | 7/1998 | Kashiwabara |
| 5,795,191 | A | 8/1998 | Preputnick et al. |
| 5,796,323 | A | 8/1998 | Uchikoba et al. |
| 5,803,768 | A | 9/1998 | Zell et al. |
| 5,831,491 | A | 11/1998 | Buer et al. |
| 5,833,486 | A | 11/1998 | Shinozaki |
| 5,833,496 | A | 11/1998 | Hollander et al. |
| 5,842,887 | A | 12/1998 | Andrews |
| 5,870,528 | A | 2/1999 | Fukuda |
| 5,885,095 | A | 3/1999 | Cohen et al. |
| 5,887,158 | A | 3/1999 | Sample et al. |
| 5,904,594 | A | 5/1999 | Longueville et al. |
| 5,924,899 | A | 7/1999 | Paagman |
| 5,931,686 | A | 8/1999 | Sasaki et al. |
| 5,959,591 | A | 9/1999 | Aurand |
| 5,961,355 | A | 10/1999 | Morlion et al. |
| 5,971,809 | A | 10/1999 | Ho |
| 5,980,321 | A | 11/1999 | Cohen et al. |
| 5,981,869 | A | 11/1999 | Kroger |
| 5,982,253 | A | 11/1999 | Perrin et al. |
| 5,993,259 | A | 11/1999 | Stokoe et al. |
| 5,997,361 | A | 12/1999 | Driscoll et al. |
| 6,019,616 | A | 2/2000 | Yagi et al. |
| 6,042,394 | A | 3/2000 | Mitra et al. |
| 6,053,770 | A | 4/2000 | Blom |
| 6,083,046 | A | 7/2000 | Wu et al. |
| 6,083,047 | A | 7/2000 | Paagman |
| 6,095,825 | A | 8/2000 | Liao |
| 6,095,872 | A | 8/2000 | Lang et al. |
| 6,102,747 | A | 8/2000 | Paagman |
| 6,116,926 | A | 9/2000 | Ortega et al. |
| 6,120,306 | A | 9/2000 | Evans |
| 6,123,554 | A | 9/2000 | Ortega et al. |
| 6,132,255 | A | 10/2000 | Verhoeven |
| 6,132,355 | A | 10/2000 | Derie |
| 6,135,824 | A | 10/2000 | Okabe et al. |
| 6,144,559 | A | 11/2000 | Johnson et al. |
| 6,146,202 | A | 11/2000 | Ramey et al. |
| 6,152,274 | A | 11/2000 | Blard et al. |
| 6,152,742 | A | 11/2000 | Cohen et al. |
| 6,152,747 | A | 11/2000 | McNamara |
| 6,163,464 | A | 12/2000 | Ishibashi et al. |
| 6,168,466 | B1 | 1/2001 | Chiou |
| 6,168,469 | B1 | 1/2001 | Lu |
| 6,171,115 | B1 | 1/2001 | Mickievicz et al. |
| 6,171,149 | B1 | 1/2001 | van Zanten |
| 6,174,202 | B1 | 1/2001 | Mitra |
| 6,174,203 | B1 | 1/2001 | Asao |
| 6,174,944 | B1 | 1/2001 | Chiba et al. |
| 6,179,651 | B1 | 1/2001 | Huang |
| 6,179,663 | B1 | 1/2001 | Bradley et al. |
| 6,196,853 | B1 | 3/2001 | Harting et al. |
| 6,203,376 | B1 | 3/2001 | Magajne et al. |
| 6,203,396 | B1 | 3/2001 | Asmussen et al. |
| 6,206,729 | B1 | 3/2001 | Bradley et al. |
| 6,210,182 | B1 | 4/2001 | Elco et al. |
| 6,210,227 | B1 | 4/2001 | Yamasaki et al. |
| 6,217,372 | B1 | 4/2001 | Reed |
| 6,227,875 | B1 | 5/2001 | Wu et al. |
| 6,231,391 | B1 | 5/2001 | Ramey et al. |
| 6,238,245 | B1 | 5/2001 | Stokoe et al. |
| 6,267,604 | B1 | 7/2001 | Mickievicz et al. |
| 6,273,753 | B1 | 8/2001 | Ko |
| 6,273,758 | B1 | 8/2001 | Lloyd et al. |
| 6,285,542 | B1 | 9/2001 | Kennedy, III et al. |
| 6,293,827 | B1 | 9/2001 | Stokoe |
| 6,296,496 | B1 | 10/2001 | Trammel |
| 6,299,438 | B1 | 10/2001 | Sahagian et al. |
| 6,299,483 | B1 | 10/2001 | Cohen et al. |
| 6,299,484 | B2 | 10/2001 | Van Woensel |
| 6,299,492 | B1 | 10/2001 | Pierini et al. |
| 6,322,379 | B1 | 11/2001 | Ortega et al. |
| 6,328,572 | B1 | 12/2001 | Higashida et al. |
| 6,328,601 | B1 | 12/2001 | Yip et al. |
| 6,333,468 | B1 | 12/2001 | Endoh et al. |
| 6,343,955 | B2 | 2/2002 | Billman et al. |
| 6,343,957 | B1 | 2/2002 | Kuo et al. |
| 6,347,962 | B1 | 2/2002 | Kline |
| 6,350,134 | B1 | 2/2002 | Fogg et al. |
| 6,358,088 | B1 | 3/2002 | Nishio et al. |
| 6,358,092 | B1 | 3/2002 | Siemon et al. |
| 6,364,711 | B1 | 4/2002 | Berg et al. |
| 6,364,713 | B1 | 4/2002 | Kuo |
| 6,364,718 | B1 | 4/2002 | Polgar et al. |
| 6,366,471 | B1 | 4/2002 | Edwards et al. |
| 6,371,788 | B1 | 4/2002 | Bowling et al. |
| 6,375,510 | B2 | 4/2002 | Asao |
| 6,379,188 | B1 | 4/2002 | Cohen et al. |
| 6,380,485 | B1 | 4/2002 | Beaman et al. |
| 6,392,142 | B1 | 5/2002 | Uzuka et al. |
| 6,394,839 | B2 | 5/2002 | Reed |
| 6,396,712 | B1 | 5/2002 | Kuijk |
| 6,398,588 | B1 | 6/2002 | Bickford |
| 6,409,543 | B1 | 6/2002 | Astbury, Jr. et al. |
| 6,413,119 | B1 | 7/2002 | Gabrisko, Jr. et al. |
| 6,428,344 | B1 | 8/2002 | Reed |
| 6,431,914 | B1 | 8/2002 | Billman |
| 6,435,913 | B1 | 8/2002 | Billman |
| 6,435,914 | B1 | 8/2002 | Billman |
| 6,441,313 | B1 | 8/2002 | Novak |
| 6,452,789 | B1 | 9/2002 | Pallotti et al. |
| 6,454,605 | B1 | 9/2002 | Bassler et al. |
| 6,461,202 | B2 | 10/2002 | Kline |
| 6,471,549 | B1 | 10/2002 | Lappohn |
| 6,478,624 | B2 | 11/2002 | Ramey et al. |
| 6,482,017 | B1 | 11/2002 | Van Doorn |
| 6,489,563 | B1 | 12/2002 | Zhao et al. |
| 6,491,545 | B1 | 12/2002 | Spiegel et al. |
| 6,503,103 | B1 | 1/2003 | Cohen et al. |
| 6,506,076 | B2 | 1/2003 | Cohen et al. |
| 6,517,360 | B1 | 2/2003 | Cohen |
| 6,520,803 | B1 | 2/2003 | Dunn |
| 6,527,587 | B1 | 3/2003 | Ortega et al. |
| 6,528,737 | B1 | 3/2003 | Kwong et al. |
| 6,530,790 | B1 | 3/2003 | McNamara et al. |
| 6,533,613 | B1 | 3/2003 | Turner et al. |

(56) References Cited

U.S. PATENT DOCUMENTS

| | | | |
|---|---|---|---|
| 6,535,367 | B1 | 3/2003 | Carpenter et al. |
| 6,537,086 | B1 | 3/2003 | Mac Mullin |
| 6,537,087 | B2 | 3/2003 | McNamara et al. |
| 6,538,524 | B1 | 3/2003 | Miller |
| 6,538,899 | B1 | 3/2003 | Krishnamurthi et al. |
| 6,540,522 | B2 | 4/2003 | Sipe |
| 6,540,558 | B1 | 4/2003 | Paagman |
| 6,540,559 | B1 | 4/2003 | Kemmick et al. |
| 6,541,712 | B1 | 4/2003 | Gately et al. |
| 6,544,072 | B2 | 4/2003 | Olson |
| 6,544,647 | B1 | 4/2003 | Hayashi et al. |
| 6,551,140 | B2 | 4/2003 | Billman et al. |
| 6,554,647 | B1 | 4/2003 | Cohen et al. |
| 6,565,387 | B2 | 5/2003 | Cohen |
| 6,565,390 | B2 | 5/2003 | Wu |
| 6,574,115 | B2 | 6/2003 | Asano et al. |
| 6,575,772 | B1 | 6/2003 | Soubh et al. |
| 6,579,116 | B2 | 6/2003 | Brennan et al. |
| 6,582,244 | B2 | 6/2003 | Fogg et al. |
| 6,585,540 | B2 | 7/2003 | Gutierrez et al. |
| 6,592,381 | B2 | 7/2003 | Cohen et al. |
| 6,592,390 | B1 | 7/2003 | Davis et al. |
| 6,592,401 | B1 | 7/2003 | Gardner et al. |
| 6,595,802 | B1 | 7/2003 | Watanabe et al. |
| 6,602,095 | B2 | 8/2003 | Astbury, Jr. et al. |
| 6,607,402 | B2 | 8/2003 | Cohen et al. |
| 6,608,762 | B2 | 8/2003 | Patriche |
| 6,609,933 | B2 | 8/2003 | Yamasaki |
| 6,612,871 | B1 | 9/2003 | Givens |
| 6,616,482 | B2 | 9/2003 | De La Cruz et al. |
| 6,616,864 | B1 | 9/2003 | Jiang et al. |
| 6,621,373 | B1 | 9/2003 | Mullen et al. |
| 6,652,296 | B2 | 11/2003 | Kuroda et al. |
| 6,652,318 | B1 | 11/2003 | Winings et al. |
| 6,652,319 | B1 | 11/2003 | Billman |
| 6,655,966 | B2 | 12/2003 | Rothermel et al. |
| 6,663,427 | B1 | 12/2003 | Billman et al. |
| 6,663,429 | B1 | 12/2003 | Korsunsky et al. |
| 6,685,501 | B1 | 2/2004 | Wu et al. |
| 6,692,262 | B1 | 2/2004 | Loveless |
| 6,692,272 | B2 | 2/2004 | Lemke et al. |
| 6,705,893 | B1 | 3/2004 | Ko |
| 6,705,895 | B2 | 3/2004 | Hasircoglu |
| 6,706,974 | B2 | 3/2004 | Chen et al. |
| 6,709,294 | B1 | 3/2004 | Cohen et al. |
| 6,712,648 | B2 | 3/2004 | Padro et al. |
| 6,713,672 | B1 | 3/2004 | Stickney |
| 6,717,825 | B2 | 4/2004 | Volstorf |
| 6,722,897 | B1 | 4/2004 | Wu |
| 6,741,141 | B2 | 5/2004 | Kormanyos |
| 6,743,057 | B2 | 6/2004 | Davis et al. |
| 6,749,444 | B2 | 6/2004 | Murr et al. |
| 6,762,941 | B2 | 7/2004 | Roth |
| 6,764,341 | B2 | 7/2004 | Lappoehn |
| 6,776,645 | B2 | 8/2004 | Roth et al. |
| 6,776,659 | B1 | 8/2004 | Stokoe et al. |
| 6,786,771 | B2 | 9/2004 | Gailus |
| 6,792,941 | B2 | 9/2004 | Andersson |
| 6,797,891 | B1 | 9/2004 | Blair et al. |
| 6,806,109 | B2 | 10/2004 | Furuya et al. |
| 6,808,419 | B1 | 10/2004 | Korsunsky et al. |
| 6,808,420 | B2 | 10/2004 | Whiteman, Jr. et al. |
| 6,814,519 | B2 | 11/2004 | Policicchio et al. |
| 6,814,619 | B1 | 11/2004 | Stokoe et al. |
| 6,816,486 | B1 | 11/2004 | Rogers |
| 6,817,870 | B1 | 11/2004 | Kwong et al. |
| 6,823,587 | B2 | 11/2004 | Reed |
| 6,824,426 | B1 | 11/2004 | Spink, Jr. |
| 6,830,478 | B1 | 12/2004 | Ko et al. |
| 6,830,483 | B1 | 12/2004 | Wu |
| 6,830,489 | B2 | 12/2004 | Aoyama |
| 6,843,657 | B2 | 1/2005 | Driscoll et al. |
| 6,857,899 | B2 | 2/2005 | Reed et al. |
| 6,872,085 | B1 | 3/2005 | Cohen et al. |
| 6,875,031 | B1 | 4/2005 | Korsunsky et al. |
| 6,899,566 | B2 | 5/2005 | Kline et al. |
| 6,903,934 | B2 | 6/2005 | Lo et al. |
| 6,903,939 | B1 | 6/2005 | Chea, Jr. et al. |
| 6,913,490 | B2 | 7/2005 | Whiteman, Jr. et al. |
| 6,916,183 | B2 | 7/2005 | Alger et al. |
| 6,932,649 | B1 | 8/2005 | Rothermel et al. |
| 6,955,565 | B2 | 10/2005 | Lloyd et al. |
| 6,957,967 | B2 | 10/2005 | Petersen et al. |
| 6,960,103 | B2 | 11/2005 | Tokunaga |
| 6,971,887 | B1 | 12/2005 | Trobough |
| 6,971,916 | B2 | 12/2005 | Tokunaga |
| 6,979,202 | B2 | 12/2005 | Benham et al. |
| 6,979,226 | B2 | 12/2005 | Otsu et al. |
| 6,982,378 | B2 | 1/2006 | Dickson |
| 7,004,793 | B2 | 2/2006 | Scherer et al. |
| 7,021,969 | B2 | 4/2006 | Matsunaga |
| 7,044,794 | B2 | 5/2006 | Consoli et al. |
| 7,056,128 | B2 | 6/2006 | Driscoll et al. |
| 7,057,570 | B2 | 6/2006 | Irion, II et al. |
| 7,070,446 | B2 | 7/2006 | Henry et al. |
| 7,074,086 | B2 | 7/2006 | Cohen et al. |
| 7,077,658 | B1 | 7/2006 | Ashman et al. |
| 7,094,102 | B2 | 8/2006 | Cohen et al. |
| 7,108,556 | B2 | 9/2006 | Cohen et al. |
| 7,120,327 | B2 | 10/2006 | Bozso et al. |
| 7,137,849 | B2 | 11/2006 | Nagata |
| 7,148,428 | B2 | 12/2006 | Meier et al. |
| 7,163,421 | B1 | 1/2007 | Cohen et al. |
| 7,182,643 | B2 | 2/2007 | Winings et al. |
| 7,214,097 | B1 | 5/2007 | Hsu et al. |
| 7,223,915 | B2 | 5/2007 | Hackman |
| 7,229,318 | B2 | 6/2007 | Winings et al. |
| 7,234,944 | B2 | 6/2007 | Nordin et al. |
| 7,244,137 | B2 | 7/2007 | Renfro et al. |
| 7,261,591 | B2 | 8/2007 | Korsunsky et al. |
| 7,267,515 | B2 | 9/2007 | Lappohn |
| 7,270,573 | B2 | 9/2007 | Houtz |
| 7,280,372 | B2 | 10/2007 | Grundy et al. |
| 7,285,018 | B2 | 10/2007 | Kenny et al. |
| 7,303,427 | B2 | 12/2007 | Swain |
| 7,307,293 | B2 | 12/2007 | Fjelstad et al. |
| 7,309,239 | B2 | 12/2007 | Shuey et al. |
| 7,309,257 | B1 | 12/2007 | Minich |
| 7,316,585 | B2 | 1/2008 | Smith et al. |
| 7,322,855 | B2 | 1/2008 | Mongold et al. |
| 7,331,816 | B2 | 2/2008 | Krohn et al. |
| 7,331,830 | B2 | 2/2008 | Minich |
| 7,335,063 | B2 | 2/2008 | Cohen et al. |
| 7,347,721 | B2 | 3/2008 | Kameyama |
| 7,351,114 | B2 | 4/2008 | Benham et al. |
| 7,354,274 | B2 | 4/2008 | Minich |
| 7,365,269 | B2 | 4/2008 | Donazzi et al. |
| 7,371,117 | B2 | 5/2008 | Gailus |
| 7,384,275 | B2 | 6/2008 | Ngo |
| 7,390,218 | B2 | 6/2008 | Smith et al. |
| 7,390,220 | B1 | 6/2008 | Wu |
| 7,402,048 | B2 | 7/2008 | Meier et al. |
| 7,407,413 | B2 | 8/2008 | Minich |
| 7,422,483 | B2 | 9/2008 | Avery et al. |
| 7,431,608 | B2 | 10/2008 | Sakaguchi et al. |
| 7,445,471 | B1 | 11/2008 | Scherer et al. |
| 7,462,942 | B2 | 12/2008 | Tan et al. |
| 7,485,012 | B2 | 2/2009 | Daugherty et al. |
| 7,494,383 | B2 | 2/2009 | Cohen et al. |
| 7,534,142 | B2 | 5/2009 | Avery et al. |
| 7,540,781 | B2 | 6/2009 | Kenny et al. |
| 7,549,897 | B2 | 6/2009 | Fedder et al. |
| 7,554,096 | B2 | 6/2009 | Ward et al. |
| 7,581,990 | B2 | 9/2009 | Kirk et al. |
| 7,585,186 | B2 | 9/2009 | McAlonis et al. |
| 7,588,464 | B2 | 9/2009 | Kim |
| 7,588,467 | B2 | 9/2009 | Chang |
| 7,594,826 | B2 | 9/2009 | Kobayashi et al. |
| 7,604,490 | B2 | 10/2009 | Chen et al. |
| 7,604,502 | B2 | 10/2009 | Pan |
| 7,613,011 | B2 | 11/2009 | Grundy et al. |
| 7,621,779 | B2 | 11/2009 | Laurx et al. |
| 7,652,381 | B2 | 1/2010 | Grundy et al. |
| 7,654,831 | B1 | 2/2010 | Wu |

(56) References Cited

U.S. PATENT DOCUMENTS

| | | | |
|---|---|---|---|
| 7,658,654 | B2 | 2/2010 | Ohyama et al. |
| 7,674,133 | B2 | 3/2010 | Fogg et al. |
| 7,686,659 | B2 | 3/2010 | Peng |
| 7,690,930 | B2 | 4/2010 | Chen et al. |
| 7,690,946 | B2 | 4/2010 | Knaub et al. |
| 7,699,644 | B2 | 4/2010 | Szczesny et al. |
| 7,699,663 | B1 | 4/2010 | Little et al. |
| 7,713,077 | B1 | 5/2010 | McGowan et al. |
| 7,719,843 | B2 | 5/2010 | Dunham |
| 7,722,401 | B2 | 5/2010 | Kirk et al. |
| 7,731,537 | B2 | 6/2010 | Amleshi et al. |
| 7,744,414 | B2 | 6/2010 | Scherer et al. |
| 7,753,731 | B2 | 7/2010 | Cohen et al. |
| 7,758,357 | B2 | 7/2010 | Pan et al. |
| 7,771,233 | B2 | 8/2010 | Gailus |
| 7,775,802 | B2 | 8/2010 | Defibaugh et al. |
| 7,789,676 | B2 | 9/2010 | Morgan et al. |
| 7,794,240 | B2 | 9/2010 | Cohen et al. |
| 7,794,278 | B2 | 9/2010 | Cohen et al. |
| 7,806,729 | B2 | 10/2010 | Nguyen et al. |
| 7,811,129 | B2 | 10/2010 | Glover et al. |
| 7,819,675 | B2 | 10/2010 | Ko et al. |
| 7,824,197 | B1 | 11/2010 | Westman et al. |
| 7,828,595 | B2 | 11/2010 | Mathews |
| 7,857,630 | B2 | 12/2010 | Hermant et al. |
| 7,862,344 | B2 | 1/2011 | Morgan et al. |
| 7,871,296 | B2 | 1/2011 | Fowler et al. |
| 7,874,873 | B2 | 1/2011 | Do et al. |
| 7,887,371 | B2 | 2/2011 | Kenny et al. |
| 7,887,379 | B2 | 2/2011 | Kirk |
| 7,906,730 | B2 | 3/2011 | Atkinson et al. |
| 7,914,304 | B2 | 3/2011 | Cartier et al. |
| 7,927,143 | B2 | 4/2011 | Helster et al. |
| 7,967,637 | B2 | 6/2011 | Fedder et al. |
| 7,976,318 | B2 | 7/2011 | Fedder et al. |
| 7,985,097 | B2 | 7/2011 | Gulla |
| 8,002,581 | B1 | 8/2011 | Whiteman, Jr. et al. |
| 8,016,616 | B2 | 9/2011 | Glover et al. |
| 8,018,733 | B2 | 9/2011 | Jia |
| 8,036,500 | B2 | 10/2011 | McColloch |
| 8,057,267 | B2 | 11/2011 | Johnescu |
| 8,083,553 | B2 | 12/2011 | Manter et al. |
| 8,100,699 | B1 | 1/2012 | Costello |
| 8,157,573 | B2 | 4/2012 | Tanaka |
| 8,162,675 | B2 | 4/2012 | Regnier et al. |
| 8,167,651 | B2 | 5/2012 | Glover et al. |
| 8,182,289 | B2 | 5/2012 | Stokoe et al. |
| 8,192,222 | B2 | 6/2012 | Kameyama |
| 8,197,285 | B2 | 6/2012 | Farmer |
| 8,210,877 | B2 | 7/2012 | Droesbeke |
| 8,215,968 | B2 | 7/2012 | Cartier et al. |
| 8,216,001 | B2 | 7/2012 | Kirk |
| 8,226,441 | B2 | 7/2012 | Regnier et al. |
| 8,251,745 | B2 | 8/2012 | Johnescu |
| 8,267,721 | B2 | 9/2012 | Minich |
| 8,272,877 | B2 | 9/2012 | Stokoe et al. |
| 8,308,491 | B2 | 11/2012 | Nichols et al. |
| 8,308,512 | B2 | 11/2012 | Ritter et al. |
| 8,337,243 | B2 | 12/2012 | Elkhatib et al. |
| 8,338,713 | B2 | 12/2012 | Fjelstad et al. |
| 8,371,875 | B2 | 2/2013 | Gailus |
| 8,371,876 | B2 | 2/2013 | Davis |
| 8,382,524 | B2 | 2/2013 | Khilchenko et al. |
| 8,398,433 | B1 | 3/2013 | Yang |
| 8,419,472 | B1 | 4/2013 | Swanger et al. |
| 8,439,704 | B2 | 5/2013 | Reed |
| 8,449,312 | B2 | 5/2013 | Lang et al. |
| 8,449,330 | B1 | 5/2013 | Schroll et al. |
| 8,465,302 | B2 | 6/2013 | Regnier et al. |
| 8,469,745 | B2 | 6/2013 | Davis et al. |
| 8,475,209 | B1 | 7/2013 | Whiteman, Jr. et al. |
| 8,535,065 | B2 | 9/2013 | Costello |
| 8,540,525 | B2 | 9/2013 | Regnier et al. |
| 8,550,861 | B2 | 10/2013 | Cohen et al. |
| 8,553,102 | B2 | 10/2013 | Yamada |
| 8,556,657 | B1 | 10/2013 | Nichols |
| 8,588,561 | B2 | 11/2013 | Zbinden et al. |
| 8,588,562 | B2 | 11/2013 | Zbinden et al. |
| 8,597,055 | B2 | 12/2013 | Regnier et al. |
| 8,657,627 | B2 | 2/2014 | McNamara et al. |
| 8,662,924 | B2 | 3/2014 | Davis et al. |
| 8,672,707 | B2 | 3/2014 | Nichols et al. |
| 8,678,860 | B2 | 3/2014 | Minich et al. |
| 8,690,604 | B2 | 4/2014 | Davis |
| 8,715,003 | B2 | 5/2014 | Buck et al. |
| 8,715,005 | B2 | 5/2014 | Pan |
| 8,740,644 | B2 | 6/2014 | Long |
| 8,753,145 | B2 | 6/2014 | Lang et al. |
| 8,758,051 | B2 | 6/2014 | Nonen et al. |
| 8,771,016 | B2 | 7/2014 | Atkinson et al. |
| 8,787,711 | B2 | 7/2014 | Zbinden et al. |
| 8,804,342 | B2 | 8/2014 | Behziz et al. |
| 8,814,595 | B2 | 8/2014 | Cohen et al. |
| 8,845,364 | B2 | 9/2014 | Wanha et al. |
| 8,864,521 | B2 | 10/2014 | Atkinson et al. |
| 8,888,531 | B2 | 11/2014 | Jeon |
| 8,888,533 | B2 | 11/2014 | Westman et al. |
| 8,911,255 | B2 | 12/2014 | Scherer et al. |
| 8,926,377 | B2 | 1/2015 | Kirk et al. |
| 8,944,831 | B2 | 2/2015 | Stoner et al. |
| 8,992,236 | B2 | 3/2015 | Wittig et al. |
| 8,992,237 | B2 | 3/2015 | Regnier et al. |
| 8,998,642 | B2 | 4/2015 | Manter et al. |
| 9,004,942 | B2 | 4/2015 | Paniauqa |
| 9,011,177 | B2 | 4/2015 | Lloyd et al. |
| 9,022,806 | B2 | 5/2015 | Cartier, Jr. et al. |
| 9,028,201 | B2 | 5/2015 | Kirk et al. |
| 9,028,281 | B2 | 5/2015 | Kirk et al. |
| 9,035,183 | B2 | 5/2015 | Kodama et al. |
| 9,040,824 | B2 | 5/2015 | Guetig et al. |
| 9,065,230 | B2 | 6/2015 | Milbrand, Jr. |
| 9,071,001 | B2 | 6/2015 | Scherer et al. |
| 9,077,115 | B2 | 7/2015 | Yang |
| 9,083,130 | B2 | 7/2015 | Casher et al. |
| 9,118,151 | B2 | 8/2015 | Tran et al. |
| 9,119,292 | B2 | 8/2015 | Gundel |
| 9,124,009 | B2 | 9/2015 | Atkinson et al. |
| 9,142,896 | B2 | 9/2015 | Wickes et al. |
| 9,142,921 | B2 | 9/2015 | Wanha et al. |
| 9,203,171 | B2 | 12/2015 | Yu et al. |
| 9,214,768 | B2 | 12/2015 | Pao et al. |
| 9,219,335 | B2 | 12/2015 | Atkinson et al. |
| 9,225,083 | B2 | 12/2015 | Krenceski et al. |
| 9,225,085 | B2 | 12/2015 | Cartier, Jr. et al. |
| 9,232,676 | B2 | 1/2016 | Sechrist et al. |
| 9,246,251 | B2 | 1/2016 | Regnier et al. |
| 9,257,778 | B2 | 2/2016 | Buck et al. |
| 9,257,794 | B2 | 2/2016 | Wanha et al. |
| 9,300,074 | B2 | 3/2016 | Gailus |
| 9,312,618 | B2 | 4/2016 | Regnier et al. |
| 9,350,108 | B2 | 5/2016 | Long |
| 9,356,401 | B1 | 5/2016 | Horning et al. |
| 9,362,678 | B2 | 6/2016 | Wanha et al. |
| 9,373,917 | B2 | 6/2016 | Sypolt et al. |
| 9,374,165 | B2 | 6/2016 | Zbinden et al. |
| 9,385,455 | B2 | 7/2016 | Regnier et al. |
| 9,391,407 | B1 | 7/2016 | Bucher et al. |
| 9,413,112 | B2 | 8/2016 | Helster et al. |
| 9,450,344 | B2 | 9/2016 | Cartier, Jr. et al. |
| 9,461,378 | B1 | 10/2016 | Chen |
| 9,490,558 | B2 | 11/2016 | Wanha et al. |
| 9,509,101 | B2 | 11/2016 | Cartier, Jr. et al. |
| 9,520,689 | B2 | 12/2016 | Cartier, Jr. et al. |
| 9,531,133 | B1 | 12/2016 | Horning et al. |
| 9,543,676 | B2 | 1/2017 | Evans et al. |
| 9,553,381 | B2 | 1/2017 | Regnier |
| 9,559,446 | B1 | 1/2017 | Wetzel et al. |
| 9,564,696 | B2 | 2/2017 | Gulla |
| 9,608,348 | B2 | 3/2017 | Wanha et al. |
| 9,651,752 | B2 | 5/2017 | Zbinden et al. |
| 9,660,364 | B2 | 5/2017 | Wig et al. |
| 9,666,961 | B2 | 5/2017 | Horning et al. |
| 9,685,736 | B2 | 6/2017 | Gailus et al. |
| 9,692,183 | B2 | 6/2017 | Phillips |

(56) References Cited

U.S. PATENT DOCUMENTS 9,692,188 B2 6/2017 Godana et al.
9,705,255 B2 7/2017 Atkinson et al.
9,728,903 B2 8/2017 Long et al.
9,748,698 B1 8/2017 Morgan et al.
9,774,144 B2 9/2017 Cartier, Jr. et al.
9,801,301 B1 10/2017 Costello
9,831,588 B2 11/2017 Cohen
9,841,572 B2 12/2017 Zbinden et al.
9,843,135 B2 12/2017 Guetig et al.
9,876,319 B2 1/2018 Zhao et al.
9,899,774 B2 2/2018 Gailus
9,923,309 B1 3/2018 Aizawa et al.
9,929,512 B1 3/2018 Trout et al.
9,985,367 B2 5/2018 Wanha et al.
9,985,389 B1 5/2018 Morgan et al.
10,038,284 B2 7/2018 Krenceski et al.
10,056,706 B2 8/2018 Wanha et al.
10,062,984 B2 8/2018 Regnier
10,069,225 B2 9/2018 Wanha et al.
10,096,921 B2 10/2018 Johnescu et al.
10,096,945 B2 10/2018 Cartier, Jr. et al.
10,122,129 B2 11/2018 Milbrand, Jr. et al.
10,148,025 B1 12/2018 Trout et al.
10,170,869 B2 1/2019 Gailus et al.
10,181,663 B2 1/2019 Regnier
10,186,814 B2 1/2019 Khilchenko et al.
10,205,286 B2 2/2019 Provencher et al.
10,211,577 B2 2/2019 Milbrand, Jr. et al.
10,243,304 B2 3/2019 Kirk et al.
RE47,342 E 4/2019 Lloyd et al.
10,283,914 B1 5/2019 Morgan et al.
10,305,224 B2 5/2019 Girard, Jr.
10,348,040 B2 7/2019 Cartier, Jr. et al.
10,355,416 B1 7/2019 Pickel et al.
10,381,767 B1 8/2019 Milbrand, Jr. et al.
10,431,936 B2 10/2019 Horning et al.
10,446,983 B2 10/2019 Krenceski et al.
10,511,128 B2 12/2019 Kirk et al.
10,601,181 B2 3/2020 Lu et al.
10,651,603 B2 5/2020 Kurudamannil et al.
10,686,282 B1 6/2020 McCarthy et al.
10,720,735 B2 7/2020 Provencher et al.
RE48,230 E 9/2020 Lloyd et al.
10,777,921 B2 9/2020 Lu et al.
10,797,417 B2 10/2020 Scholeno et al.
10,826,245 B2 11/2020 Chen et al.
10,916,894 B2 2/2021 Kirk et al.
10,931,050 B2 2/2021 Cohen
10,931,062 B2 2/2021 Cohen et al.
10,965,063 B2 3/2021 Krenceski et al.
11,189,971 B2 11/2021 Lu
11,316,307 B2 4/2022 Chen et al.
11,387,609 B2 7/2022 Provencher et al.
11,469,553 B2 * 10/2022 Johnescu ..... H01R 12/716
11,469,554 B2 * 10/2022 Ellison ..... H01R 13/6471
2001/0012730 A1 8/2001 Ramey et al.
2001/0041477 A1 11/2001 Billman et al.
2001/0042632 A1 11/2001 Manov et al.
2001/0046810 A1 11/2001 Cohen et al.
2002/0042223 A1 4/2002 Belopolsky et al.
2002/0086582 A1 7/2002 Nitta et al.
2002/0088628 A1 7/2002 Chen
2002/0089464 A1 7/2002 Joshi
2002/0098738 A1 7/2002 Astbury et al.
2002/0102885 A1 8/2002 Kline
2002/0111068 A1 8/2002 Cohen et al.
2002/0111069 A1 8/2002 Astbury et al.
2002/0115335 A1 8/2002 Saito
2002/0123266 A1 9/2002 Ramey et al.
2002/0136506 A1 9/2002 Asada et al.
2002/0157865 A1 10/2002 Noda
2002/0168898 A1 11/2002 Billman et al.
2002/0172469 A1 11/2002 Benner et al.
2002/0181215 A1 12/2002 Guenthner
2002/0187688 A1 12/2002 Marvin et al.
2002/0192988 A1 12/2002 Droesbeke et al.
2003/0003803 A1 1/2003 Billman et al.
2003/0008561 A1 1/2003 Lappoehn
2003/0008562 A1 1/2003 Yamasaki
2003/0022555 A1 1/2003 Vicich et al.
2003/0027439 A1 2/2003 Johnescu et al.
2003/0073331 A1 4/2003 Peloza et al.
2003/0109174 A1 6/2003 Korsunsky et al.
2003/0119362 A1 6/2003 Nelson et al.
2003/0143894 A1 7/2003 Kline et al.
2003/0147227 A1 8/2003 Egitto et al.
2003/0162441 A1 8/2003 Nelson et al.
2003/0220018 A1 11/2003 Winings et al.
2003/0220021 A1 11/2003 Whiteman et al.
2004/0001299 A1 1/2004 van Haaster et al.
2004/0005815 A1 1/2004 Mizumura et al.
2004/0018757 A1 1/2004 Lang et al.
2004/0020674 A1 2/2004 McFadden et al.
2004/0043661 A1 3/2004 Okada et al.
2004/0072473 A1 4/2004 Wu
2004/0094328 A1 5/2004 Fjelstad et al.
2004/0097112 A1 5/2004 Minich et al.
2004/0110421 A1 6/2004 Broman et al.
2004/0115968 A1 6/2004 Cohen
2004/0121633 A1 6/2004 David et al.
2004/0121652 A1 6/2004 Gailus
2004/0155328 A1 8/2004 Kline
2004/0171305 A1 9/2004 McGowan et al.
2004/0196112 A1 10/2004 Welbon et al.
2004/0224559 A1 11/2004 Nelson et al.
2004/0229510 A1 11/2004 Lloyd et al.
2004/0235352 A1 11/2004 Takemasa
2004/0259419 A1 12/2004 Payne et al.
2004/0264894 A1 12/2004 Cooke et al.
2005/0006119 A1 1/2005 Cunningham et al.
2005/0006126 A1 1/2005 Aisenbrey
2005/0020135 A1 1/2005 Whiteman et al.
2005/0032430 A1 2/2005 Otsu et al.
2005/0039331 A1 2/2005 Smith
2005/0048838 A1 3/2005 Korsunsky et al.
2005/0048842 A1 3/2005 Benham et al.
2005/0070160 A1 3/2005 Cohen et al.
2005/0090299 A1 4/2005 Tsao et al.
2005/0093127 A1 5/2005 Fjelstad et al.
2005/0118869 A1 6/2005 Evans
2005/0133245 A1 6/2005 Katsuyama et al.
2005/0142944 A1 6/2005 Ling et al.
2005/0148239 A1 7/2005 Hull et al.
2005/0176300 A1 8/2005 Hsu et al.
2005/0176835 A1 8/2005 Kobayashi et al.
2005/0215121 A1 9/2005 Tokunaga
2005/0233610 A1 10/2005 Tutt et al.
2005/0239339 A1 10/2005 Pepe
2005/0277315 A1 12/2005 Mongold et al.
2005/0283974 A1 12/2005 Richard et al.
2005/0287869 A1 12/2005 Kenny et al.
2006/0001163 A1 1/2006 Kolbehdari et al.
2006/0009080 A1 1/2006 Regnier et al.
2006/0019517 A1 1/2006 Raistrick et al.
2006/0019538 A1 1/2006 Davis et al.
2006/0024983 A1 2/2006 Cohen et al.
2006/0024984 A1 2/2006 Cohen et al.
2006/0068640 A1 3/2006 Gailus
2006/0073709 A1 4/2006 Reid
2006/0079119 A1 4/2006 Wu
2006/0091507 A1 5/2006 Fjelstad et al.
2006/0104010 A1 5/2006 Donazzi et al.
2006/0110977 A1 5/2006 Matthews
2006/0141866 A1 6/2006 Shiu
2006/0166551 A1 7/2006 Korsunsky et al.
2006/0216969 A1 9/2006 Bright et al.
2006/0228922 A1 10/2006 Morriss
2006/0255876 A1 11/2006 Kushta et al.
2006/0292932 A1 12/2006 Benham et al.
2007/0004282 A1 1/2007 Cohen et al.
2007/0004828 A1 1/2007 Khabbaz
2007/0021000 A1 1/2007 Laurx
2007/0021001 A1 1/2007 Laurx et al.
2007/0021002 A1 1/2007 Laurx et al.

(56) References Cited

U.S. PATENT DOCUMENTS

| | | | |
|---|---|---|---|
| 2007/0021003 | A1 | 1/2007 | Laurx et al. |
| 2007/0021004 | A1 | 1/2007 | Laurx et al. |
| 2007/0032104 | A1 | 2/2007 | Yamada et al. |
| 2007/0037419 | A1 | 2/2007 | Sparrowhawk |
| 2007/0042639 | A1 | 2/2007 | Manter et al. |
| 2007/0054554 | A1 | 3/2007 | Do et al. |
| 2007/0059961 | A1 | 3/2007 | Cartier et al. |
| 2007/0111597 | A1 | 5/2007 | Kondou et al. |
| 2007/0141872 | A1 | 6/2007 | Szczesny et al. |
| 2007/0155241 | A1 | 7/2007 | Lappohn |
| 2007/0197095 | A1 | 8/2007 | Feldman et al. |
| 2007/0207641 | A1 | 9/2007 | Minich |
| 2007/0218765 | A1 | 9/2007 | Cohen et al. |
| 2007/0243741 | A1 | 10/2007 | Yang |
| 2007/0254517 | A1 | 11/2007 | Olson et al. |
| 2007/0275583 | A1 | 11/2007 | McNutt et al. |
| 2008/0026638 | A1 | 1/2008 | Cohen et al. |
| 2008/0050968 | A1 | 2/2008 | Chang |
| 2008/0194146 | A1 | 8/2008 | Gailus |
| 2008/0200955 | A1 | 8/2008 | Tepic |
| 2008/0207023 | A1 | 8/2008 | Tuin et al. |
| 2008/0246555 | A1 | 10/2008 | Kirk et al. |
| 2008/0248658 | A1 | 10/2008 | Cohen et al. |
| 2008/0248659 | A1 | 10/2008 | Cohen et al. |
| 2008/0248660 | A1 | 10/2008 | Kirk et al. |
| 2008/0264673 | A1 | 10/2008 | Chi et al. |
| 2008/0267620 | A1 | 10/2008 | Cole et al. |
| 2008/0297988 | A1 | 12/2008 | Chau |
| 2008/0305689 | A1 | 12/2008 | Zhang et al. |
| 2008/0318455 | A1 | 12/2008 | Beaman et al. |
| 2009/0011641 | A1 | 1/2009 | Cohen et al. |
| 2009/0011643 | A1 | 1/2009 | Amleshi et al. |
| 2009/0011645 | A1 | 1/2009 | Laurx et al. |
| 2009/0011664 | A1 | 1/2009 | Laurx et al. |
| 2009/0017682 | A1 | 1/2009 | Amleshi et al. |
| 2009/0023330 | A1 | 1/2009 | Stoner et al. |
| 2009/0035955 | A1 | 2/2009 | McNamara |
| 2009/0051558 | A1 | 2/2009 | Dorval |
| 2009/0061661 | A1 | 3/2009 | Shuey et al. |
| 2009/0098767 | A1 | 4/2009 | Long |
| 2009/0117386 | A1 | 5/2009 | Vacanti et al. |
| 2009/0124101 | A1 | 5/2009 | Minich et al. |
| 2009/0130913 | A1 | 5/2009 | Yi et al. |
| 2009/0130918 | A1 | 5/2009 | Nguyen et al. |
| 2009/0149045 | A1 | 6/2009 | Chen et al. |
| 2009/0166082 | A1 | 7/2009 | Liu et al. |
| 2009/0176400 | A1 | 7/2009 | Davis et al. |
| 2009/0203259 | A1 | 8/2009 | Nguyen et al. |
| 2009/0205194 | A1 | 8/2009 | Semba et al. |
| 2009/0215309 | A1 | 8/2009 | Mongold et al. |
| 2009/0227141 | A1 | 9/2009 | Pan |
| 2009/0239395 | A1 | 9/2009 | Cohen et al. |
| 2009/0247012 | A1 | 10/2009 | Pan |
| 2009/0258516 | A1 | 10/2009 | Hiew et al. |
| 2009/0291593 | A1 | 11/2009 | Atkinson et al. |
| 2009/0305533 | A1 | 12/2009 | Feldman et al. |
| 2009/0305553 | A1 | 12/2009 | Thomas et al. |
| 2009/0311908 | A1 | 12/2009 | Fogg et al. |
| 2010/0009571 | A1 | 1/2010 | Scherer et al. |
| 2010/0048058 | A1 | 2/2010 | Morgan et al. |
| 2010/0081302 | A1 | 4/2010 | Atkinson et al. |
| 2010/0099299 | A1 | 4/2010 | Moriyama et al. |
| 2010/0112850 | A1 | 5/2010 | Rao et al. |
| 2010/0144167 | A1 | 6/2010 | Fedder et al. |
| 2010/0144168 | A1 | 6/2010 | Glover et al. |
| 2010/0144175 | A1 | 6/2010 | Helster et al. |
| 2010/0144201 | A1 | 6/2010 | Defibaugh et al. |
| 2010/0144203 | A1 | 6/2010 | Glover et al. |
| 2010/0144204 | A1 | 6/2010 | Knaub et al. |
| 2010/0177489 | A1 | 7/2010 | Yagisawa |
| 2010/0183141 | A1 | 7/2010 | Arai et al. |
| 2010/0197149 | A1 | 8/2010 | Davis et al. |
| 2010/0203768 | A1 | 8/2010 | Kondo et al. |
| 2010/0221951 | A1 | 9/2010 | Pepe et al. |
| 2010/0221959 | A1 | 9/2010 | Pan |
| 2010/0273359 | A1 | 10/2010 | Walker et al. |
| 2010/0291806 | A1 | 11/2010 | Minich et al. |
| 2010/0294530 | A1 | 11/2010 | Atkinson et al. |
| 2011/0003509 | A1 | 1/2011 | Gailus |
| 2011/0067237 | A1 | 3/2011 | Cohen et al. |
| 2011/0074213 | A1 | 3/2011 | Schaffer et al. |
| 2011/0104948 | A1 | 5/2011 | Girard, Jr. et al. |
| 2011/0130038 | A1 | 6/2011 | Cohen et al. |
| 2011/0177699 | A1 | 7/2011 | Crofoot et al. |
| 2011/0212632 | A1 | 9/2011 | Stokoe et al. |
| 2011/0212633 | A1 | 9/2011 | Regnier et al. |
| 2011/0212649 | A1 | 9/2011 | Stokoe et al. |
| 2011/0212650 | A1 | 9/2011 | Amleshi et al. |
| 2011/0223807 | A1 | 9/2011 | Jeon et al. |
| 2011/0230095 | A1 | 9/2011 | Atkinson et al. |
| 2011/0230096 | A1 | 9/2011 | Atkinson et al. |
| 2011/0230104 | A1 | 9/2011 | Lang et al. |
| 2011/0256739 | A1 | 10/2011 | Toshiyuki et al. |
| 2011/0263156 | A1 | 10/2011 | Ko |
| 2011/0287663 | A1 | 11/2011 | Gailus et al. |
| 2011/0300757 | A1 | 12/2011 | Regnier et al. |
| 2012/0003848 | A1 | 1/2012 | Casher et al. |
| 2012/0034820 | A1 | 2/2012 | Lang et al. |
| 2012/0077369 | A1 | 3/2012 | Andersen |
| 2012/0077380 | A1 | 3/2012 | Minich et al. |
| 2012/0094536 | A1 | 4/2012 | Khilchenko et al. |
| 2012/0115371 | A1 | 5/2012 | Chuang et al. |
| 2012/0135643 | A1 | 5/2012 | Lange et al. |
| 2012/0156929 | A1 | 6/2012 | Manter et al. |
| 2012/0184136 | A1 | 7/2012 | Ritter |
| 2012/0184154 | A1 | 7/2012 | Frank et al. |
| 2012/0202363 | A1 | 8/2012 | McNamara et al. |
| 2012/0202386 | A1 | 8/2012 | McNamara et al. |
| 2012/0202387 | A1 | 8/2012 | McNamara |
| 2012/0214343 | A1 | 8/2012 | Buck et al. |
| 2012/0214344 | A1 | 8/2012 | Cohen et al. |
| 2012/0329294 | A1 | 12/2012 | Raybold et al. |
| 2013/0012038 | A1 | 1/2013 | Kirk et al. |
| 2013/0017715 | A1 | 1/2013 | Laarhoven et al. |
| 2013/0017733 | A1 | 1/2013 | Kirk et al. |
| 2013/0052843 | A1 | 2/2013 | Johnescu et al. |
| 2013/0065454 | A1 | 3/2013 | Milbrand Jr. |
| 2013/0078870 | A1 | 3/2013 | Milbrand, Jr. |
| 2013/0078871 | A1 | 3/2013 | Milbrand, Jr. |
| 2013/0089993 | A1 | 4/2013 | Jeon |
| 2013/0090001 | A1 | 4/2013 | Kagotani |
| 2013/0092429 | A1 | 4/2013 | Ellison |
| 2013/0109232 | A1 | 5/2013 | Paniaqua |
| 2013/0143442 | A1 | 6/2013 | Cohen et al. |
| 2013/0178107 | A1 | 7/2013 | Costello et al. |
| 2013/0196553 | A1 | 8/2013 | Gailus |
| 2013/0210246 | A1 | 8/2013 | Davis et al. |
| 2013/0217263 | A1 | 8/2013 | Pan |
| 2013/0223036 | A1 | 8/2013 | Herring et al. |
| 2013/0225006 | A1 | 8/2013 | Khilchenko et al. |
| 2013/0273781 | A1 | 10/2013 | Buck et al. |
| 2013/0288513 | A1 | 10/2013 | Masubuchi et al. |
| 2013/0288521 | A1 | 10/2013 | McClellan et al. |
| 2013/0288525 | A1 | 10/2013 | McClellan et al. |
| 2013/0288539 | A1 | 10/2013 | McClellan et al. |
| 2013/0316590 | A1 | 11/2013 | Hon |
| 2013/0340251 | A1 | 12/2013 | Regnier et al. |
| 2014/0004724 | A1 | 1/2014 | Cartier, Jr. et al. |
| 2014/0004726 | A1 | 1/2014 | Cartier, Jr. et al. |
| 2014/0004746 | A1 | 1/2014 | Cartier, Jr. et al. |
| 2014/0041937 | A1 | 2/2014 | Lloyd et al. |
| 2014/0057493 | A1 | 2/2014 | De Geest et al. |
| 2014/0057494 | A1 | 2/2014 | Cohen |
| 2014/0057498 | A1 | 2/2014 | Cohen |
| 2014/0065883 | A1 | 3/2014 | Cohen et al. |
| 2014/0073174 | A1 | 3/2014 | Yang |
| 2014/0073181 | A1 | 3/2014 | Yang |
| 2014/0080331 | A1 | 3/2014 | Jeon |
| 2014/0194004 | A1 | 7/2014 | Pickel et al. |
| 2014/0242844 | A1 | 8/2014 | Wanha et al. |
| 2014/0273551 | A1 | 9/2014 | Resendez et al. |
| 2014/0273557 | A1 | 9/2014 | Cartier, Jr. et al. |
| 2014/0273627 | A1 | 9/2014 | Cartier, Jr. et al. |
| 2014/0287627 | A1 | 9/2014 | Cohen |

(56) References Cited

U.S. PATENT DOCUMENTS

| | | | |
|---|---|---|---|
| 2014/0308852 | A1 | 10/2014 | Gulla |
| 2014/0322974 | A1 | 10/2014 | Chang et al. |
| 2014/0335707 | A1 | 11/2014 | Johnescu et al. |
| 2014/0335736 | A1 | 11/2014 | Regnier et al. |
| 2015/0031238 | A1 | 1/2015 | Davis et al. |
| 2015/0056856 | A1 | 2/2015 | Atkinson et al. |
| 2015/0079829 | A1 | 3/2015 | Brodsgaard |
| 2015/0079845 | A1 | 3/2015 | Wanha et al. |
| 2015/0111427 | A1 | 4/2015 | Wu et al. |
| 2015/0180578 | A1 | 6/2015 | Leigh et al. |
| 2015/0194751 | A1 | 7/2015 | Herring |
| 2015/0200496 | A1 | 7/2015 | Simpson et al. |
| 2015/0207247 | A1 | 7/2015 | Regnier et al. |
| 2015/0236450 | A1 | 8/2015 | Davis |
| 2015/0236451 | A1 | 8/2015 | Cartier, Jr. et al. |
| 2015/0236452 | A1 | 8/2015 | Cartier, Jr. et al. |
| 2015/0255926 | A1 | 9/2015 | Paniagua |
| 2015/0280351 | A1 | 10/2015 | Bertsch |
| 2015/0303608 | A1 | 10/2015 | Zerebilov et al. |
| 2015/0357736 | A1 | 12/2015 | Tran et al. |
| 2015/0357761 | A1 | 12/2015 | Wanha et al. |
| 2015/0380868 | A1 | 12/2015 | Chen et al. |
| 2016/0000616 | A1 | 1/2016 | Lavoie |
| 2016/0013594 | A1 | 1/2016 | Costello et al. |
| 2016/0013596 | A1 | 1/2016 | Regnier |
| 2016/0028189 | A1 | 1/2016 | Resendez et al. |
| 2016/0104956 | A1 | 4/2016 | Santos et al. |
| 2016/0111825 | A1 | 4/2016 | Wanha et al. |
| 2016/0134057 | A1 | 5/2016 | Buck et al. |
| 2016/0141807 | A1 | 5/2016 | Gailus et al. |
| 2016/0149343 | A1 | 5/2016 | Atkinson et al. |
| 2016/0149362 | A1 | 5/2016 | Ritter et al. |
| 2016/0150633 | A1 | 5/2016 | Cartier, Jr. |
| 2016/0150639 | A1 | 5/2016 | Gailus et al. |
| 2016/0150645 | A1 | 5/2016 | Gailus et al. |
| 2016/0156133 | A1 | 6/2016 | Masubuchi et al. |
| 2016/0172794 | A1 | 6/2016 | Sparrowhawk et al. |
| 2016/0181713 | A1 | 6/2016 | Peloza et al. |
| 2016/0181732 | A1 | 6/2016 | Laurx et al. |
| 2016/0190747 | A1 | 6/2016 | Regnier et al. |
| 2016/0197423 | A1 | 7/2016 | Regnier |
| 2016/0211618 | A1 | 7/2016 | Gailus |
| 2016/0218455 | A1 | 7/2016 | Sayre et al. |
| 2016/0233598 | A1 | 8/2016 | Wittig |
| 2016/0240946 | A1 | 8/2016 | Evans et al. |
| 2016/0268714 | A1 | 9/2016 | Wanha et al. |
| 2016/0274316 | A1 | 9/2016 | Verdiell |
| 2016/0308296 | A1 | 10/2016 | Pitten et al. |
| 2016/0315409 | A1 | 10/2016 | Horning et al. |
| 2016/0322770 | A1 | 11/2016 | Zerebilov |
| 2016/0344141 | A1 | 11/2016 | Cartier, Jr. et al. |
| 2017/0025783 | A1 | 1/2017 | Astbury et al. |
| 2017/0033478 | A1 | 2/2017 | Wanha et al. |
| 2017/0042070 | A1 | 2/2017 | Baumler et al. |
| 2017/0047692 | A1 | 2/2017 | Cartier, Jr. et al. |
| 2017/0077643 | A1 | 3/2017 | Zbinden et al. |
| 2017/0093093 | A1 | 3/2017 | Cartier, Jr. et al. |
| 2017/0098901 | A1 | 4/2017 | Regnier |
| 2017/0162960 | A1 | 6/2017 | Wanha et al. |
| 2017/0294743 | A1 | 10/2017 | Gailus et al. |
| 2017/0302011 | A1 | 10/2017 | Wanha et al. |
| 2017/0338595 | A1 | 11/2017 | Girard, Jr. |
| 2017/0365942 | A1 | 12/2017 | Regnier |
| 2017/0365943 | A1 | 12/2017 | Wanha et al. |
| 2018/0006416 | A1 | 1/2018 | Lloyd et al. |
| 2018/0034175 | A1 | 2/2018 | Lloyd et al. |
| 2018/0034190 | A1 | 2/2018 | Ngo |
| 2018/0040989 | A1 | 2/2018 | Chen |
| 2018/0062323 | A1 | 3/2018 | Kirk et al. |
| 2018/0109043 | A1 | 4/2018 | Provencher et al. |
| 2018/0138620 | A1 | 5/2018 | Horning et al. |
| 2018/0145438 | A1 | 5/2018 | Cohen |
| 2018/0166828 | A1 | 6/2018 | Gailus |
| 2018/0198220 | A1 | 7/2018 | Sasame et al. |
| 2018/0219331 | A1 | 8/2018 | Cartier, Jr. et al. |
| 2018/0219332 | A1 | 8/2018 | Brungard et al. |
| 2018/0366880 | A1 | 12/2018 | Zerebilov et al. |
| 2019/0013625 | A1 | 1/2019 | Gailus et al. |
| 2019/0020155 | A1 | 1/2019 | Trout et al. |
| 2019/0036256 | A1 | 1/2019 | Martens et al. |
| 2019/0044284 | A1 | 2/2019 | Dunham |
| 2019/0157812 | A1 | 5/2019 | Gailus et al. |
| 2019/0173236 | A1 | 6/2019 | Provencher et al. |
| 2019/0221973 | A1 | 7/2019 | Kirk et al. |
| 2019/0296469 | A1 | 9/2019 | Stokoe et al. |
| 2019/0334292 | A1 | 10/2019 | Cartier, Jr. et al. |
| 2020/0021052 | A1 | 1/2020 | Milbrand, Jr. et al. |
| 2020/0076132 | A1 | 3/2020 | Yang et al. |
| 2020/0194940 | A1 | 6/2020 | Cohen et al. |
| 2020/0220289 | A1 | 7/2020 | Scholeno et al. |
| 2020/0235529 | A1 | 7/2020 | Kirk et al. |
| 2020/0251841 | A1 | 8/2020 | Stokoe et al. |
| 2020/0259294 | A1 | 8/2020 | Lu |
| 2020/0266584 | A1 | 8/2020 | Lu |
| 2020/0266585 | A1 | 8/2020 | Paniagua et al. |
| 2020/0303879 | A1 | 9/2020 | Provencher et al. |
| 2021/0159643 | A1 | 5/2021 | Kirk et al. |
| 2021/0175670 | A1 | 6/2021 | Cartier, Jr. et al. |
| 2021/0184404 | A1 | 6/2021 | Cohen et al. |
| 2021/0203096 | A1 | 7/2021 | Cohen |
| 2021/0234314 | A1 | 7/2021 | Johnescu et al. |
| 2021/0234315 | A1 | 7/2021 | Ellison et al. |
| 2021/0242632 | A1 | 8/2021 | Trout et al. |
| 2022/0094099 | A1 | 3/2022 | Liu et al. |
| 2022/0102916 | A1 | 3/2022 | Liu et al. |
| 2022/0329015 | A1 | 10/2022 | Provencher et al. |
| 2023/0026708 | A1 | 1/2023 | Carbaugh et al. |
| 2023/0062661 | A1 | 3/2023 | Johnescu et al. |
| 2023/0099389 | A1 | 3/2023 | Cohen |

FOREIGN PATENT DOCUMENTS

| | | | |
|---|---|---|---|
| CN | 1237652 | A | 12/1999 |
| CN | 1265470 | A | 9/2000 |
| CN | 2400938 | Y | 10/2000 |
| CN | 1276597 | A | 12/2000 |
| CN | 1280405 | A | 1/2001 |
| CN | 1299524 | A | 6/2001 |
| CN | 2513247 | Y | 9/2002 |
| CN | 2519434 | Y | 10/2002 |
| CN | 2519458 | Y | 10/2002 |
| CN | 2519592 | Y | 10/2002 |
| CN | 1394829 | A | 2/2003 |
| CN | 1398446 | A | 2/2003 |
| CN | 1401147 | A | 3/2003 |
| CN | 1126212 | C | 10/2003 |
| CN | 1127783 | C | 11/2003 |
| CN | 1471749 | A | 1/2004 |
| CN | 1489810 | A | 4/2004 |
| CN | 1491465 | A | 4/2004 |
| CN | 1502151 | A | 6/2004 |
| CN | 1516723 | A | 7/2004 |
| CN | 1179448 | C | 12/2004 |
| CN | 1561565 | A | 1/2005 |
| CN | 1203341 | C | 5/2005 |
| CN | 1639866 | A | 7/2005 |
| CN | 1650479 | A | 8/2005 |
| CN | 1764020 | A | 4/2006 |
| CN | 1799290 | A | 7/2006 |
| CN | 2798361 | Y | 7/2006 |
| CN | 2865050 | Y | 1/2007 |
| CN | 1985199 | Y | 6/2007 |
| CN | 101032060 | A | 9/2007 |
| CN | 201000949 | Y | 1/2008 |
| CN | 101124697 | A | 2/2008 |
| CN | 201022125 | Y | 2/2008 |
| CN | 201038469 | Y | 3/2008 |
| CN | 101164204 | A | 4/2008 |
| CN | 101176389 | A | 5/2008 |
| CN | 101208837 | A | 6/2008 |
| CN | 101273501 | A | 9/2008 |
| CN | 201112782 | Y | 9/2008 |
| CN | 101312275 | A | 11/2008 |
| CN | 101316012 | A | 12/2008 |

(56) References Cited

FOREIGN PATENT DOCUMENTS

| | | | |
|---|---|---|---|
| CN | 201222548 | Y | 4/2009 |
| CN | 201252183 | Y | 6/2009 |
| CN | 101471515 | A | 7/2009 |
| CN | 101552410 | A | 10/2009 |
| CN | 101600293 | A | 12/2009 |
| CN | 201374433 | Y | 12/2009 |
| CN | 101752700 | A | 6/2010 |
| CN | 101783449 | A | 7/2010 |
| CN | 101790818 | A | 7/2010 |
| CN | 201562814 | U | 8/2010 |
| CN | 101854748 | A | 10/2010 |
| CN | 101120490 | B | 11/2010 |
| CN | 101964463 | A | 2/2011 |
| CN | 101124697 | B | 3/2011 |
| CN | 201846527 | U | 5/2011 |
| CN | 102106041 | A | 6/2011 |
| CN | 102157860 | A | 8/2011 |
| CN | 102195173 | A | 9/2011 |
| CN | 201966361 | U | 9/2011 |
| CN | 102232259 | A | 11/2011 |
| CN | 102239605 | A | 11/2011 |
| CN | 102282731 | A | 12/2011 |
| CN | 102292881 | A | 12/2011 |
| CN | 102299429 | A | 12/2011 |
| CN | 102427178 | A | 4/2012 |
| CN | 101600293 | B | 5/2012 |
| CN | 102570100 | A | 7/2012 |
| CN | 102598430 | A | 7/2012 |
| CN | 101258649 | B | 9/2012 |
| CN | 102738621 | A | 10/2012 |
| CN | 102176586 | B | 11/2012 |
| CN | 102782955 | A | 11/2012 |
| CN | 102859805 | A | 1/2013 |
| CN | 202678544 | U | 1/2013 |
| CN | 202695788 | U | 1/2013 |
| CN | 202695861 | U | 1/2013 |
| CN | 102986091 | A | 3/2013 |
| CN | 103036081 | A | 4/2013 |
| CN | 103124030 | A | 5/2013 |
| CN | 202930673 | U | 5/2013 |
| CN | 103151651 | A | 6/2013 |
| CN | 103594871 | A | 2/2014 |
| CN | 103915727 | A | 7/2014 |
| CN | 104241973 | A | 12/2014 |
| CN | 204190038 | U | 3/2015 |
| CN | 104577577 | A | 4/2015 |
| CN | 205212085 | U | 5/2016 |
| CN | 102820589 | B | 8/2016 |
| CN | 106067610 | A | 11/2016 |
| CN | 106099546 | A | 11/2016 |
| CN | 107069274 | A | 8/2017 |
| CN | 304240766 | S | 8/2017 |
| CN | 304245430 | S | 8/2017 |
| CN | 206712089 | U | 12/2017 |
| CN | 207677189 | U | 7/2018 |
| CN | 108832338 | A | 11/2018 |
| CN | 109728456 | A | 5/2019 |
| CN | 109994892 | A | 7/2019 |
| CN | 110212332 | A | 9/2019 |
| CN | 111555069 | A | 8/2020 |
| CN | 112134095 | A | 12/2020 |
| CN | 213636403 | U | 7/2021 |
| DE | 3447556 | A1 | 7/1986 |
| DE | 4109863 | A1 | 10/1992 |
| DE | 4238777 | A1 | 5/1993 |
| DE | 19853837 | C1 | 2/2000 |
| DE | 102006044479 | A1 | 5/2007 |
| DE | 60216728 | T2 | 11/2007 |
| EP | 0560551 | A1 | 9/1993 |
| EP | 0774807 | A2 | 5/1997 |
| EP | 0903816 | A2 | 3/1999 |
| EP | 1018784 | A1 | 7/2000 |
| EP | 1 207 587 | A2 | 5/2002 |
| EP | 1779472 | A1 | 5/2007 |
| EP | 1794845 | A1 | 6/2007 |
| EP | 2169770 | A2 | 3/2010 |
| EP | 2262061 | A1 | 12/2010 |
| EP | 2388867 | A2 | 11/2011 |
| EP | 2390958 | A1 | 11/2011 |
| EP | 2405537 | A1 | 1/2012 |
| EP | 1794845 | B1 | 3/2013 |
| EP | 2811589 | A1 | 12/2014 |
| GB | 1272347 | A | 4/1972 |
| GB | 2161658 | A | 1/1986 |
| GB | 2283620 | A | 5/1995 |
| HK | 1043254 | A1 | 9/2002 |
| JP | H02-079571 | U | 6/1990 |
| JP | H05-54201 | A | 3/1993 |
| JP | H05-234642 | A | 9/1993 |
| JP | H07-57813 | A | 3/1995 |
| JP | H07-302649 | A | 11/1995 |
| JP | H09-63703 | A | 3/1997 |
| JP | H09-274969 | A | 10/1997 |
| JP | 2711601 | B2 | 2/1998 |
| JP | H11-67367 | A | 3/1999 |
| JP | 2896836 | B2 | 5/1999 |
| JP | H11-233200 | A | 8/1999 |
| JP | H11-260497 | A | 9/1999 |
| JP | 2000-013081 | A | 1/2000 |
| JP | 2000-311749 | A | 11/2000 |
| JP | 2001-068888 | A | 3/2001 |
| JP | 2001-510627 | A | 7/2001 |
| JP | 2001-217052 | A | 8/2001 |
| JP | 2002-042977 | A | 2/2002 |
| JP | 2002-053757 | A | 2/2002 |
| JP | 2002-075052 | A | 3/2002 |
| JP | 2002-075544 | A | 3/2002 |
| JP | 2002-117938 | A | 4/2002 |
| JP | 2002-246107 | A | 8/2002 |
| JP | 2003-017193 | A | 1/2003 |
| JP | 2003-309395 | A | 10/2003 |
| JP | 2004-192939 | A | 7/2004 |
| JP | 2004-259621 | A | 9/2004 |
| JP | 3679470 | B2 | 8/2005 |
| JP | 2006-108115 | A | 4/2006 |
| JP | 2006-344524 | A | 12/2006 |
| JP | 2008-515167 | A | 5/2008 |
| JP | 2009-043717 | A | 2/2009 |
| JP | 2009-110956 | A | 5/2009 |
| JP | 2011-018651 | A | 1/2011 |
| JP | 2012-516021 | A | 7/2012 |
| JP | 2016-528688 | A | 9/2016 |
| MX | 9907324 | A1 | 8/2000 |
| TW | 466650 | B | 12/2001 |
| TW | 517002 | B | 1/2003 |
| TW | 534494 | U | 5/2003 |
| TW | 200501874 | A | 1/2005 |
| TW | 200515773 | A | 5/2005 |
| TW | M274675 | U | 9/2005 |
| TW | M329891 | U | 4/2008 |
| TW | M357771 | U | 5/2009 |
| TW | 200926536 | A | 6/2009 |
| TW | M403141 | U | 5/2011 |
| TW | M494411 | U | 1/2015 |
| TW | I475770 | B | 3/2015 |
| TW | M518837 | U | 3/2016 |
| TW | M558482 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565700 | Y | 8/2018 |
| TW | M565894 | Y | 8/2018 |
| TW | M565895 | Y | 8/2018 |
| TW | M565899 | Y | 8/2018 |
| TW | M565901 | Y | 8/2018 |
| TW | M558481 | U | 4/2019 |
| TW | M623128 | U | 2/2022 |
| WO | WO 85/02265 | A1 | 5/1985 |
| WO | WO 88/05218 | A1 | 7/1988 |
| WO | WO 98/35409 | A1 | 8/1998 |
| WO | WO 99/56352 | A2 | 11/1999 |
| WO | WO 01/09332 | A1 | 5/2001 |
| WO | WO 2011/060236 | A1 | 5/2001 |

(56) References Cited

FOREIGN PATENT DOCUMENTS

| | | | |
|---|---|---|---|
| WO | WO 01/57963 | A2 | 8/2001 |
| WO | WO 2002/061892 | A1 | 8/2002 |
| WO | WO 03/013199 | A2 | 2/2003 |
| WO | WO 03/047049 | A1 | 6/2003 |
| WO | WO 2004/034539 | A1 | 4/2004 |
| WO | WO 2004/051809 | A2 | 6/2004 |
| WO | WO 2004/059794 | A2 | 7/2004 |
| WO | WO 2004/059801 | A1 | 7/2004 |
| WO | WO 2004/114464 | A2 | 12/2004 |
| WO | WO 2005/011062 | A2 | 2/2005 |
| WO | WO 2005/114274 | A1 | 12/2005 |
| WO | WO 2006/002356 | A1 | 1/2006 |
| WO | WO 2006039277 | A1 | 4/2006 |
| WO | WO 2007/005597 | A2 | 1/2007 |
| WO | WO 2007/005599 | A1 | 1/2007 |
| WO | WO 2008/072322 | A1 | 6/2008 |
| WO | WO 2008/124052 | A2 | 10/2008 |
| WO | WO 2008/124054 | A2 | 10/2008 |
| WO | WO 2008/124057 | A2 | 10/2008 |
| WO | WO 2008/124101 | A2 | 10/2008 |
| WO | WO 2009/111283 | A2 | 9/2009 |
| WO | WO 2010/030622 | A1 | 3/2010 |
| WO | WO 2010/039188 | A1 | 4/2010 |
| WO | WO 2011/060634 | A2 | 7/2011 |
| WO | WO 2011/100740 | A2 | 8/2011 |
| WO | WO 2011/106572 | A2 | 9/2011 |
| WO | WO 2011/139946 | A1 | 11/2011 |
| WO | WO 2011/140438 | A2 | 11/2011 |
| WO | WO 2011/140438 | A3 | 12/2011 |
| WO | WO 2012/078434 | A2 | 6/2012 |
| WO | WO 2012/106554 | A2 | 8/2012 |
| WO | WO 2013/006592 | A2 | 1/2013 |
| WO | WO 2013/059317 | A1 | 5/2013 |
| WO | WO 2015/013430 | A1 | 1/2015 |
| WO | WO 2015/112717 | A1 | 7/2015 |
| WO | WO 2016/008473 | A1 | 1/2016 |
| WO | WO 2018/039164 | A1 | 3/2018 |

OTHER PUBLICATIONS

Chinese Invalidation Request dated Aug. 17, 2021 in connection with Chinese Application No. 200580040906.5.
Chinese Invalidation Request dated Jun. 1, 2021 in connection with Chinese Application No. 200680023997.6.
Chinese Invalidation Request dated Jun. 15, 2021 in connection with Chinese Application No. 201180033750.3.
Chinese Invalidation Request dated Mar. 17, 2021 in connection with Chinese Application No. 201610952606.4.
Chinese Invalidation Request dated Sep. 9, 2021 in connection with Chinese Application No. 201110008089.2.
Chinese Office Action dated Apr. 2, 2021 in connection with Chinese Application No. 201780073986.7.
Chinese Office Action dated Jan. 10, 2023 in connection with Chinese Application No. 201911147602.9.
Chinese Office Action for Application No. CN201580069567.7 dated Jun. 17, 2019.
Chinese Office Action for Application No. CN201580069567.7 dated Oct. 9, 2019.
Chinese Office Action for Chinese Application No. 201580014851.4 dated Sep. 4, 2019.
Chinese Office Action for Chinese Application No. 201780064531.9 dated Jan. 2, 2020.
Chinese Office Action for Chinese Application No. 202010467444.1 dated Apr. 2, 2021.
Chinese Office Action for Chinese Application No. 202010825662.8 dated Sep. 3, 2021.
Chinese Office Action for Chinese Application No. 202010922401.8 dated Aug. 6, 2021.
Chinese Supplemental Observations dated Jun. 17, 2021 in connection with Chinese Application No. 201210249710.9.
Decision Invalidating CN Patent Application No. 201610952606.4, which issued as CN Utility Model Patent No. 107069274B, and Certified Translation.
Extended European Search Report for European Application No. EP 11166820.8 dated Jan. 24, 2012.
In re Certain Electrical Connectors and Cages, Components Thereof, and Prods. Containing the Same, Inv. No. 337-TA-1241, Order No. 31 (Oct. 19, 2021): Construing Certain Terms of the Asserted Claims of the Patents at Issue.
In re Matter of Certain Electrical Connectors and Cages, Components Thereof, and Products Containing the Same, Inv. No. 337-TA-1241, Complainant Amphenol Corporation's Corrected Initial Post-Hearing Brief. Public Version. Jan. 5, 2022. 451 pages.
In re Matter of Certain Electrical Connectors and Cages, Components Thereof, and Products Containing the Same, Inv. No. 337-TA-1241, Complainant Amphenol Corporation's Post-Hearing Reply Brief. Public Version. Dec. 6, 2021. 159 pages.
In re Matter of Certain Electrical Connectors and Cages, Components Thereof, and Products Containing the Same, Inv. No. 337-TA-1241, Luxshare Respondents' Initial Post-Hearing Brief. Public Version. Nov. 23, 2021. 348 pages.
In re Matter of Certain Electrical Connectors and Cages, Components Thereof, and Products Containing the Same, Inv. No. 337-TA-1241, Luxshare Respondents' Reply Post-Hearing Brief. Public Version. Dec. 6, 2021. 165 pages.
In re Matter of Certain Electrical Connectors and Cages, Components Thereof, and Products Containing the Same, Inv. No. 337-TA-1241, Notice of Prior Art. Jun. 3, 2021. 319 pages.
In re Matter of Certain Electrical Connectors and Cages, Components Thereof, and Products Containing the Same, Inv. No. 337-TA-1241, Respondents' Pre-Hearing Brief. Redacted. Oct. 21, 2021. 219 pages.
In the Matter of Certain Electrical Connectors and Cages, Components Thereof, and Products Containing the Same, Inv. No. 337-TA-1241, Final Initial Determination on Violation of Section 337. Public Version. Mar. 11, 2022. 393 pages.
International Preliminary Report on Patentability Chapter II dated Apr. 1, 2022 in connection with International Application No. PCT/US2021/015073.
International Preliminary Report on Patentability Chapter II dated Apr. 5, 2022 in connection with International Application No. PCT/US2021/015048.
International Preliminary Report on Patentability for International Application No. PCT/US2005/034605 dated Apr. 3, 2007.
International Preliminary Report on Patentability for International Application No. PCT/US2006/025562 dated Jan. 9, 2008.
International Preliminary Report on Patentability for International Application No. PCT/US2010/056482 dated May 24, 2012.
International Preliminary Report on Patentability for International Application No. PCT/US2011/026139 dated Sep. 7, 2012.
International Preliminary Report on Patentability for International Application No. PCT/US2012/023689 dated Aug. 15, 2013.
International Preliminary Report on Patentability for International Application No. PCT/US2012/060610 dated May 1, 2014.
International Preliminary Report on Patentability for International Application No. PCT/US2015/012463 dated Aug. 4, 2016.
International Preliminary Report on Patentability for International Application No. PCT/US2017/047905, dated Mar. 7, 2019.
International Preliminary Report on Patentability for International Application No. PCT/US2017/057402 dated May 2, 2019.
International Preliminary Report on Patentability dated Aug. 11, 2022 in connection with International Application No. PCT/US2021/015178.
International Search Report and Written Opinion for International Application No. PCT/US2005/034605 dated Jan. 26, 2006.
International Search Report and Written Opinion for International Application No. PCT/US2006/25562 dated Oct. 31, 2007.
International Search Report and Written Opinion for International Application No. PCT/US2010/056482 dated Mar. 14, 2011.
International Search Report and Written Opinion for International Application No. PCT/US2010/056495 dated Jan. 25, 2011.
International Search Report and Written Opinion for International Application No. PCT/US2011/026139 dated Nov. 22, 2011.

(56) References Cited

OTHER PUBLICATIONS

International Search Report and Written Opinion for International Application No. PCT/US2011/034747 dated Jul. 28, 2011.
International Search Report and Written Opinion for International Application No. dated Sep. 12, 2012.
International Search Report and Written Opinion for International Application No. PCT/US2012/060610 dated Mar. 29, 2013.
International Search Report and Written Opinion for International Application No. PCT/US2014/026381 dated Aug. 12, 2014.
International Search Report and Written Opinion for International Application No. PCT/US2015/012463 dated May 13, 2015.
International Search Report and Written Opinion for International Application No. PCT/US2015/012542 dated Apr. 30, 2015.
International Search Report and Written Opinion for International Application No. PCT/US2015/060472 dated Mar. 11, 2016.
International Search Report and Written Opinion for International Application No. PCT/US2016/043358 dated Nov. 3, 2016.
International Search Report and Written Opinion for International Application No. PCT/US2017/033122 dated Aug. 8, 2017.
International Search Report and Written Opinion for International Application No. PCT/US2017/047905 dated Dec. 4, 2017.
International Search Report and Written Opinion for International Application No. PCT/US2017/057402 dated Jan. 19, 2018.
International Search Report and Written Opinion for International Application No. PCT/US2018/045207 dated Nov. 29, 2018.
International Search Report and Written Opinion dated Dec. 28, 2021 in connection with International Application No. PCT/CN2021/119849.
International Search Report and Written Opinion dated Jul. 1, 2021 in connection with International Application No. PCT/US2021/015048.
International Search Report and Written Opinion dated May 17, 2021 in connection with International Application No. PCT/US2021/015073.
International Search Report and Written Opinion dated May 17, 2021 in connection with International Application No. PCT/US2021/015178.
International Search Report with Written Opinion for International Application No. PCT/US2006/025562 dated Oct. 31, 2007.
Invalidity Claim Charts Based on CN 201112782Y ("Cai"). Luxshare Respondents' Supplemental Responses to Interrogatories Nos. 13 and 14, Exhibit 25. May 7, 2021. 147 pages.
Invalidity Claim Charts Based on U.S. Pat. No. 6,179,651 ("Huang"). Luxshare Respondents' Supplemental Responses to Interrogatories Nos. 13 and 14, Exhibit 26. May 7, 2021. 153 pages.
Invalidity Claim Charts Based on U.S. Pat. No. 7,261,591 ("Korsunsky"). Luxshare Respondents' Supplemental Responses to Interrogatories Nos. 13 and 14, Exhibit 27. May 7, 2021. 150 pages.
Petition for Inter Partes Review. *Luxshare Precision Industry Co., Ltd* v. *Amphenol Corp.* U.S. Pat. No. 10,381,767. IPR2022-00132. Nov. 4, 2021. 112 pages.
Taiwanese Office Action dated Mar. 15, 2022 in connection with Taiwanese Application No. 110140608.
Taiwanese Office Action dated Mar. 5, 2021 in connection with Taiwanese Application No. 106128439.
[No Author Listed], Amphenol TCS expands the Xcede Platform with 85 Ohm Connectors and High-Speed Cable Solutions. Press Release. Published Feb. 25, 2009. http://www.amphenol.com/about/news_archive/2009/58 [Retrieved on Mar. 26, 2019 from Wayback Machine]. 4 pages.
[No Author Listed], Agilent. Designing Scalable 10G Backplane Interconnect Systems Utilizing Advanced Verification Methodologies. White Paper, Published May 5, 2012. 24 pages.
[No Author Listed], All About ESD Plastics. Evaluation Engineering. Jul. 1, 1998. 8 pages. https://www.evaluationengineering.com/home/article/13001136/all-about-esdplastics [last accessed Mar. 14, 2021].
[No Author Listed], AMP Incorporated Schematic, Cable Assay, 2 Pair, HMZD. Oct. 3, 2002. 1 page.
[No Author Listed], Board to Backplane Electrical Connector. The Engineer. Mar. 13, 2001, [last accessed Apr. 30, 2021]. 2 pages.
[No Author Listed], Borosil Vision Mezzo Mug Set of 2. Zola. 3 pages. https://www.zola.com/shop/product/borosil_vision_mezzao_mug_setof2_3.25. [date retrieved May 4, 2021].
[No Author Listed], Cable Systems. Samtec. Aug. 2010. 148 pages.
[No Author Listed], Carbon Nanotubes For Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], Coating Electrical Contacts. Brush Wellman Engineered Materials. Jan. 2002;4(1). 2 pages.
[No Author Listed], Common Management Interface Specification. Rev 4.0. MSA Group. May 8, 2019. 265 pages.
[No Author Listed], Electronics Connector Overview. FCI. Sep. 23, 2009. 78 pages.
[No Author Listed], EMI Shielding Compounds Instead of M et al. RTP Company. Last Accessed Apr. 30, 2021. 2 pages.
[No Author Listed], EMI Shielding Solutions and EMC Testing Services from Laird Technologies. Laird Technologies. Last acessed Apr. 30, 2021. 1 page.
[No Author Listed], EMI Shielding, Dramatic Cost Reductions for Electronic Device Protection. RTP. Jan. 2000. 10 pages.
[No Author Listed], Excerpt from The Concise Oxford Dictionary, Tenth Edition. 1999. 3 pages.
[No Author Listed], Excerpt from The Merriam-Webster Dictionary, Between. 2005. 4 pages.
[No Author Listed], Excerpt from Webster's Third New International Dictionary, Contact. 1986. 3 pages.
[No Author Listed], FCI—High Speed Interconnect Solutions, Backpanel Connectors. FCI. [last accessed Apr. 30, 2021). 2 pages.
[No Author Listed], File:Wrt54gl-layout.jpg Sep. 8, 2006. Retrieved from the Internet: https://xinu.mscs.mu.edu/File:Wrt54gl-layout.jpg [retrieved on Apr. 9, 2019]. 2 pages.
[No Author Listed], General Product Specification for GbX Backplane and Daughtercard Interconnect System. Revision "B". Teradyne. Aug. 23, 2005. 12 pages.
[No Author Listed], Hitachi Cable America Inc. Direct Attach Cables. 8 pages. Retrieved Aug. 10, 2017 from http://www.hca.hitachi-cable.com/products/hca/catalog/pdfs/direct-attach-cable-assemblies.pdf [last accessed Mar. 6, 2019].
[No Author Listed], High Speed Backplane Connectors. Tyco Electronics. Product Catalog No. 1773095. Revised Dec. 2008. 1-40 pages.
[No Author Listed], HOZOX EMI Absorption Sheet and Tape. Molex. Laird Technologies. 2013. 2 pages.
[No Author Listed], INF-8074i Specification for SFP (Small Formfactor Pluggable) Transceiver. SFF Committee. Revision 1.0. May 12, 2001. 39 pages.
[No Author Listed], INF-8438i Specification for QSFP (Quad Small Formfactor Pluggable) Transceiver. Rev 1.0 Nov. 2006. SFF Committee. 76 pages.
[No Author Listed], Interconnect Signal Integrity Handbook. Samtec. Aug. 2007. 21 pages.
[No Author Listed], Metallized Conductive Products: Fabric-Over-Foam, Conductive Foam, Fabric, Tape. Laird Technologies. 2003. 32 pages.
[No Author Listed], Metral® 2000 Series. FCI. 2001. 2 pages.
[No Author Listed], Metral® 2mm High-Speed Connectors 1000, 2000, 3000 Series. FCI. 2000. 119 pages.
[No Author Listed], Metral® 3000 Series. FCI. 2001. 2 pages.
[No Author Listed], Metral® 4000 Series. FCI. 2002. 2 pages.
[No Author Listed], Metral® 4000 Series: High-Speed Backplane Connectors. FCI, Rev. 3. Nov. 30, 2001. 21 pages.
[No Author Listed], Military Fibre Channel High Speed Cable Assembly. www.gore.com. 2008. [last accessed Aug. 2, 2012 via Internet Archive: Wayback Machine http://web.archive.org] Link archived: http://www.gore.com/en.sub.--xx/products/cables/copper/networking/militar-y/military.sub.-- fibre . . . Last archive date Apr. 6, 2008.

(56) References Cited

OTHER PUBLICATIONS

[No Author Listed], Molex Connectors as InfiniBand Solutions. Design World. Nov. 19, 2008. 7 pages. https://www.designworldonline.com/molex-connectors-as-infiniband-solutions/. [last accessed May 3, 2021].
[No Author Listed], OSFP MSA Specification for OSFP Octal Small Form Factor Pluggable Module. Revision 1.11. OSFP MSA. Jun. 26, 2017. 53 pages.
[No Author Listed], OSFP MSA Specification for OSFP Octal Small Form Factor Pluggable Module. Revision 1.12. OSFP MSA. Aug. 1, 2017. 53 pages.
[No Author Listed], OSFP MSA Specification for OSFP Octal Small Form Factor Pluggable Module. Revision 2.0 OSFP MSA. Jan. 14, 2019. 80 pages.
[No Author Listed], OSFP MSA Specification for OSFP Octal Small Form Factor Pluggable Module. Revision 3.0 OSFP MSA. Mar. 14, 2020. 99 pages.
[No Author Listed], Photograph of Molex Connector. Oct. 2021. 1 page.
[No Author Listed], Photograph of TE Connector. Oct. 2021. 1 page.
[No Author Listed], Pluggable Form Products. Tyco Electronics. Mar. 5, 2006. 1 page.
[No Author Listed], Pluggable Input/Output Solutions. Tyco Electronics Catalog 1773408-1. Revised Feb. 2009. 40 pages.
[No Author Listed], QSFP Market Evolves, First Products Emerge. Lightwave. Jan. 2, 20082. pp. 1-8. https://www.lightwaveonline.com/home/article/16662662.
[No Author Listed], QSFP-DD Hardware Specification for QSFP Double Density 8X Pluggable Transceiver, Rev 3.0. QSFP-DD MSA. Sep. 19, 2017. 69 pages.
[No Author Listed], QSFP-DD Hardware Specification for QSFP Double Density 8X Pluggable Transceiver, Rev 4.0. QSFP-DD MSA. Sep. 18, 2018. 68 pages.
[No Author Listed], QSFP-DD MSA QSFP-DD Hardware Specification for QSFP Double Density 8X Pluggable Transceiver. Revision 5.0. QSFP-DD-MSA. Jul. 9, 2019. 82 pages.
[No Author Listed], QSFP-DD MSA QSFP-DD Hardware Specification for QSFP Double Density 8X Pluggable Transceiver. Revision 5.1. QSFP-DD MSA. Aug. 7, 2020. 84 pages.
[No Author Listed], QSFP-DD MSA QSFP-DD Specification for QSFP Double Density 8X Pluggable Transceiver. Revision 1.0. QSFP-DD-MSA. Sep. 15, 2016. 69 pages.
[No Author Listed], QSFP-DD Specification for QSFP Double Density 8X Pluggable Transceiver Specification, Rev. 2.0. QSFP-DD MSA. Mar. 13, 2017. 106 pages.
[No Author Listed], RTP Company Introduces "Smart" Plastics for Bluetooth Standard. Press Release. RTP. Jun. 4, 2001. 2 pages.
[No Author Listed], RTP Company Specialty Compounds. RTP. Mar. 2002. 2 pages.
[No Author Listed], RTP Company-EMI/RFI Shielding Compounds (Conductive) Data Sheets. RTP Company. Last accessed Apr. 3, 20210. 4 pages.
[No Author Listed], Samtec Board Interface Guide. Oct. 2002. 253 pages.
[No Author Listed], SFF Committee SFF-8079 Specification for SFP Rate and Application Selection. Revision 1.7. SFF Committee. Feb. 2, 2005. 21 pages.
[No Author Listed], SFF Committee SFF-8089 Specification for SFP (Small Formfactor Pluggable) Rate and Application Codes. Revision 1.3. SFF Committee. Feb. 3, 2005. 18 pages.
[No Author Listed], SFF Committee SFF-8436 Specification for Qsfp+ 4X 10 GB/s Pluggable Transceiver. Revision 4.9. SFF Committee. Aug. 31, 2018. 88 pages.
[No Author Listed], SFF Committee SFF-8665 Specification for QSFP+ 28 GB/s 4X Pluggable Transceiver Solution (QSFP28). Revision 1.9. SFF Committee. Jun. 29, 2015. 14 pages.
[No Author Listed], SFF-8075 Specification for PCI Card Version of SFP Cage. Rev 1.0. SFF Committee. Jul. 3, 2001. 11 pages.
[No Author Listed], SFF-8431 Specifications for Enhanced Small Form Factor Pluggable Module SFP+. Revision 4.1. SFF Committee. Jul. 6, 2009. 132 pages.
[No Author Listed], SFF-8432 Specification for SFP+ Module and Cage. Rev 5.1. SFF Committee. Aug. 8, 2012. 18 pages.
[No Author Listed], SFF-8433 Specification for SFP+ Ganged Cage Footprints and Bezel Openings. Rev 0.7. SFF Committee. Jun. 5, 2009. 15 pages.
[No Author Listed], SFF-8477 Specification for Tunable XFP for ITU Frequency Grid Applications. Rev 1.4. SFF Committee. Dec. 4, 2009. 13 pages.
[No Author Listed], SFF-8672 Specification for QSFP+ 4x 28 GB/s Connector (Style B). Revision 1.2. SNIA. Jun. 8, 2018. 21 pages.
[No Author Listed], SFF-8679 Specification for QSFP+4X Base Electrical Specification. Rev 1.7. SFF Committee. Aug. 12, 2014. 31 pages.
[No Author Listed], SFF-8682 Specification for Qsfp+ 4X Connector. Rev 1.1. Snia Sff Twg Technology Affiliate. Jun. 8, 2018. 19 pages.
[No Author Listed], Shielding Theory and Design. Laird Technologies. Last accessed Apr. 30, 2021. 1 page.
[No Author Listed], Shielding Theory and Design. Laird Technologies. Last accessed Apr. 3,0 2021. 2 pages. URL:web.archive.org/web/20030226182710/http://www.lairdtech.com/catalog/staticdata/shieldingtheorydesign/std_3.htm.
[No Author Listed], Shielding Theory and Design. Laird Technologies. Last accessed Apr. 30, 2021. 2 pages. URL:web.archive.org/web/20021223144443/http://www.lairdtech.com/catalog/staticdata/shielding theorydesign/std_2.htm.
[No Author Listed], Signal Integrity—Multi-Gigabit Transmission Over Backplane Systems. International Engineering Consortium. 2003;1-8.
[No Author Listed], Signal Integrity Considerations for 10Gbps Transmission over Backplane Systems. DesignCon2001. Teradyne Connections Systems, Inc. 2001. 47 pages.
[No Author Listed], Size 8 High Speed Quadrax and Differential Twinax Contacts for Use in MIL-DTL-38999 Special Subminiature Cylindrical and ARINC 600 Rectangular Connectors. Published May 2008. 10 pages. Retrieved from https://www.peigenesis.com/images/content/news/amphenol_quadrax.pdf.
[No Author Listed], Specification for OSFP Octal Small Form Factor Pluggable Module. Rev 1.0. Osfp Msa. Mar. 17, 2017. 53 pages.
[No Author Listed], TB-2092 GbX Backplane Signal and Power Connector Press-Fit Installation Process. Teradyne. Aug. 8, 2002;1-9.
[No Author Listed], Teradyne Beefs Up High-Speed GbX Connector Platform. EE Times. Sep. 20, 2005. 3 pages.
[No Author Listed], Teradyne Connection Systems Introduces the GbX L-Series Connector. Press Release. Teradyne. Mar. 22, 2004. 5 pages.
[No Author Listed], Teradyne Schematic, Daughtercard Connector Assembly 5 Pair GbX, Drawing No. C-163-5101-500. Nov. 6, 2002. 1 page.
[No Author Listed], Tin as a Coating Material. Brush Wellman Engineered Materials. Jan. 2002;4(2). 2 pages.
[No Author Listed], Two and Four Pair HM-Zd Connectors. Tyco Electronics. Oct. 14, 2003;1-8.
[No Author Listed], Tyco Electronics Schematic, Header Assembly, Right Angle, 4 Pair HMZd, Drawing No. C-1469048. Jan. 10, 2002. 1 page.
[No Author Listed], Tyco Electronics Schematic, Receptacle Assembly, 2 Pair 25mm HMZd, Drawing No. C-1469028. Apr. 24, 2002. 1 page.
[No Author Listed], Tyco Electronics Schematic, Receptacle Assembly, 3 Pair 25mm HMZd, Drawing No. C1469081. May 13, 2002. 1 page.
[No Author Listed], Tyco Electronics Schematic, Receptacle Assembly, 4 Pair HMZd, Drawing No. C1469001. Apr. 23, 2002. 1 page.
[No Author Listed], Tyco Electronics Z-Dok+ Connector. May 23, 2003. PP. 1-15. http://zdok.tycoelectronics.com.
[No Author Listed], Tyco Electronics, SFP System. Small Form-Factor Pluggable (SFP) System. Feb. 2001. 1 page.

(56) References Cited

OTHER PUBLICATIONS

[No Author Listed], Typical conductive additives—Conductive Compounds. RTP Company. https://www.rtpcompany.com/products/conductive/additives.htm. Last accessed Apr. 30, 2021. 2 pages.
[No Author Listed], Z-Pack HM-Zd Connector, High Speed Backplane Connectors. Tyco Electronics. Catalog 1773095. 2009;5-44.
[No Author Listed], Z-Pack HM-Zd: Connector Noise Analysis for XAUI Applications. Tyco Electronics. Jul. 9, 2001. 19 pages.
Atkinson et al., High Frequency Electrical Connector, U.S. Appl. No. 15/645,931, filed Jul. 10, 2017.
Beaman, High Performance Mainframe Computer Cables. 1997 Electronic Components and Technology Conference. 1997;911-7.
Chung, Electrical applications of carbon materials. J. of Materials Science. 2004;39:2645-61.
Cohen et al., High-Frequency Electrical Connector, U.S. Appl. No. 18/100,447, filed Jan. 23, 2023.
Dahman, Recent Innovations of Inherently Conducting Polymers for Optimal (106-109 Ohm/Sq) ESD Protection Materials. RTD Company. 2001. 8 pages.
Do et al., A Novel Concept Utilizing Conductive Polymers on Power Connectors During Hot Swapping in Live Modular Electronic Systems. IEEE Xplore 2005; downloaded Feb. 18, 2021;340-345.
Eckardt, Co-Injection Charting New Territory and Opening New Markets. Battenfeld GmbH. Journal of Cellular Plastics. 1987;23:555-92.
ELCO, Metral® High Bandwidth—A Differential Pair Connector for Applications up to 6 GHz. FCI. Apr. 26, 1999;1-5.
Feller et al., Conductive polymer composites: comparative study of poly(ester)-short carbon fibres and poly(epoxy)-short carbon fibres mechanical and electrical properties. Materials Letters. Feb. 21, 2002;57:64-71.
Fjelstad, Flexible Circuit Technology. Third Edition. BR Publishing, Inc. Sep. 2006. 226 pages. ISBN 0-9667075-0-8.
Getz et al., Understanding and Eliminating EMI in Microcontroller Applications. National Semiconductor Corporation. Aug. 1996. 30 pages.
Grimes et al., A Brief Discussion of EMI Shielding Materials. IEEE. 1993:217-26.
Housden et al., Moulded Interconnect Devices. Prime Faraday Technology Watch. Feb. 2002. 34 pages.
Kirk et al., Connector Configurable for High Performance, U.S. Appl. No. 18/085,093, filed Dec. 20, 2022.
McAlexander, CV of Joseph C. McAlexander III . Exhibit 1009. 2021. 31 pages.
McAlexander, Declaration of Joseph C. McAlexander III in Support of Petition for Inter Partes Review of U.S. Pat. No. 10,381,767. Exhibit 1002. Nov. 4, 2021. 85 pages.
Muha et al., High Speed, High Density Connector, U.S. Appl. No. 17/794,578, filed Jul. 21, 2022.
Nadolny et al., Optimizing Connector Selection for Gigabit Signal Speeds. Sep. 2000. 5 pages.
Neelakanta, Handbook of Electromagnetic Materials: Monolithic and Composite Versions and Their Applications. CRC. 1995. 246 pages.
Okinaka, Significance of Inclusions in Electroplated Gold Films for Electronics Applications. Gold Bulletin. Aug. 2000;33(4): 117-127.
Ott, Noise Reduction Techniques In Electronic Systems. Wiley. Second Edition. 1988. 124 pages.
Patel et al., Designing 3.125 Gbps Backplane System. Teradyne. 2002. 58 pages.
Preusse, Insert Molding vs. Post Molding Assembly Operations. Society of Manufacturing Engineers. 1998. 8 pages.
Reich et al., Microwave Theory and Techniques. Boston Technical Publishers, Inc. 1965;182-91.
Ross, Focus on Interconnect: Backplanes Get Reference Designs. EE Times. Oct. 27, 2003 [last accessed Apr. 30, 2021]. 4 pages.
Ross, GbX Backplane Demonstrator Helps System Designers Test High-Speed Backplanes. EE Times. Jan. 27, 2004 [last accessed May 5, 2021]. 3 pages.
Shi et al. Improving Signal Integrity in Circuit Boards by Incorporating Absorbing Materials. 2001 Proceedings. 51st Electronic Components and Technology Conference, Orlando FL. 2001:1451-56.
Silva et al., Conducting Materials Based on Epoxy/Graphene Nanoplatelet Composites With Microwave Absorbing Properties: Effect of the Processing Conditions and Ionic Liquid. Frontiers in Materials. Jul. 2019;6(156):1-9. doi: 10.3389/fmats.2019.00156.
Tracy, Rev. 3.0 Specification IP (Intellectual Property). Mar. 20, 2020. 8 pages.
Violette et al., Electromagnetic Compatibility Handbook. Van Nostrand Reinhold Company Inc. 1987. 229 pages.
Wagner et al., Recommended Engineering Practice to Enhance the EMI/EMP Immunity of Electric Power Systems. Electric Research and Management, Inc. Dec. 1992. 209 pages.
Weishalla, Smart Plastic for Bluetooth. RTP Imagineering Plastics. Apr. 2001. 7 pages.
White, A Handbook on Electromagnetic Shielding Materials and Performance. Don Whie Consultants. 1998. Second Edition. 77 pages.
White, EMI Control Methodology and Procedures. Don White Consultants, Inc. Third Edition 1982. 22 pages.
Williams et al., Measurement of Transmission and Reflection of Conductive Lossy Polymers at Millimeter-Wave Frequencies. IEEE Transactions on Electromagnetic Compatibility. Aug. 1990;32(3):236-240.
U.S. Appl. No. 16/518,362, filed Jan. 16, 2020, Milbrand, Jr. et al.
U.S. Appl. No. 16/795,398, filed Feb. 19, 2020, Paniagua et al.
U.S. Appl. No. 17/102,133, filed Nov. 23, 2020, Cartier et al.
U.S. Appl. No. 17/164,400, filed Feb. 1, 2021, Kirk et al.
U.S. Appl. No. 17/181,639, filed Feb. 22, 2021, Cohen.
U.S. Appl. No. 17/181,822, filed Feb. 22, 2021, Cohen et al.
U.S. Appl. No. 17/477,352, filed Sep. 16, 2021, Liu et al.
U.S. Appl. No. 17/477,391, filed Sep. 16, 2021, Liu et al.
U.S. Appl. No. 17/794,578, filed Jul. 21, 2022, Muha et al.
U.S. Appl. No. 17/824,381, filed May 25, 2022, Provencher et al.
U.S. Appl. No. 17/868,165, filed Jul. 19, 2022, Carbaugh et al.
U.S. Appl. No. 17/902,342, filed Sep. 2, 2022, Johnescu et al.
U.S. Appl. No. 18/075,313, filed Dec. 5, 2022, Cohen.
U.S. Appl. No. 18/085,093, filed Dec. 20, 2022, Kirk et al.
U.S. Appl. No. 18/100,447, filed Jan. 23, 2023 Cohen et al.
CN 200580040906.5, Aug. 17, 2021, Chinese Invalidation Request.
CN 200680023997.6, Jun. 1, 2021, Chinese Invalidation Request.
CN 201110008089.2, Sep. 9, 2021, Chinese Invalidation Request.
CN 201180033750.3, Jun. 15, 2021, Chinese Invalidation Request.
CN 201210249710.9, Jun. 17, 2021, Chinese Supplemental Observations.
CN 201580014851.4, Jun. 01, 2020, Chinese Communication.
CN 201580014851.4, Sep. 4, 2019, Chinese Office Action.
CN 201610952606.4, Mar. 17, 2021, Chinese Invalidation Request.
CN 201780073986.7, Apr. 2, 2021, Chinese Office Action.
CN 201911147602.9, Jan. 10, 2023, Chinese Office Action.
CN 202010467444.1, Apr. 02, 2021, Chinese Office Action.
CN 202010825662.8, Sep. 3, 2021, Chinese Office Action.
CN 202010922401.8, Aug. 6, 2021, Chinese Office Action.
CN201580069567.7, Jun. 17, 2019, Chinese Office Action.
CN201580069567.7, Oct. 9, 2019, Chinese Office Action.
CN201780064531.9, Jan. 2, 2020, Chinese Office Action.
EP 11166820.8, Jan. 24, 2012, Extended European Search Report.
PCT/CN2021/119849, Dec. 28, 2021, International Search Report and Written Opinion.
PCT/US2005/034605, Apr. 3, 2007, International Preliminary Report on Patentability.
PCT/US2005/034605, Jan. 26, 2006, International Search Report and Written Opinion.
PCT/US2006/025562, Jan. 8, 2008, International Preliminary Report on Patentability.
PCT/US2006/025562, Oct. 31, 2007, International Search Report and Written Opinion.
PCT/US2006/025562, Oct. 31, 2007, International Search Report with Written Opinion.
PCT/US2010/056482, May 24, 2012, International Preliminary Report on Patentability.

(56) References Cited

OTHER PUBLICATIONS

PCT/US2010/056482, Mar. 14, 2011, International Search Report and Written Opinion.
PCT/US2010/056495, Jan. 25, 2011, International Search Report and Written Opinion.
PCT/US2011/026139, Sep. 7, 2012, International Preliminary Report on Patentability.
PCT/US2011/026139, Nov. 22, 2011, International Search Report and Written Opinion.
PCT/US2011/034747, Jul. 28, 2011, International Search Report and Written Opinion.
PCT/US2012/023689, Aug. 15, 2013, International Preliminary Report on Patentability.
PCT/US2012/023689, Sep. 12, 2012, International Search Report and Written Opinion.
PCT/US2012/060610, May 1, 2014, International Preliminary Report on Patentability.
PCT/US2012/060610, Mar. 29, 2023, International Search Report and Written Opinion.
PCT/US2014/026381, Aug. 12, 2014, International Search Report and Written Opinion.
PCT/US2015/012463, Aug. 4, 2016, International Premiminary Report on Patentability.
PCT/US2015/012463, May 13, 2015, International Search Report and Written Opinion.
PCT/US2015/012542, Apr. 30, 2015, International Search Report and Written Opinion.
PCT/US2015/060472, Mar. 11, 2016, International Search Report and Written Opinion.
PCT/US2016/043358, Nov. 3, 2016, International Search Report and Written Opinion.
PCT/US2017/033122, Aug. 8, 2017, International Search Report and Written Opinion.
PCT/US2017/047905, Mar. 7, 2019, International Preliminary Report on Patentability.
PCT/US/2017/047905, Dec. 4, 2017, International Search Report and Written Opinion.
PCT/US2017/057402, May 2, 2019, International Preliminary Report on Patentability.
PCT/US2017/057402, Jan. 19, 2018, International Search Report and Written Opinion.
PCT/US2018/045207, International Search Report and Written Opinion.
PCT/US2021/015048, Jul. 1, 2021, International Search Report and Written Opinion.
PCT/US2021/015048, Apr. 5, 2022, International Preliminary Report on Patentability Chapter II.
PCT/US2021/015073, May 17, 2021, International Search Report and Written Opinion.
PCT/US2021/015072, Apr. 1, 2022, International Preliminary Report on Patentability Chapter II.
PCT/US2021/015178, May 17, 2021, International Search Report and Written Opinion.
PCT/US2021/015178, Aug. 11, 2022, International Preliminary Report on Patentability.
TW 106128439, Mar. 5, 2021, Taiwanese Office Action.
TW 110140608, Mar. 15, 2022, Taiwanese Office Action.

* cited by examiner

HIGH SPEED, HIGH DENSITY DIRECT MATE ORTHOGONAL CONNECTOR

RELATED APPLICATIONS

This patent application is a continuation of U.S. patent application Ser. No. 17/158,543, now U.S. Pat. No. 11,469,554, filed on Jan. 26, 2021 and entitled "HIGH SPEED, HIGH DENSITY DIRECT MATE ORTHOGONAL CONNECTOR," which is hereby incorporated herein by reference in its entirety. U.S. patent application Ser. No. 17/158,543 claims priority to and the benefit of U.S. Provisional Patent Application Ser. No. 62/966,521, filed Jan. 27, 2020 and entitled "HIGH SPEED, HIGH DENSITY DIRECT MATE ORTHOGONAL CONNECTOR," which is hereby incorporated herein by reference in its entirety. U.S. patent application Ser. No. 17/158,543 claims priority to and the benefit of U.S. Provisional Patent Application Ser. No. 62/966,528, filed Jan. 27, 2020 and entitled "HIGH SPEED CONNECTOR," which is hereby incorporated herein by reference in its entirety. U.S. patent application Ser. No. 17/158,543 also claims priority to and the benefit of U.S. Provisional Patent Application Ser. No. 63/076,692, filed Sep. 10, 2020 and entitled "HIGH SPEED CONNECTOR," which is hereby incorporated herein by reference in its entirety.

TECHNICAL FIELD

This patent application relates generally to interconnection systems, such as those including electrical connectors, used to interconnect electronic assemblies.

BACKGROUND

Electrical connectors are used in many electronic systems. It is generally easier and more cost effective to manufacture a system as separate electronic assemblies, such as printed circuit boards ("PCBs"), which may be joined together with electrical connectors. A known arrangement for joining several printed circuit boards is to have one printed circuit board serve as a backplane. Other printed circuit boards, called "daughterboards" or "daughtercards," may be connected through the backplane.

A known backplane is a printed circuit board onto which many connectors may be mounted. Conducting traces in the backplane may be electrically connected to signal conductors in the connectors so that signals may be routed between the connectors. Daughtercards may also have connectors mounted thereon. The connectors mounted on a daughtercard may be plugged into the connectors mounted on the backplane. In this way, signals may be routed among the daughtercards through the backplane. The daughtercards may plug into the backplane at a right angle. The connectors used for these applications may therefore include a right angle bend and are often called "right angle connectors."

In other system configurations, signals may be routed between parallel boards, one above the other. Connectors used in these applications are often called "stacking connectors" or "mezzanine connectors." In yet other configurations, orthogonal boards may be aligned with edges facing each other. Connectors used to connect printed circuit boards in this configuration are often called "direct mate orthogonal connectors".

Regardless of the exact application, electrical connector designs have been adapted to mirror trends in the electronics industry. Electronic systems generally have gotten smaller, faster, and functionally more complex. Because of these changes, the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

In a high density, high speed connector, electrical conductors may be so close to each other that there may be electrical interference between adjacent signal conductors. To reduce interference, and to otherwise provide desirable electrical properties, shield members are often placed between or around adjacent signal conductors. The shields may prevent signals carried on one conductor from creating "crosstalk" on another conductor. The shield may also impact the impedance of each conductor, which may further contribute to desirable electrical properties.

Other techniques may be used to control the performance of a connector. For instance, transmitting signals differentially may also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. No shielding is desired between the conducting paths of the pair, but shielding may be used between differential pairs. Electrical connectors can be designed for differential signals as well as for single-ended signals.

In an interconnection system, connectors are attached to printed circuit boards. Typically a printed circuit board is formed as a multi-layer assembly manufactured from stacks of dielectric sheets, sometimes called "prepreg." Some or all of the dielectric sheets may have a conductive film on one or both surfaces. Some of the conductive films may be patterned, using lithographic or laser printing techniques, to form conductive traces that are used to make interconnections between circuit boards, circuits and/or circuit elements. Others of the conductive films may be left substantially intact and may act as ground planes or power planes that supply the reference potentials. The dielectric sheets may be formed into an integral board structure by heating and pressing the stacked dielectric sheets together.

To make electrical connections to the conductive traces or ground/power planes, holes may be drilled through the printed circuit board. These holes, or "vias", are filled or plated with metal such that a via is electrically connected to one or more of the conductive traces or planes through which it passes.

To attach connectors to the printed circuit board, contact "tails" from the connectors may be inserted into the vias or attached to conductive pads on a surface of the printed circuit board that are connected to a via.

SUMMARY

Embodiments of a high speed, high density interconnection system are described.

Some embodiments relate to an electrical connector. The electrical connector includes a plurality of leadframe assemblies, each leadframe assembly comprising a plurality of conductive elements, each of the plurality of conductive elements comprising a mating end and a mounting end opposite the mating ends; a housing holding the plurality of leadframe assemblies, the housing includes a front housing; and a plurality of core members held by the front housing, the plurality of core members comprising conductive material. Mating ends of the conductive elements of leadframes of the plurality of leadframes are disposed on opposite sides of respective core members of the plurality of core members. Selective ones of the mating ends of the conductive elements of the leadframes on the opposite sides of a core member of the plurality of core members are coupled via the conductive material of the core member.

Some embodiments relate to a leadframe assembly. The leadframe assembly includes a plurality of conductive elements, each of the plurality of conductive element comprising a mating end, a mounting end opposite the mating end, and an intermediate portion extending between the mating end and the mounting end, the mating ends of the plurality of conductive elements being aligned in a first row, the mounting ends of the plurality of conductive elements being aligned in a second row parallel to the first row, wherein the intermediate portions of the plurality of conductive elements are bent so as to provide first segments parallel to the mating ends and second segments parallel to the mounting ends; a leadframe housing holding the intermediate portions of the plurality of conductive elements, the leadframe housing comprising at least one portion holding the second segments of the plurality of conductive elements; and a shield separated from the plurality of conductive elements by the leadframe housing, the shield comprising a plurality of mounting ends, the plurality of mounting ends of the ground shield being aligned in a third row that is parallel to and offset from the second row. The at least one portion of the leadframe housing comprises portions comprising surfaces facing towards the mounting ends of the shield and engaged with edges of the shield.

Some embodiments relate to a compliant shield for an electrical connector. The electrical connector comprises a plurality of mounting ends for attachment to a printed circuit board. The compliant shield includes a conductive body made of a foam material suitable for a first portion of the mounting ends from the electrical connector to pierce through so as to maintain physical contacts with the first portion of the mounting ends from the electrical connector, the first portion of the mounting ends from the electrical connector being configured for grounding; and a plurality of openings in the conductive body, the plurality of openings sized and positioned for a second portion of the mounting ends from the electrical connector to pass therethrough without physically contacting the portion of the mounting ends from the electrical connector, the second portion of the mounting ends being configured for signals.

Some embodiments relate to an electrical connector. The electrical connector includes a plurality of leadframe assemblies. Each leadframe assembly includes a plurality of conductive elements, each conductive element comprising mating and mounting portions and intermediate portions connect the mating and mounting portions, wherein broadsides of the mating portions and the broadsides of the mounting portions extending in planes perpendicular to each other, and a leadframe housing holding the plurality of conductive elements. The leadframe housing includes a first portion secured to portions of the plurality of conductive elements extending parallel to the plane of the mating portions, a second portion secured to portions of the plurality of conductive elements extending parallel to the plane of the mounting portions, and at least one member extending from the second portion. The electrical connector includes a housing holding the plurality of leadframe assemblies, the housing comprising a front housing holding the first portion of the leadframe housings of the plurality of leadframe assemblies in slots separated by separators. The members of the leadframe housings make contact with respective separators of the front housing such that a force on the front housing for mounting the connector to a board is at least partially transferred to the second portion of the leadframe housings.

Some embodiments relate to a printed circuit board. The printed circuit board includes a surface, a plurality of differential pairs of signal vias disposed in first rows, a ground plane at an inner layer of the printed circuit board, and a plurality of ground vias connecting to the ground plane, the plurality of ground vias configured to receive ground mounting ends of a mounting connector, the plurality of ground vias disposed in second rows that are offset from the first rows in a direction perpendicular to the first rows and are offset from the differential pairs of signal vias in a direction parallel to the first rows.

The foregoing summary is provided by way of illustration and is not intended to be limiting.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
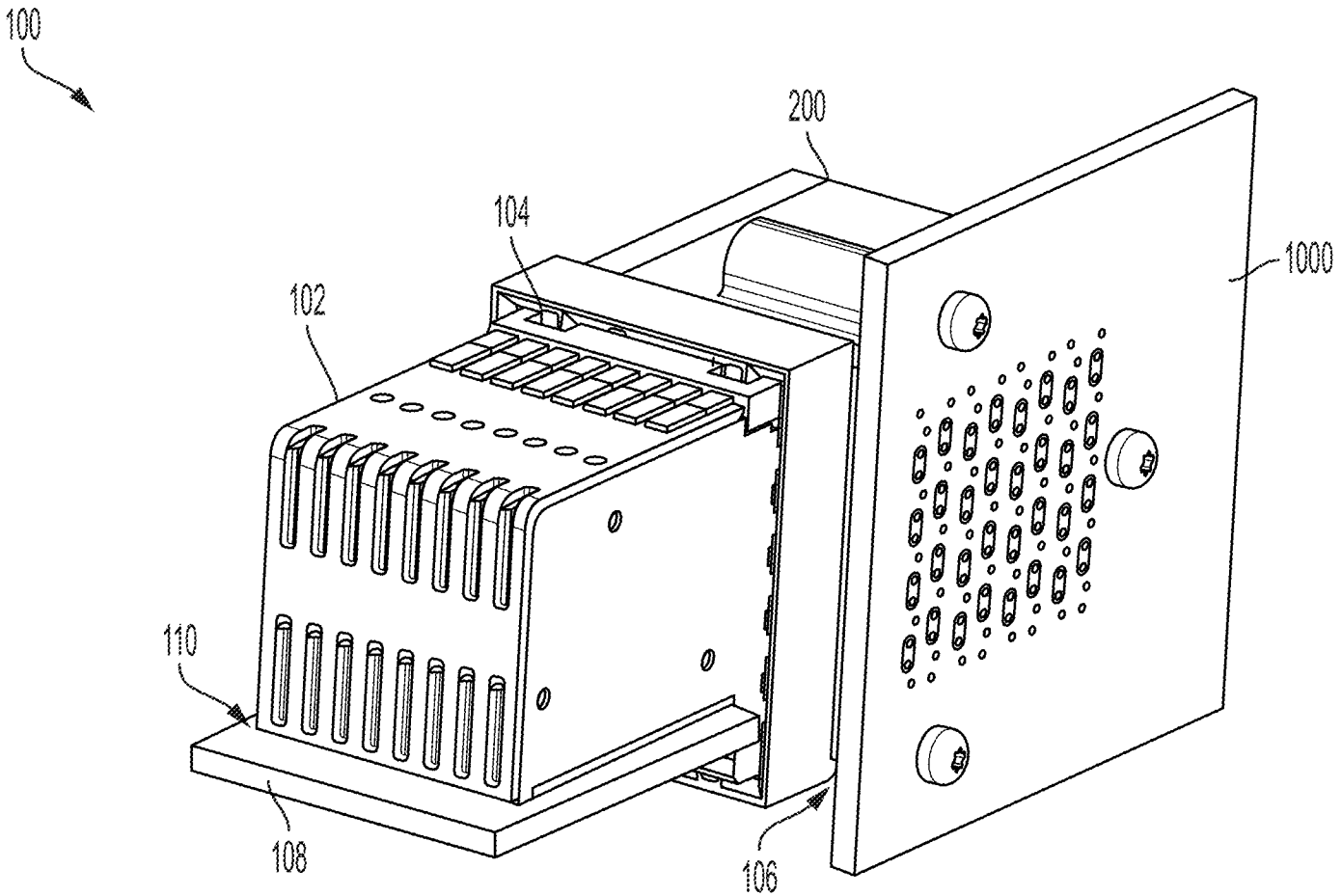
FIG. 1 is a perspective view of an electrical interconnection system, according to some embodiments.

The inventors have recognized and appreciated connector designs that increase performance of a high density interconnection system, particularly those that carry very high frequency signals that are necessary to support high data rates. The connector designs may provide conductive shielding and lossy material in locations that provide desirable performance at very high frequencies, including at 112 GHz and above, for closely spaced signal conductors of a high density interconnect. These designs may also provide a robust connector that is economical to manufacture, even when miniaturized to provide high density interconnects.

Conventional designs, while effective up to certain frequencies, may not perform as expected at very high frequencies, for example, at or above 112 GHz. To enable effective isolation of the signal conductors at very high frequencies, the connector may include conductive material selectively molded over by lossy material. The conductive material may provide effective shielding in a mating region where two connectors are mated. When the two connectors are mated, the mating interface shielding may be disposed between mated portions of conductive elements carrying separate signals.

These techniques may be applied to a connector that supports a direct mate orthogonal system configuration. The connector may have rows of conductive elements, parallel to a surface of a printed circuit board to which the connector is mounted, configured for mating with a second connector that has columns of conductive elements perpendicular to a surface of a second printed circuit board to which the second connector is mounted.

The direct mate orthogonal connector may be constructed of leadframe assemblies including shielding for the intermediate portions of conductive elements passing through the connector. Components of the leadframe assembly may be configured to preserve the positional relationship between the shield and signal conductive elements upon insertion of the mounting ends of the conductive elements and shields into holes in a printed circuit board, enhancing high frequency performance. Signal conductors, for example, may be held within an insulative housing of the leadframe assembly. The leadframe housing may have features that engage with a leadframe shield and a connector housing. The leadframe housing may transfer a force applied to the connector housing to mount a connector onto a printed circuit board to both the conductive elements in the leadframe and the leadframe shields. Relative position of the shield and conductive elements may be maintained, even under the force of inserting pressfits of the shield and conductive elements into holes in aboard for mounting the connector.

Desirable electrical performance at the mating interface may be provided through the use of core members that include conductive material and/or lossy material. These core members may be integrated into a front portion of a housing for the connector such that the, when the leadframe assemblies are inserted into the housing, the mating ends of the conductive elements of the leadframe assemblies align with the core members.

The core members may be formed with features that facilitate mating, including projections that deflect the mating ends of conductive elements from the second connector to avoid mechanical stubbing of the mating ends of the two connectors. These features may be readily molded in the core members, even if molding similar features as part of the housing would be difficult or prone to manufacturing defects. The conductive material in the core member, in addition to enhancing electrical performance may provide a mechanical function, such as stiffening the core members and facilitating integration of the core members in the housing.

The connector may have features that support desirable electrical and/or mechanical properties at a mounting interface. To reduce undesirable emissions at a mounting region where the connector is mounted to a printed circuit board (PCB), the connector may include a compressible shield. The compressible shield may be configured to provide current paths between internal shields within the connector and ground structures in the PCB. These current paths may run parallel to signal conductors passing from the connector to the PCB. The inventors have found that such a compressible shield, though spanning a small distance between the connector and the board, such as 2 mm or less, provides a desirable increase in signal integrity, particularly for high frequency signals.

A compressible shield may be simply implemented with a conductive foam sheet, which may be adhere to an organizer of the connector. The organizer may include standoffs that set a spacing between the connector and the PCB when the connector is secured to the board, such as with screws. Such a configuration precludes the counter force generated by compression of the compliant shield from disrupting reliable mounting of the connector to the board, ensuring robust attachment of the connector to the board. The standoffs may have a height that provides partial compression of compliant shield, ensuring a reliable connection between internal shields and the ground planes of the printed circuit board not withstanding variations in dimensions of parts as manufactured.

A printed circuit board to which the direct mate orthogonal connector is mounted also may be configured for enhanced electrical and mechanical performance. Robust connector performance may also be enhanced by aligning press fits of conductors of a leadframe assembly, including the signal conductive elements and leadframe shields, with intermediate portions of those conductors. Such a configuration may transfer force through the intermediate portion in a direction aligned with the press fit, providing a low risk of the press fits collapsing upon mounting of a connector to a PCB. Mounting holes in the PCB may be configured to support this configuration. In some embodiments, a connector footprint in the PCB may have pairs of mounting holes positioned in rows, receiving pressfits of pairs of signal conductive elements in the leadframe assemblies.

Holes for receiving pressfits for the leadframe shields may also be positioned in rows, parallel to the rows of holes for the signal conductive elements. A row of holes of the shield pressfits of a leadframe assembly may be offset in the column direction, perpendicular to the row direction, from the row of holes for the signal pressfits for that leadframe. A hole for a shield pressfit may be adjacent each pair of holes for signal pressfits.

In some embodiments, shadow vias, which may be smaller in diameter than the vias that receive pressfits may be connected to ground and positioned, within a row of signal vias, between each pair. Alternatively or additionally, shadow vias may be positioned between each pair of signal vias in a row and a pair of signal vias in an adjacent parallel row.

These techniques may be used separately or may be used together, to provide desirable electrical characteristics for the interconnection system from the board through the connector to another connector, which may similarly be configured for desirable electrical performance at high frequencies. An example of such an electrical connector is shown, for example, in co-pending U.S. application Ser. No. 17/158,214 titled "HIGH SPEED CONNECTOR," which is hereby incorporated herein by reference in its entirety.

An exemplary embodiment of such connectors is illustrated in FIG. 1 in which a direct mate orthogonal connector has a right angle orthogonal configuration. FIG. 1 depicts an electrical interconnection system 100 of the form that may be used in an electronic system. This example illustrates a direct mate orthogonal configuration, as printed circuit board 108 is orthogonal, and edge to edge, with respect to printed circuit board 1000. Electrical connections between PCB 108 and 1000 are made through two mating connectors, here illustrated as a right angle orthogonal connector 200 and a right angle connector 102.

FIG. 1 illustrates a portion of an electronic system, such as an electronic switch or router. FIG. 1 illustrates only a portion of each of the PCB's 108 and 1000. Other portions of the PCB's, including portions to which other connectors or other electronic components are mounted, are not shown for simplicity. Further, such a system may include more than two printed circuit boards. Additional printed circuit boards, parallel to either PCB 108 or PCB 1000, may be included, for example. Regardless of the number of printed circuit boards, connectors as illustrated in FIG. 1 may be used to make connections between those that are orthogonal to each other.

In the illustrated embodiment, the right angle orthogonal connector 200 is attached to a printed circuit board 1000 at a mounting interface 106, and mated to the header connector 700 at a mating interface 104. The right angle connector 102 may be attached to a printed circuit board 108 at a mounting interface 110. At the mounting interfaces, conductive elements, acting as signal conductors, within the connectors may be connected to signal traces within the respective printed circuit boards. For connectors including ground conductive elements, those may be connected to ground structures within the printed circuit board.

To support mounting of the connectors to respective printed circuit boards, right angle orthogonal connector 200 may include contact tails configured to attach to the printed circuit board 1000. The right angle connector 102 may include contact tails configured to attach to the printed circuit board 108. These contact tails may form one end of conductive elements that pass through the mated connectors. When the connectors are mounted to printed circuit boards, these contact tails will make electrical connection to conductive structures within the printed circuit board that carry signals or are connected to a reference potential. In some embodiments, the contact tails may be press fit, "eye of the needle (EON)," contacts that are designed to be pressed into vias in a printed circuit board, which in turn may be connected to signal traces or ground planes or other conductive structures within the printed circuit board. In some embodiments, other forms of contact tails may be used, for example, surface mount contacts, BGA attachments, or pressure contacts.

At the mounting interfaces, shields internal to the connectors may also be connected to conductive structures in the printed circuit boards. Such connections may be made using the same techniques as for the signal and/or ground conductive elements. Alternatively or additionally, shields may be connected through the use of compliant members and/or compliant shields that provide a conductive path for conductive structures in the connector to ground planes on the surface of the PCB.

At the mating interfaces, the conductive elements in each connector make mechanical and electrical connections such that the conductive traces in the printed circuit board 108 may be electrically connected to conductive traces in the printed circuit board 1000 through the mated connectors. Conductive elements acting as ground conductors within each connector may be similarly connected, such that the ground structures within the printed circuit board 108 similarly may be electrically connected to ground structures in the printed circuit board 1000.

In the embodiment of FIG. 1, each of the connectors has linear arrays of mating ends for the conductive elements that mate to other conductive elements at the mating interface. In mating the two connectors, each linear array of mating ends of one connector align with, and press against, the mating ends in a linear array of the other connector. In the illustrated embodiment, the mating ends have broadsides and edges. Each of the linear arrays may include mating ends positioned edge-to-edge along the array, such that the broadsides are parallel to the axis of the array. When mated, the broadsides of two mating ends may press against each other.

In the orthogonal configuration of FIG. 1, to achieve alignment of broadsides of the mating ends of connectors mounted to orthogonal PCBs, the two mating connectors have arrays with different orientations relative to the PCB to which the connector is mounted. In this example, connector 102 has columns of mating ends extending perpendicularly to PCB 108 in a vertical orientation. Connector 200 has rows of mating ends extending parallel to PCB 1000 in a horizontal orientation.

In the example of FIG. 1, connector 102 may be a right angle connector, such as used in mating to a backplane header or a cable connector. Such a connector, and construction techniques to make such a connector, are described in co-pending U.S. application Ser. No. 17/158,214 titled "HIGH SPEED CONNECTOR." Orthogonal connector 200 may be constructed using the same construction techniques, adapted for a direct mate orthogonal form factor. The construction techniques described more fully in co-pending U.S. application Ser. No. 17/158,214 titled "HIGH SPEED CONNECTOR" and applied to connector 200 may include the use of insert molded leadframe assemblies (IMLAs), with IMLA shields. Those techniques also include the use of a core member, containing features of a mating interface of the connector that is molded separately from, but added into a connector housing into which the IMLAs are inserted. Shielding within the core members, incorporation of lossy material at the mating interface and interconnection of the core shield and IMLA shield may also be applied to connector 200. Further, an organizer and/or a compliant shield at the mounting interface may also be employed. Further details of these techniques as adapted for use in connector 200 are provided below.

Figure 2B:
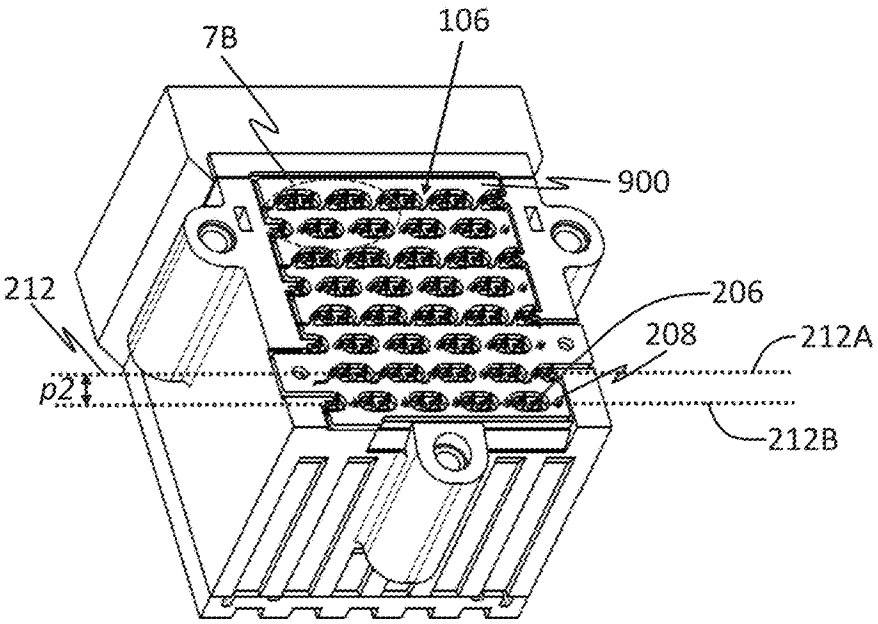
FIG. 2B is a perspective view of the right angle orthogonal connector of FIG. 2A, illustrating the mounting interface of the right angle orthogonal connector, according to some embodiments.
Figure 2A:
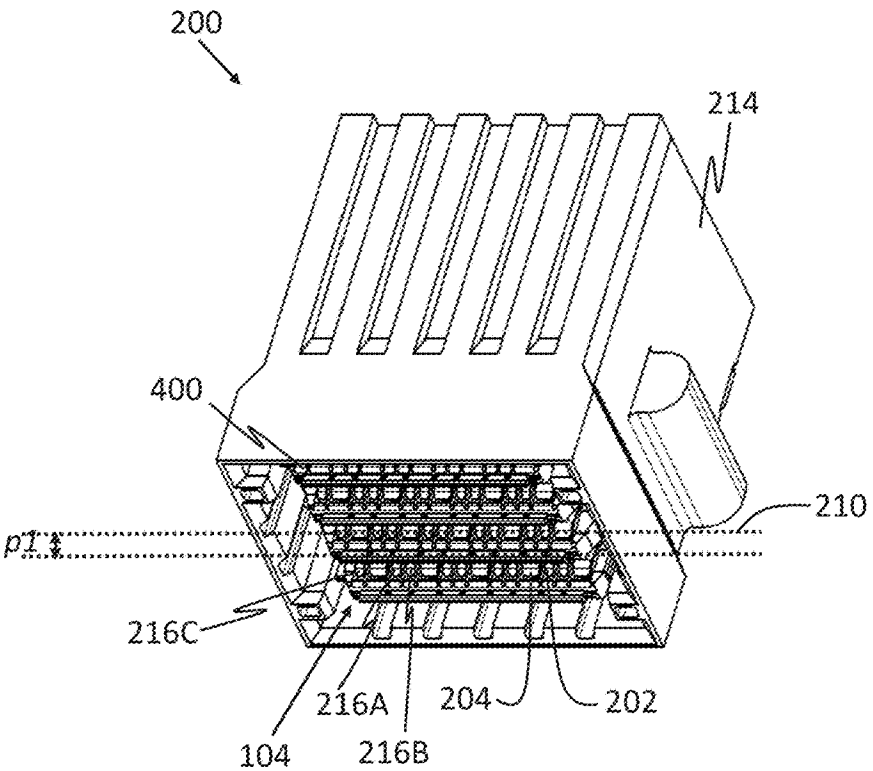
FIG. 2A is a perspective view of a right angle orthogonal connector in the electrical interconnection system of FIG. 1, illustrating the mating interface of the right angle orthogonal connector, according to some embodiments.
Figure 2C:
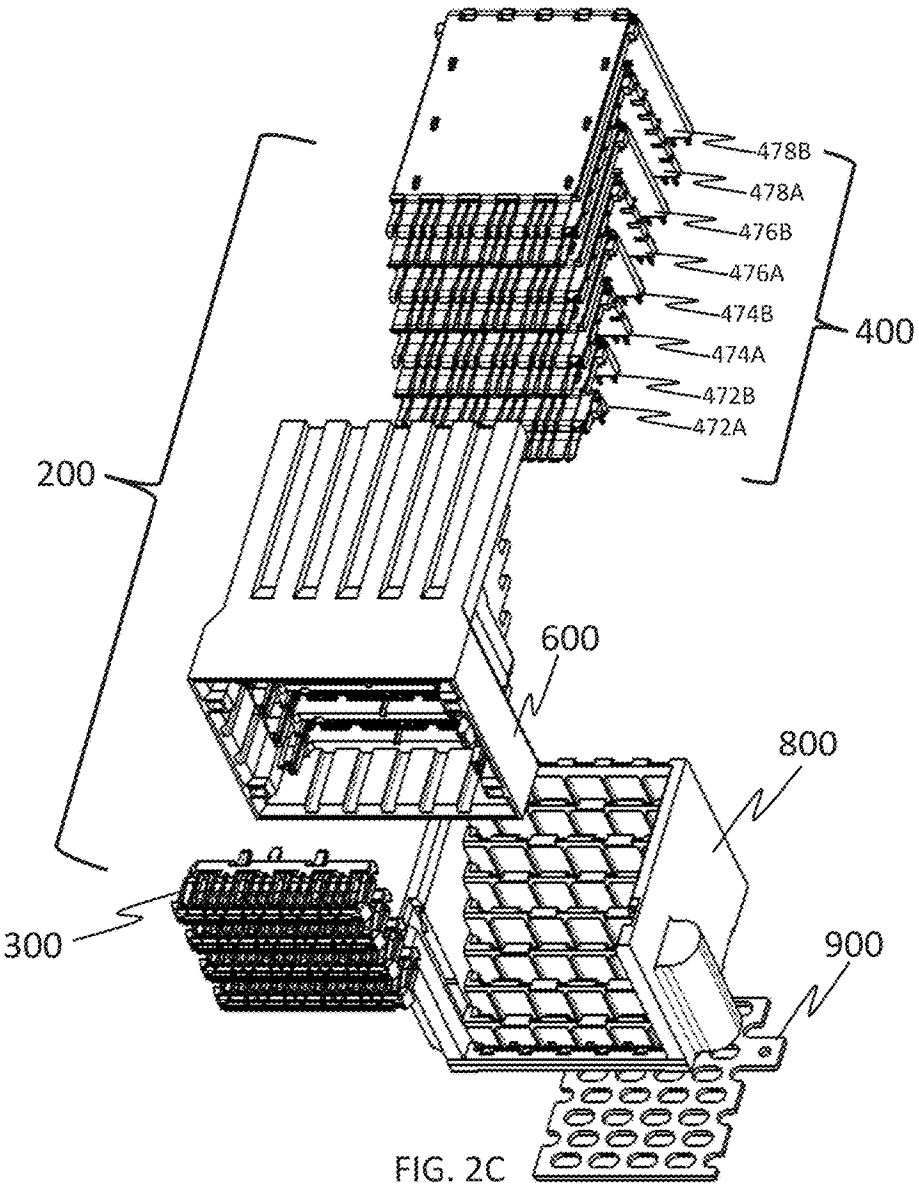
FIG. 2C is an exploded view of the right angle orthogonal connector of FIG. 2A, according to some embodiments.

FIGS. 2A and 2B are perspective views of the right angle orthogonal connector 200, according to some embodiments. FIG. 2C is an exploded view of the right angle orthogonal connector 200, according to some embodiments. The right angle orthogonal connector 200 may include leadframe assemblies 400, core members 300, a housing 214 holding the leadframe assemblies 400, and a compressible shield 900 at the mounting interface 106. The leadframe assemblies 400 may include mating ends (e.g., signal mating ends 202 and ground mating ends 204) disposed in rows 210 at the mating interface 104, and mounting ends (e.g., signal mounting ends 206 and ground mounting ends 208) disposed in rows 212 at the mounting interface 106.

The rows 210 may have a row-to-row pitch p1. The row-to-row pitch p1 may be compatible with a mating connector (e.g., the right angle connector 102). The rows 212 may be parallel to the rows 210, and have a row-to-row pitch p2. The row-to-row pitch p2 may be configured for a suitable footprint on a board (e.g., the printed circuit board 1000). In some embodiments, the row-to-row pitch p2 may have the same value as the row-to-row pitch p1. In some embodiments, the row-to-row pitch p2 may have a value different from that of the row-to-row pitch p1. The inventors found that such design enables the connectors to be matable with existing connectors, which may have larger pitches, and to have a desirable footprint, which may have a density higher than that of the existing connectors such that the row pitch p2 may be smaller than that of existing connectors and may also be smaller than row pitch p1.

At the mating interface 104, a row 210 of mating ends may include signal mating ends shaped and spaced in pairs to provide pairs of differential signal mating ends (e.g., 216A and 216B), and/or signal mating ends shaped and spaced to form single ended signal mating ends (e.g., 216C). The signal mating ends may be separated by respective ground mating ends 204. It should be appreciated that ground conductors need not be connected to earth ground, but are shaped to carry reference potentials, which may include earth ground, DC voltages or other suitable reference potentials. The "ground" or "reference" conductors may have a shape different than the signal conductors, which are configured to provide suitable signal transmission properties for high frequency signals.

Correspondingly, at the mounting interface 106, a row 212 of mounting ends may include signal mounting ends 206 and ground mounting ends 208. As illustrated in FIG. 2B, the mounting ends of the adjacent rows 212A and 212B may be offset from each other such that the ground mounting ends in the row 212A may overlap with signal mounting ends in the row 212B and reduce row-to-row cross talk.

The housing 214 may include one or more separately formed portions that engage to one another or are otherwise held together in a connector. In the illustrated example, housing 214 includes a front housing 600 and a rear housing 800. Front housing 600 may include a mating interface of connector 200. Core members 300 may be held by the front housing 600, and may form a portion of the mating interface of the connector.

Rear housing 800 may engage with, and may partially enclose, the front housing 600. Rear housing 800 may include the mounting interface of connector 200. In the illustrated example, rear housing 800 includes a bottom surface through which mounting ends of the conductors within connector 200 extend. That floor may be insulative and may act as an organizer for the mounting ends that positions and/or supports the mounting ends so that they may be pressed into holes in a PCB to which connector 200 is mounted. Alternatively or additionally, the floor of rear housing 800 may serve as a support member for attaching a compressible shield 900.

As illustrated in FIG. 2C, in some embodiments, the core members 300 may be inserted into the front housing 600 in a mating direction. The leadframe assemblies 400 may be inserted into the front housing 600 from the back of the front housing 600. The rear housing 800 may be added from the bottom of the front housing 600 such that the mounting ends of the leadframe assemblies 400 extend out of the rear housing 800.

Figure 3B:
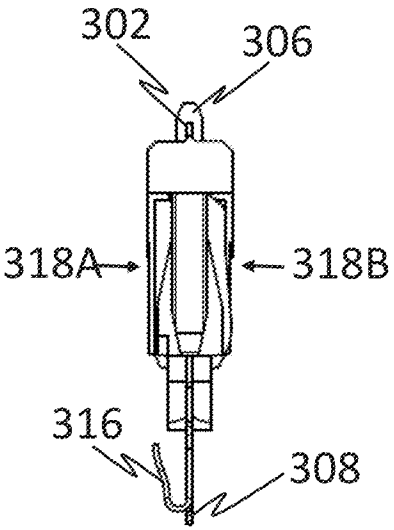
FIG. 3B is a side view of the core member of FIG. 3A, according to some embodiments.
Figure 3A:
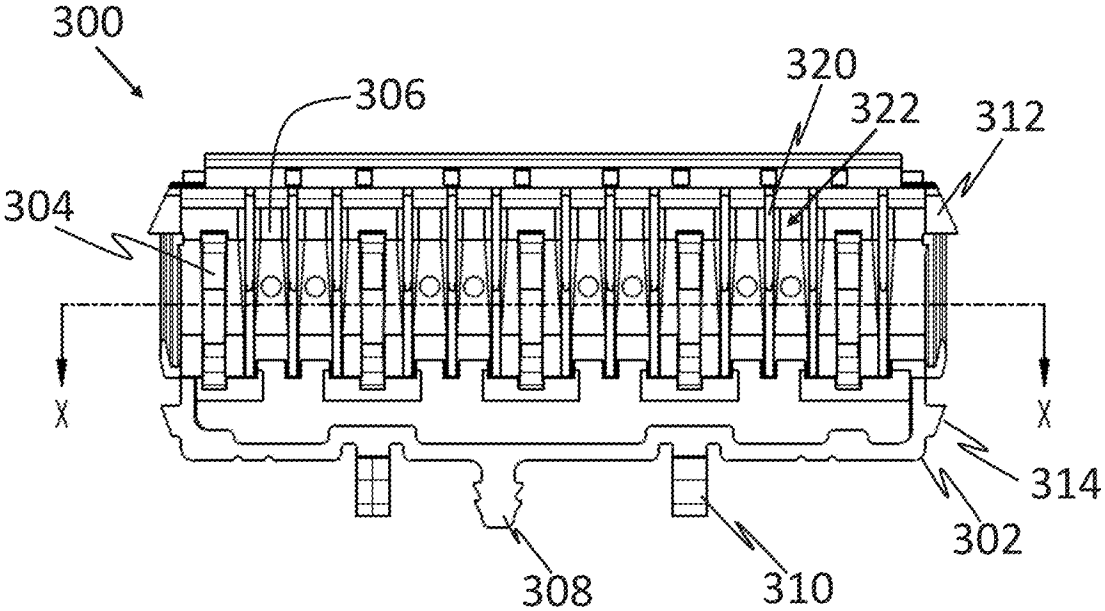
FIG. 3A is an elevation view of a core member of the right angle orthogonal connector of FIG. 2A, according to some embodiments.
Figure 3C:
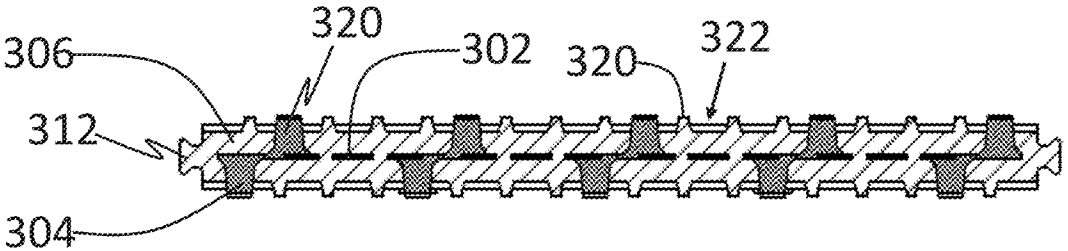
FIG. 3C is a cross-sectional view of the core member of FIG. 3A along the line marked "X-X" in FIG. 3A, according to some embodiments.
Figure 3D:
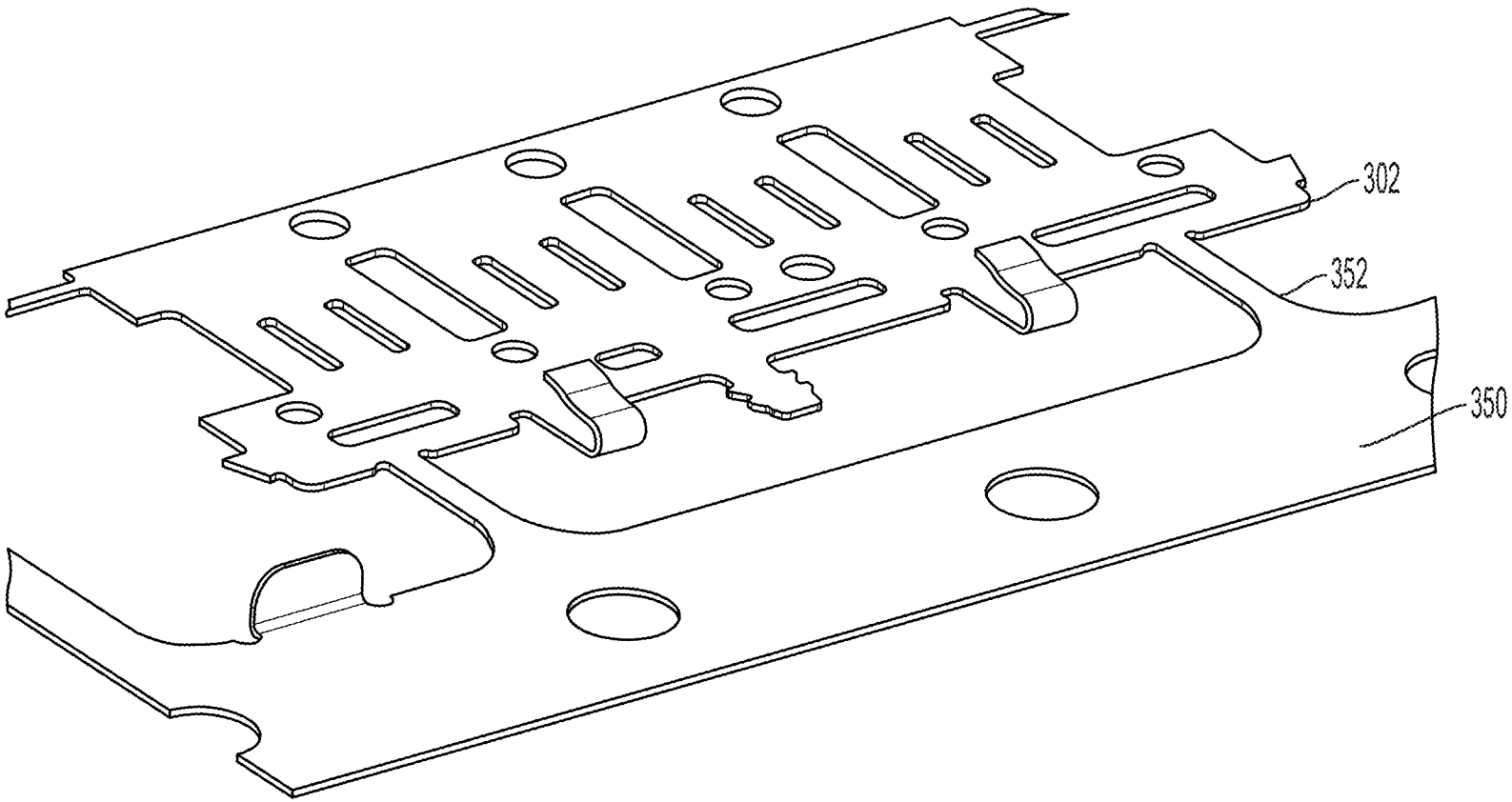
FIG. 3D is a perspective view of conductive material of a core member attached to carrier strips, prior to being molded over with lossy and insulative material.

A core member 300 may be adjacent the mating ends of one or more leadframe assemblies 400. In the illustrated embodiments, the mating ends of two leadframe assemblies are on opposite sides of each core member. FIG. 3A and FIG. 3B depict a top plan view and a side view of a core member 300, respectively, according to some embodiments. FIG. 3C depicts a cross-sectional view of the core member 300 along the line marked "X-X" in FIG. 3A, according to some embodiments. FIG. 3D depicts conductive material 302 within a core member, with lossy material and insulative material, which may be molded conductive material 302, not shown. FIG. 3D illustrates the conductive material 302 attached to a carrier strip 350 through tie bars 352, which may be formed at the same time that conductive material 302 is cut from a larger sheet of metal. Carrier strip 350 may be used to manipulate conductive material 302 during insert molding operations. A core member 300 may be freed from the carrier strip 350 after severing the tie bars 352 and prior to insertion of a core member 300 into a front housing 600.

The core member 300 may include conductive material 302 selectively overmolded with lossy material 304 and insulative material 306. The conductive material 302 may be metal or any other material that is conductive and provides suitable mechanical properties for shields in an electrical connector. Stainless steel, or phosphor-bronze, beryllium copper and other copper alloys are non-limiting examples of materials that may be used. The conductive material may be a sheet of metal that is stamped and formed into the shape illustrated. In some embodiments, the conductive material may have a planar region that passes through the interior of the core member. That planar region, for example, may be along the midline of the core member such that it is equidistant from the mating ends on opposing sides of the core member. That planar region may be solid, may contain one or more holes and/or slits to enable lossy or insulative material to flow through the conductive material during an insert molding operation and lock onto the conductive material, for example. Features may be formed in the conductive material to support other functions. For example, features may be formed at the periphery of the conductive material to mechanically and/or electrically connect the core member to other structures in the connector, such as the front housing, the housing of leadframe assemblies and/or shields of the leadframe assemblies.

The conductive material 302 may include retention features 308 configured to be inserted into matching receivers in the front housing 600. Here the retention features are configured as barbed tabs that can be inserted into a slot in a cross piece, such as slot 652 in cross piece 650 (FIG. 6) of front housing 600. Barbs 314 may also be formed to engage side walls of the front housing.

The conductive material 302 may include projections for making contact with other ground structures within the connector 200. Here those projections are configured as hooks 310 with distal ends serving as contact portions 316. Contact portions 316 may be positioned to press against a leadframe shield when the core member and leadframes are both inserted in front housing 600. In this example, hooks 310 fit within openings 604 (FIG. 6) of cross piece 650 such that contact portions 316 will press against a leadframe shield of a respective one of the leadframe assemblies 472A, 474A, 476A and 478A with mating ends aligned with the lower side of the core member.

In the illustrated example, the conductive material 302 of a core member 300 includes a retention feature 308 in the middle and two hooks 310 on opposite side of the retention feature. The contact portions 316 of the two hooks 310 are, in this example in the same direction so as to make contact with the same leadframe shield but may, in other embodiments, be bent in opposite directions such that one contact portion 316 can make contact with ground structures of a first leadframe assembly 400 at a first side 318A of the core member 300, and the other contact portion 316 can make contact with ground structures of a second leadframe assembly 400 at a second side 318B of the core member 300.

Figure 3E:
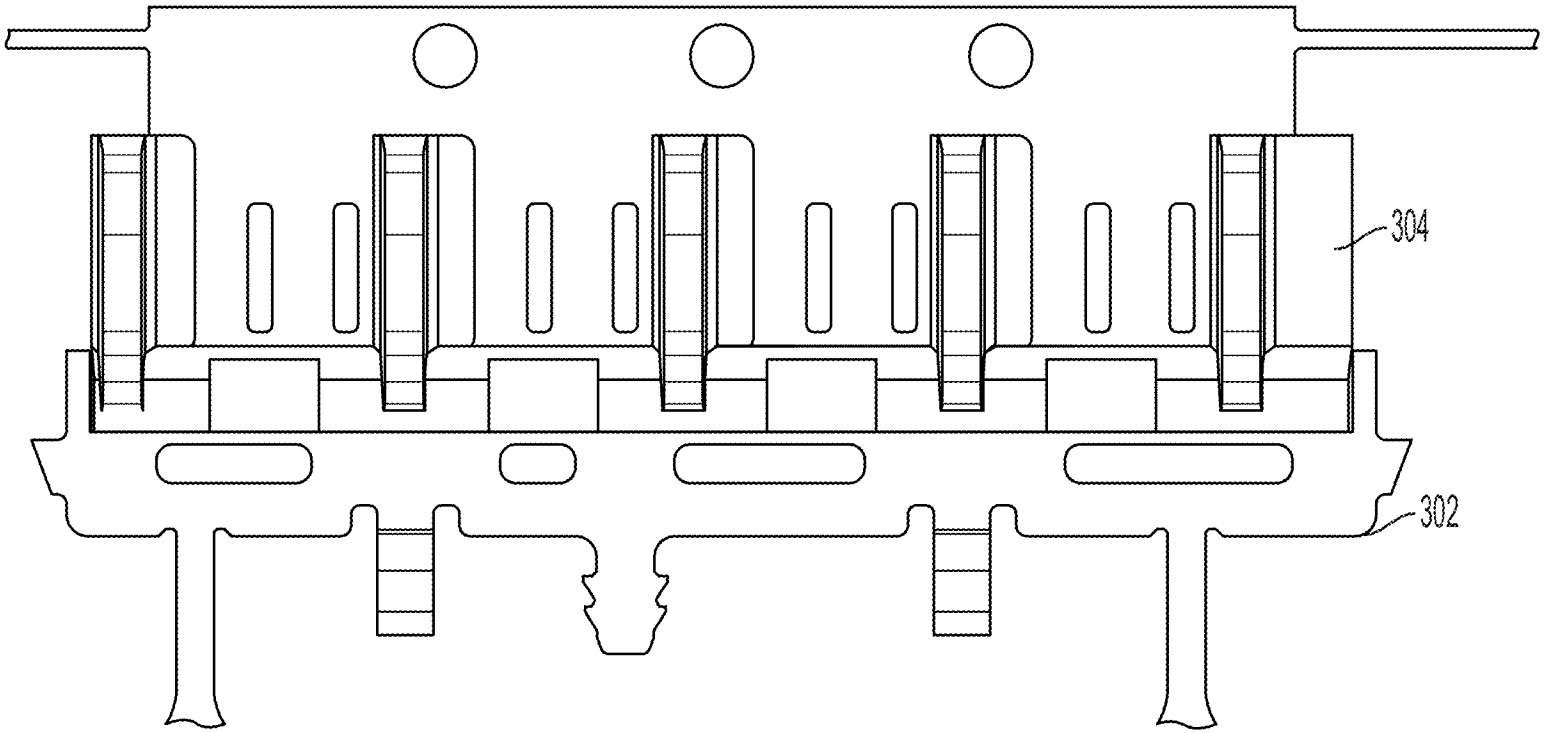
FIG. 3E shows the conductive material of FIG. 3D after being molded over with lossy material.

Lossy material 304 may be selectively molded over the conductive material. The lossy material 304 may form ribs 320, which may be configured to make contact with ground mating ends, which here extend from IMLA shields (e.g., ground mating ends 208). FIG. 3E shows conductive material 302, as in FIG. 3D, overmolded with lossy material 304.

Any suitable lossy material may be used for the lossy material 304 and other structures that are "lossy." Materials that conduct, but with some loss, or material which by another physical mechanism absorbs electromagnetic energy over the frequency range of interest are referred to herein generally as "lossy" materials. Electrically lossy materials can be formed from lossy dielectric and/or poorly conductive and/or lossy magnetic materials. Magnetically lossy material can be formed, for example, from materials traditionally regarded as ferromagnetic materials, such as those that have a magnetic loss tangent greater than approximately 0.05 in the frequency range of interest. The "magnetic loss tangent" is the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest. Electrically lossy material can be formed from material traditionally regarded as dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor such as copper over the frequency range of interest.

Electrically lossy materials typically have a bulk conductivity of about 1 Siemen/meter to about 10,000 Siemens/meter and preferably about 1 Siemen/meter to about 5,000 Siemens/meter. In some embodiments material with a bulk conductivity of between about 10 Siemens/meter and about 200 Siemens/meter may be used. As a specific example, material with a conductivity of about 50 Siemens/meter may be used. However, it should be appreciated that the conductivity of the material may be selected empirically or through electrical simulation using known simulation tools to determine a suitable conductivity that provides a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material has a surface resistivity between 10 Ω/square and 1000 Ω/square. As a specific example, the material may have a surface resistivity of between about 20 Ω/square and 80 Ω/square.

In some embodiments, electrically lossy material is formed by adding to a binder a filler that contains conductive particles. In such an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, alternative forms of binder materials may be used. Curable materials, such as epoxies, may serve as a binder. Alternatively, materials such as thermosetting resins or adhesives may be used.

Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Celanese Corporation which can be filled with carbon fibers or stainless steel filaments. A lossy material, such as lossy conductive carbon filled adhesive preform, such as those sold by Techfilm of Billerica, Mass., US may also be used. This preform can include an epoxy binder filled with carbon fibers and/or other carbon particles. The binder surrounds carbon particles, which act as a reinforcement for the preform. Such a preform may be inserted in a connector wafer to form all or part of the housing. In some embodiments, the preform may adhere through the adhesive in the preform, which may be cured in a heat treating process. In some embodiments, the adhesive may take the form of a separate conductive or non-conductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a lossy portion may be manufactured by stamping a preform or sheet of lossy material. For example, a lossy portion may be formed by stamping a preform as described above with an appropriate pattern of openings. However, other materials may be used instead of or in addition to such a preform. A sheet of ferromagnetic material, for example, may be used.

However, lossy portions also may be formed in other ways. In some embodiments, a lossy portion may be formed by interleaving layers of lossy and conductive material such as metal foil. These layers may be rigidly attached to one another, such as through the use of epoxy or other adhesive, or may be held together in any other suitable way. The layers may be of the desired shape before being secured to one another or may be stamped or otherwise shaped after they are held together. As a further alternative, lossy portions may be formed by plating plastic or other insulative material with a lossy coating, such as a diffuse metal coating.

The insulative material 306 may be molded in a second shot after the overmolding of the lossy material 304 such that some regions of the lossy material are covered by the insulative material and the insulative material 306 provides isolation at selected regions. Insulative material may be molded, for example, in regions adjacent mating ends of signal conductive elements adjacent each core member. Those regions of insulative material, for example, may include ribs 320 that separate mating ends of the signal conductive elements from adjacent signal mating ends and ground mating ends. The ribs 320, for example, may provide isolation between adjacent signal mating ends held in the spaces 322 between ribs 320. Other regions may separate the signal mating ends from the conductive material and/or lossy material.

The insulative material 306 may also include features that provide mechanical functions. For example, the insulative material 306 may include dovetails 312, which may be configured to be inserted into matching features, such as grooves 670 (FIG. 6) in the front housing 600 for alignment and retention.

The insulative material 306 may be a dielectric material such as plastic or nylon. Examples of suitable materials include, but are not limited to, liquid crystal polymer (LCP), polyphenyline sulfide (PPS), high temperature nylon or polyphenylenoxide (PPO) or polypropylene (PP). Other suitable materials may be employed, as aspects of the present disclosure are not limited in this regard.

Mating ends of two leadframe assemblies, such as leadframe assemblies 400 and 450, may be positioned on opposite sides (e.g., sides 318A and 318B) of core member 300. As shown in FIG. 2C, the leadframe assemblies may be formed in pairs, each of which includes a leadframe with mating ends aligning with a lower surface of a core member and a leadframe with mating ends that align with an upper surface of the core member. For example, the core member 300 may have a first leadframe assembly 472A on the side 318A and a second leadframe assembly 472B on the side 318B. In this example, there are eight rows of mating ends in the mating interface, corresponding to four pairs of leadframes: leadframes 472A and 472B, 474A and 474B, 476A and 476B, and 478A and 478B. In this example, the leadframes have a right angle bend and are nested, such that each successive leadframe is longer than the preceding one.

Each pair of leadframes includes an inner leadframe, 472A, 474A, 476A, or 478A, with mating ends with downward facing contact surfaces adjacent to a lower surface of the corresponding core member 300. Each pair of leadframes includes an outer leadframe, 472B, 474B, 476B, or 478B, with mating ends with upward facing contact surfaces adjacent to an upper surface of the corresponding core member 300. Similar construction techniques may otherwise be applied to manufacture the leadframes.

Figure 4B:
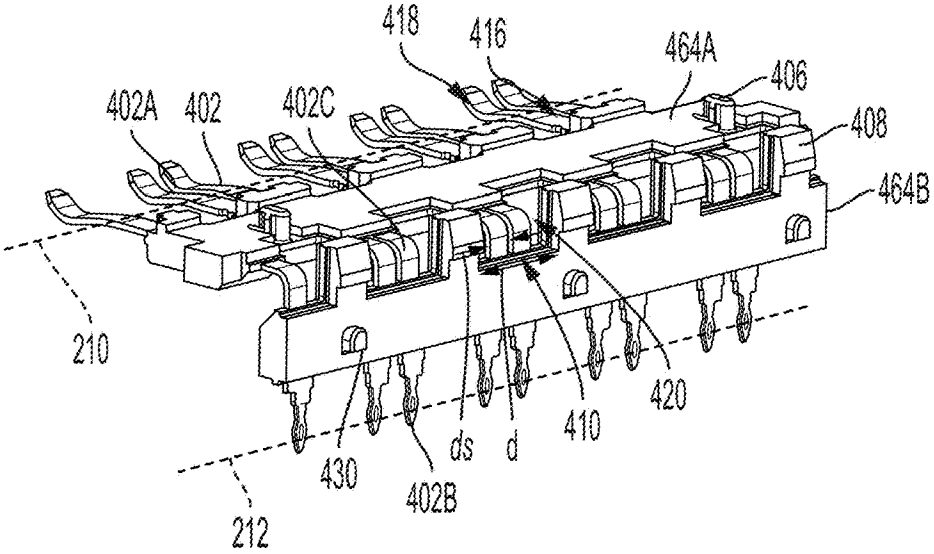
FIG. 4B is a perspective view of the leadframe assembly of FIG. 4A without a ground shield, according to some embodiments.
Figure 4A:
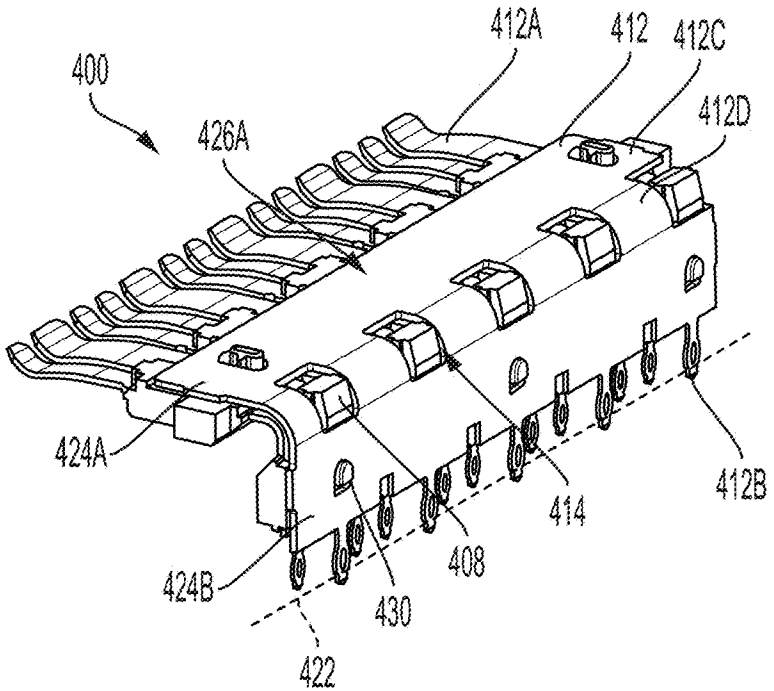
FIG. 4A is a perspective view of a leadframe assembly of the right angle orthogonal connector of FIG. 2A, according to some embodiments.
Figure 4C:
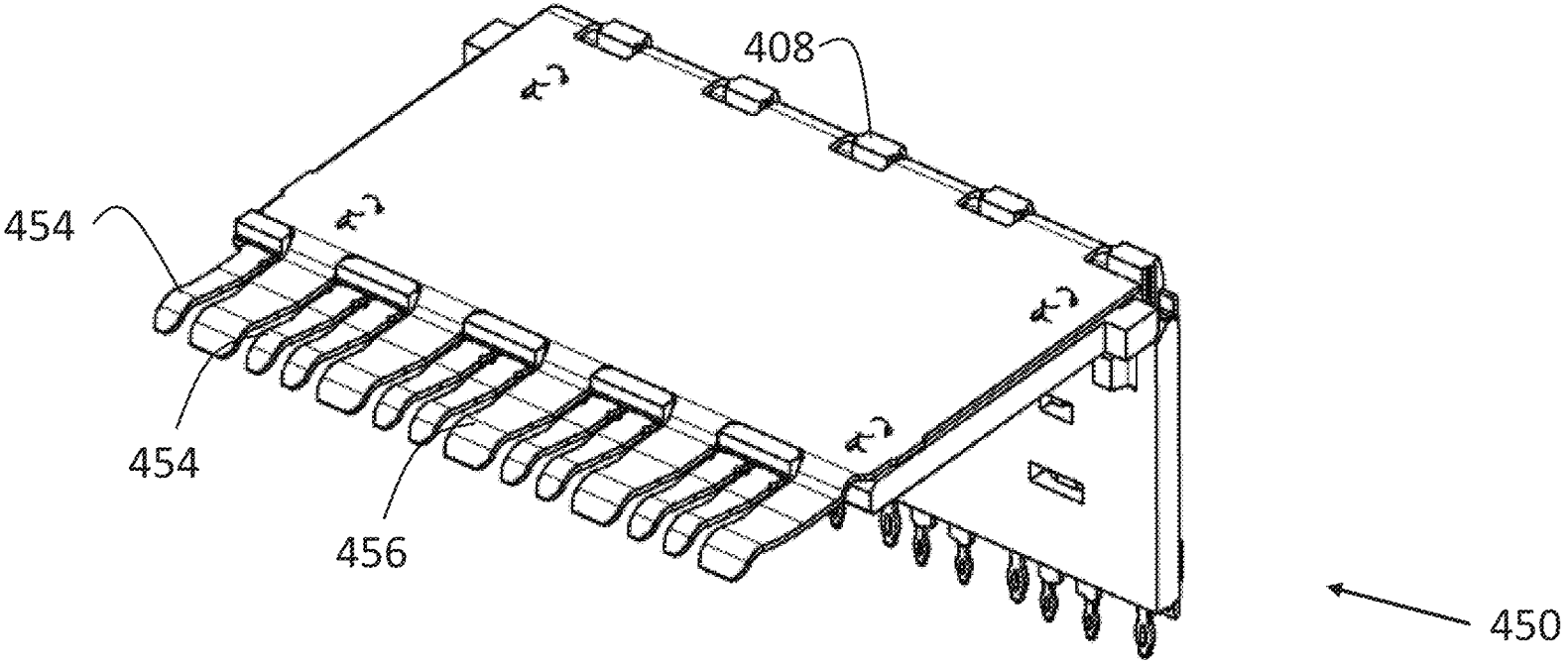
FIG. 4C is a perspective view of a leadframe assembly configured for attaching to an upper surface of a core member, according to some embodiments.

FIG. 4A depicts a perspective view of a representative leadframe assembly 400, according to some embodiments. FIG. 4B depicts a perspective view of the leadframe assembly 400 without a ground shield 412, according to some embodiments. FIG. 4C is a perspective view of a leadframe assembly 450, according to some embodiments. The leadframe assembly of FIG. 4A has downward facing contact surfaces. The leadframe assembly 450 of FIG. 4C has upward facing contact surfaces. Each of the leadframe assemblies 472A, 474A, 476A and 478A may be configured as in FIGS. 4A and 4B, with the same mating and mounting interface portions. The leadframe assemblies 472A, 474A, 476A and 478A may differ in the length of the horizontal and vertical segments of the intermediate portions, with each having successively longer horizontal and vertical portions such that the leadframe assemblies may nest as shown in FIG. 2C. Similarly, each of the leadframe assemblies 472B, 474B, 476B and 478B may be configured as in FIG. 4C, with the same mating and mounting interface portions. The leadframe assemblies 472B, 474B, 476B and 478B may differ in the length of the horizontal and vertical segments of the intermediate portions, with each having successively longer horizontal and vertical portions such that the leadframe assemblies may nest. To support nesting as shown in FIG. 2C, each of the upper leadframe assemblies 472B, 474B, 476B and 478B may have longer horizontal and vertical segments of its intermediate portion than the corresponding inner leadframe assembly 472A, 474A, 476A or 478A aligned with the same core member 300.

The leadframe assembly 400 may include conductive elements 402, a leadframe housing 464 holding the conductive elements 402, and a ground shield 412 separate from intermediate portions of the conductive elements 402 by the leadframe housing 464. The conductive elements 402 may be made of metal or any other material that is conductive and provides suitable mechanical properties for conductive elements in an electrical connector. Phosphor-bronze, beryllium copper and other copper alloys are non-limiting examples of materials that may be used. The conductive elements may be formed from such materials in any suitable way, including by stamping and/or forming.

The conductive elements 402 may be configured to transmit signals. Each conductive element 402 may include a mating end 402A, a mounting end 402B opposite the mating end, and an intermediate portion extending between the mating end 402A and the mounting end 402B. The mating ends 402A of the conductive elements 402 may be aligned in the row 210. The mounting ends 402B of the conductive elements 402 may be aligned in the row 212 that is parallel to the row 210. The rows containing the mating ends of all of the leadframe assemblies may be in a plane of a mating interface. Likewise, the rows containing the mounting ends of all of the leadframe assemblies may be in a plane of a mounting interface. The plane of the mating interface may be perpendicular to the plane of the mounting interface.

The intermediate portion of each conductive element 402 may include a transition portion 402C bent at substantially a right angle such that the mating end 402A and the mounting end 402B extend in directions substantially perpendicular to each other. Each conductive element 402 may have broadsides 416 and edges 418. The broadsides of the mating ends 402A and the broadsides of the mounting ends 402B may extend in planes substantially perpendicular to each other.

The conductive elements 402 may be held in a leadframe housing 464. In this example, the leadframe housing is overmolded on the intermediate portions so as to be secured to the intermediate portions.

Here, the leadframe housing has two portions, 464A and 464B. A first portion 464A holds the intermediate portions of signal conductors in a first, horizontal segment, aligned in the vertical direction with the mating ends of the conductive elements. A second portion 464B holds the intermediate portions in a second, vertical segment of the intermediate portions aligned in the horizontal direction with the mounting ends of the conductive elements. In some embodiments, the conductive elements of the leadframe assembly may be stamped from a sheet of metal, such that the conductive elements initial generally extend in a plane. Both portions of the housing may be molded over the intermediate portions while in this state. The intermediate portions subsequently may be bent to create the right angle configuration illustrated in FIGS. 4A and 4B.

Housing 464B may include openings 410 sized and positioned such that the transition portions 402C of conductive elements 402 are exposed. Transition portions 402C of one or more conductive elements 402 may be exposed by a single opening 410. The openings 410 may have a width d that is larger than the combination of the widths ds of transition portions exposed by individual openings 410, leaving gaps 420.

The leadframe ground shield 412 may be stamped from a sheet of metal and may have a right angle bend. The ground shield 412 may be attached to housing potions 464A and 464B. Ground shield 412, for example, may be aligned and attached to the leadframe housing 464B by features 406. Ground shield 412 may be attached to housing portion 464B by hubs 430 and members 408.

The ground shield 412 may include a body 412C, ground mating ends 412A extending from the body 412C, and ground mounting ends 412B also extending from the body 412C. The body 412C may include a transition portion 412D bent at a right angle, a first portion 424A extending from the transition portion 412D, and a second portion 424B also extending from the transition portion 412D. The first and second portions 424A and 424B of the body 412C may extend in planes substantially perpendicular to each other.

The ground mating ends 412A may extend from the first portion 424A of the body 412C. As shown, for example, in FIG. 4C, The ground mating ends 412A may jog away from the plane that the first portion 424A of the body 412C extends such that the ground mating ends 412A may be aligned with the mating ends 402A of the conductive elements 402 in the row 210, which may reduce cross talk between adjacent conductive elements 402. A ground mating end may separate each of the pairs of signal conductors within a row, for example.

The inventors have recognized and appreciated that in conventional connectors jog the ground mounting ends to be in-column with signal mounting ends. The jogging lengthens a ground return path between internal shields of the connector and ground structures in the PCB, hence increasing an inductance associated with the ground return path. The higher inductance in the ground return path can cause or exacerbate resonances on the ground structures.

The ground mounting ends 412B may extend from the second portion 424B of the body 412C, without jogging to be in-row with the mounting ends 402B of the conductive elements 402. The ground mounting ends 412B may be disposed in a row 422 that is parallel to and offset from the row 212 that the mounting ends 402B of the conductive elements 402 are aligned in. The inventors found that this configuration enhances signal integrity relative to a jogged configuration, which is believed to result from a reduction in the length of the ground return path between the ground shield 412 and the ground structures in the PCB.

The ground shield 412 may include openings 414, which may be sized and positioned such that the members 408 of the leadframe housing 464 may extend out of the openings 414. In the illustrated embodiment, members 408 are positioned between pairs of signal conductors in a row. As a result, the openings 414 in shield 412 are between pairs. Thus, while creating openings in a shield is generally undesirable, positioning members 408 in this way does not lead to a significant degradation in signal integrity as a result of openings 414.

Leadframe assembly 450 of FIG. 4C may be formed using similar techniques as described above for leadframe assembly 400, except that the contact surfaces 454 of the mating ends of the signal conductive elements and mating ends 456 of the leadframe shield face upwards.

One or more features may be used to interconnect the ground structures of the interconnection system. A contact portion 316 of a hook 310, which in turn is connected to the conductive material 302 that acts as shield within the core member, may make contact with a ground shield 412 of the first leadframe assembly 400, such as at the surface 426A of the ground shield 412.

Ground paths between the leadframes on the opposite sides of individual core members may be formed through the conductive material 302 and/or lossy material 304 of the core members 300. Lossy ribs 304, for example, may couple to the mating ends of the leadframe shields. Such a design enables the connector 200 to operate at high frequencies even with the openings 410 in the leadframe housings 464.

The inventors have recognized and appreciated that bent regions in a connector (e.g., the transition portions 402C of the conductive elements 402, the transition portion 412D of the ground shield 412) may be deformed by, for example, forces generated when the connector is pressed onto a board.

The inventors have recognized and appreciated connector structures that make the generated forces bypass the bent regions.

In some embodiments, features may be included in the leadframe housing to hold the spacing of the leadframe shield relative to the signal conductive elements, even in the face of pressure on the signal conductive elements and/or shields upon inserting their respective tails in holes in a printed circuit board. The leadframe housing 464B may include members 408. In the illustrated embodiment, members 408 have upper surfaces extending above an upper horizontal surface such that, when leadframe assembly 400 is inserted in a connector housing, the upper surface of member 408 may abut the connector housing such that a downward force on the connector housing may be translated into a downward force on member 408. As member 408 is coupled to the leadframe housing 464B, holding the conductive elements, that force is translated to the conductive elements.

Housing 464B may also include features that transfer a portion of the downward force on member 408 to the leadframe assembly shield. In this example, member 408 has a downward facing ledge, forming a shoulder 510 (FIG. 5B) that engages an upper surface of the leadframe assembly shield. Housing 464B also includes hubs 430 that pass through openings in the leadframe assembly shield. Hubs 430 also have downward facing ledges that similarly engage the leadframe assembly shield at an edge of the opening. Such a configuration transfers force during mounting the connector to a PCB to both the shield and the conductive elements, such that forces that might otherwise occur during mounting connector do not separate the conductive elements and the leadframe assembly shield.

Figure 5B:
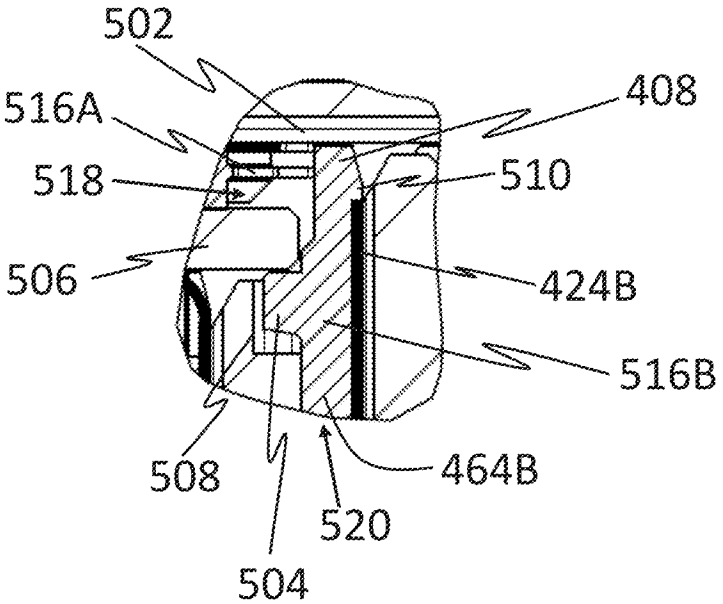
FIG. 5B is an enlarged view of a portion of the right angle orthogonal connector of FIG. 5A within the circle marked as "A" in FIG. 5A, according to some embodiments.
Figure 5A:
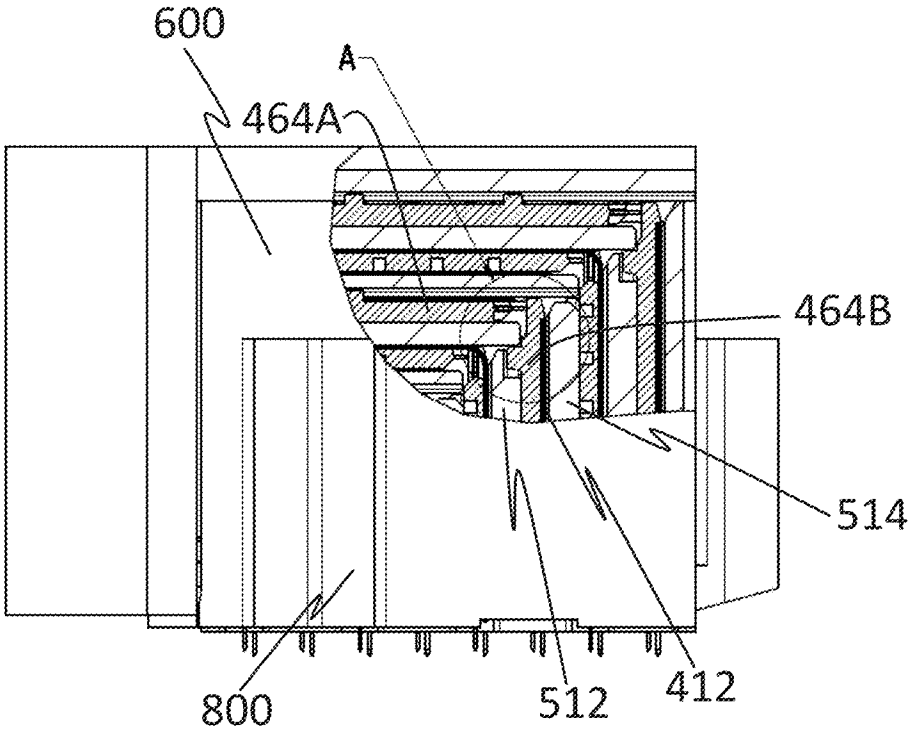
FIG. 5A is an elevation view of the right angle orthogonal connector of FIG. 2A, partially cut away, according to some embodiments.

The connector structures may include the members 408 of the leadframe housing 464 and additional features illustrated in FIG. 5A and FIG. 5B to reduce shifting of the signal and ground structures under forces that may occur during mounting of the connector. FIG. 5A is an elevation view of the right angle orthogonal connector 200, partially cut away, according to some embodiments. FIG. 5B is an enlarged view of a portion of the right angle orthogonal connector 200 within the circle marked as "A" in FIG. 5A, according to some embodiments.

A horizontal portion 516A of the leadframe assembly 400 may be held in a slot 518 between separators 502 and 506 of the front housing 600. A vertical portion 516B of the leadframe assembly 400 may be held in a slot 520 between separators 512 and 514 of the rear housing 800. The spacing between the portions of the leadframe assemblies in slots 518 and 520 may be controlled by the spacing of these slots. Within these regions, the spacing between signal conductive elements and their respective leadframe shields may be controlled by the thickness of the leadframe housing. Other features may be included to control the spacing between signal conductive elements and their respective leadframe shields at the transition between these two segments of the leadframe assemblies.

The member 408 of the leadframe housing 464B may extend out of the opening 414 of the ground shield 412, and make contact with the separator 502 of the front housing 600. The member 408 may include a shoulder 510 extending beyond the second portion 424B of the ground shield 412. Portions of the second portion 424B of the ground shield 412 may be blocked by the shoulder 510 of the member 408 from moving relative to the signal conductive elements that are also held in position by the leadframe housing portion 464B. As a result, impedance of the signal conductive elements is maintained with high uniformity throughout the intermediate portions of the signal conductors, even in the transition regions between vertical and horizontal portions. The impedance may vary, for example, by less than 1% or less than 0.5%, in some embodiments. The impedance variation for a differential pair of signal conductors, for example, may be less than 1 Ohm or less than 0.5 Ohm, for example.

Other features may alternatively or additionally be included to transfer a downward force on the connector housing to portions of the leadframe housing that fix the position of signal conductive elements and leadframe shields. The leadframe housing 464B, for example, may include a projection 504 extending perpendicular to the member 408. The projection 504 may press against a lower surface of separator 506 of the front housing 600. The separator 512 of the rear housing 800 may include a recess 508 sized and positioned to accommodate the projections 504. In this way, the leadframe housing of one leadframe assembly may make contact with the front housing 600 of the connector at multiple locations. Here, contact is made with separators in the front housing positioning two adjacent leadframe assemblies. As a result, relative positioning of the components of the leadframe assemblies may be reliably maintained, despite forces applied to the connector in use.

FIG. 5A illustrates connector structures that make the generated forces bypass the bent regions in every other leadframe assembly 400. Some or all of the leadframe assemblies 400 in a connector may have such structures. FIG. 5A, for example, illustrates a cross section through a portion of a row aligned with the member 408 of every other leadframe assembly. That portion may correspond, for example, to a member 408 of a leadframe assembly 450 (FIG. 4C). As can be seen from a comparison of FIGS. 4A and 4C, the locations, within a row, of the members 408 may be offset, reflecting the offset in locations of signal conductors between the leadframe assemblies with upwardly facing contact surfaces and those with downwardly facing contact surfaces. In such an embodiment, other cross sections parallel to the cross section illustrated in FIGS. 5A and 5B may reveal structures that make the generated forces bypass the bent regions of conductors in leadframe assemblies with downwardly facing contact surfaces.

In some embodiments, the leadframe assemblies in a connector may have Type-A and Type-B configurations corresponding, for example the leadframe assemblies 472A, 474A, 476A or 478A and leadframe assemblies 472B, 474B, 476B or 478B. The ground mating ends of a Type-A leadframe assembly may be configured to face the signal mating ends of a Type-B leadframe assembly so as to reduce row-to-row cross talk, and decrease the rate of assembly mistakes. The members 408 may be aligned with the ground mating ends in a direction perpendicular to the row 210. The members 408 and structures corresponding to the members 408 (e.g., the projections 504, and the recesses 508) of a Type-A leadframe may be offset, in the row direction, from a Type-B leadframe assembly. Such configuration makes the applied forces bypass the bent regions at offset locations and enhances the structural stability of the connector.

Figure 6:
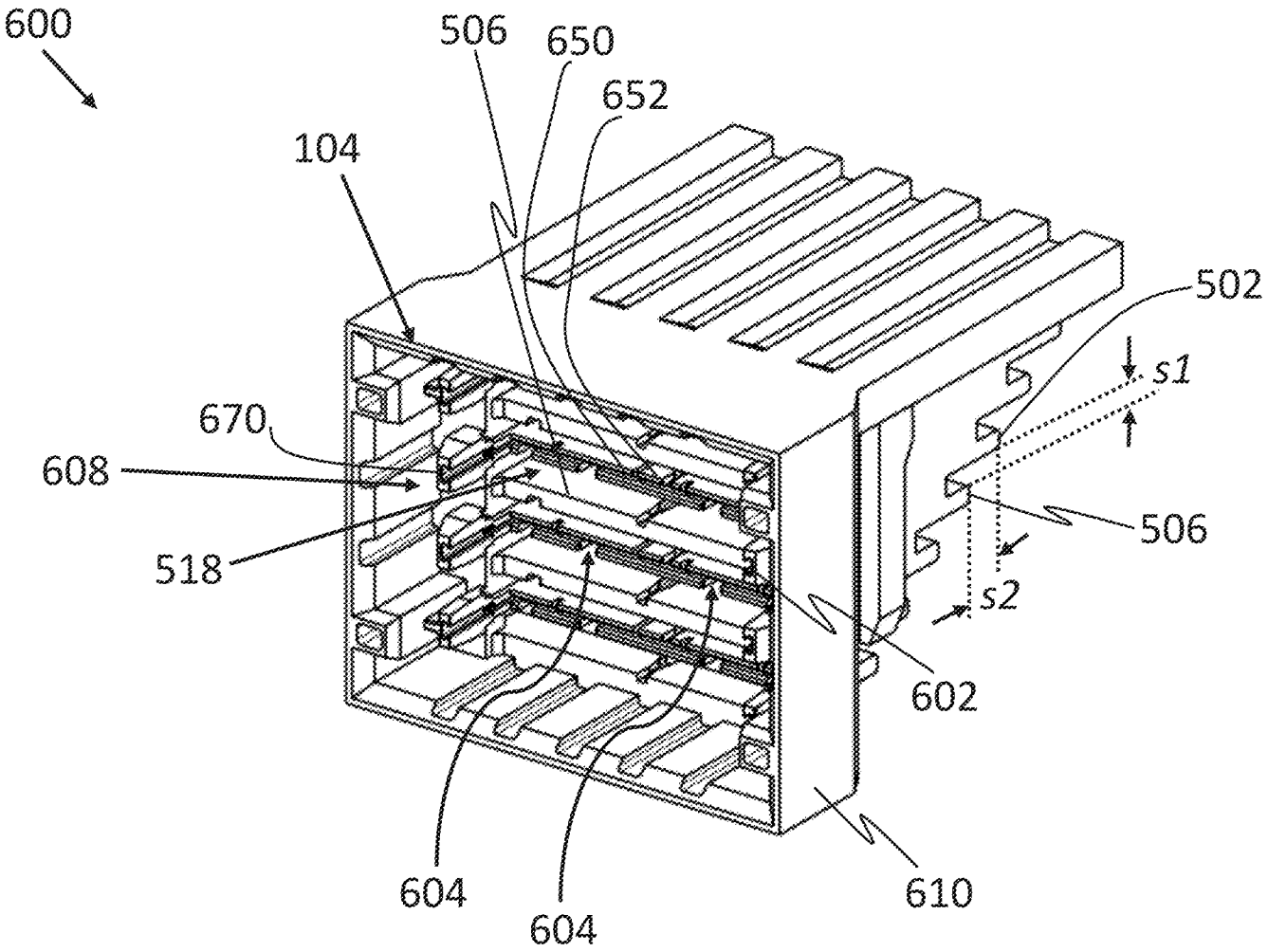
FIG. 6 is a perspective view of a front housing of the right angle orthogonal connector of FIG. 2A, according to some embodiments.

FIG. 6 depicts a perspective view of the front housing 600 of the right angle orthogonal connector 200, according to some embodiments. The front housing 600 may include a cavity 608 enclosed by a frame 610. Frame 610 may bound the mating region of the connector 200 and may receive a mating region of a second connector, such as connector 102 (FIG. 1).

A rear of front housing 600 may be divided into slots (e.g., slot 518) by separators (e.g., separators 502 and 506). The separators may extend reward from the frame 610. The slots may align the horizontal portions of the leadframe assemblies 400 as the assemblies are inserted from the back of the front housing 600, opposite the mating interface 104. Forward ends of the separators 502 and 506 may be exposed in cavity 608 and may be shaped to engage with the core members 300.

In the illustrated embodiment, pairs of leadframe assemblies, such as 472A and 472B, or 474A and 474B, or 476A and 476B, or 478A and 478B have mating portions aligned with the same core member 300. Accordingly, every other separator, corresponds to one core member. A forward edge of every other separator, such as separator 502, for example, may be shaped with the features of cross pieces 650 so as to engage with a core member.

The front housing 600 may include members 602 configured with grooves 670 to receive the dovetails 312 of the core members 300. Barbs 314 may engage the front housing within grooves 670, restraining the core member from being separated from front housing 600 after insertion. The members 602 may align the core members with respective separators (e.g., separator 502) as the core members are inserted from the front of the front housing 600. Separators 502 that align with respective core members 300 may include structures to receive retention features 308 of the core members 300. Further, openings 604 may be configured to receive hooks 310 so as to enable the contact portion 316 of the hooks 310 to contact a surface of a leadframe shield adjacent opening 604.

The adjacent separators may be spaced from each other in a direction perpendicular to the mating direction by a distance s1. The distance s1 may be configured to correspond to the row-to-row pitch p1 (FIG. 2A). The adjacent separators may be offset from each other in the mating direction by a distance s2. The distance s2 may be configured to correspond to the row-to-row pitch p2 (FIG. 2B).

Figure 7B:
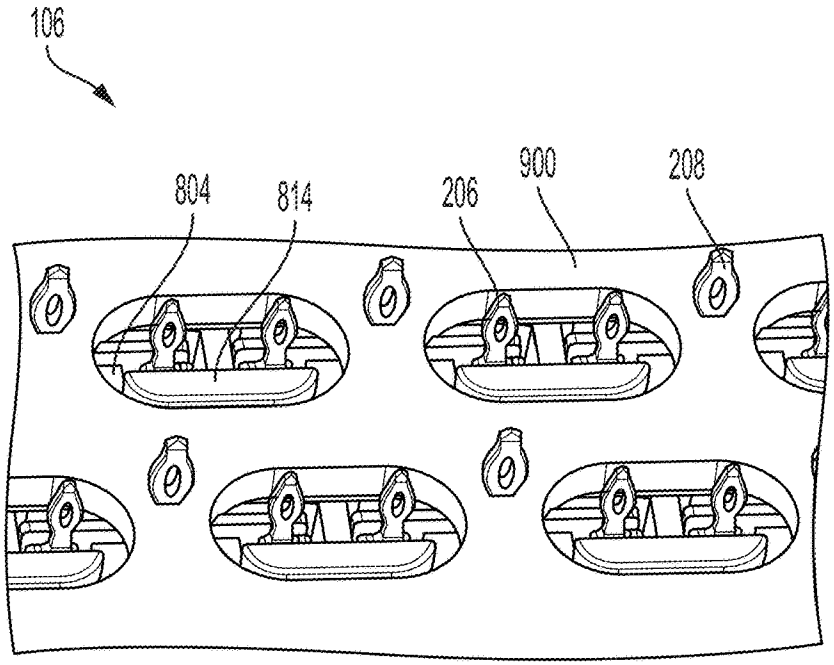
FIG. 7B is an enlarged view of a portion of the mounting interface of the right angle orthogonal connector within the circle marked as "7B" in FIG. 2B, according to some embodiments.
Figure 7A:
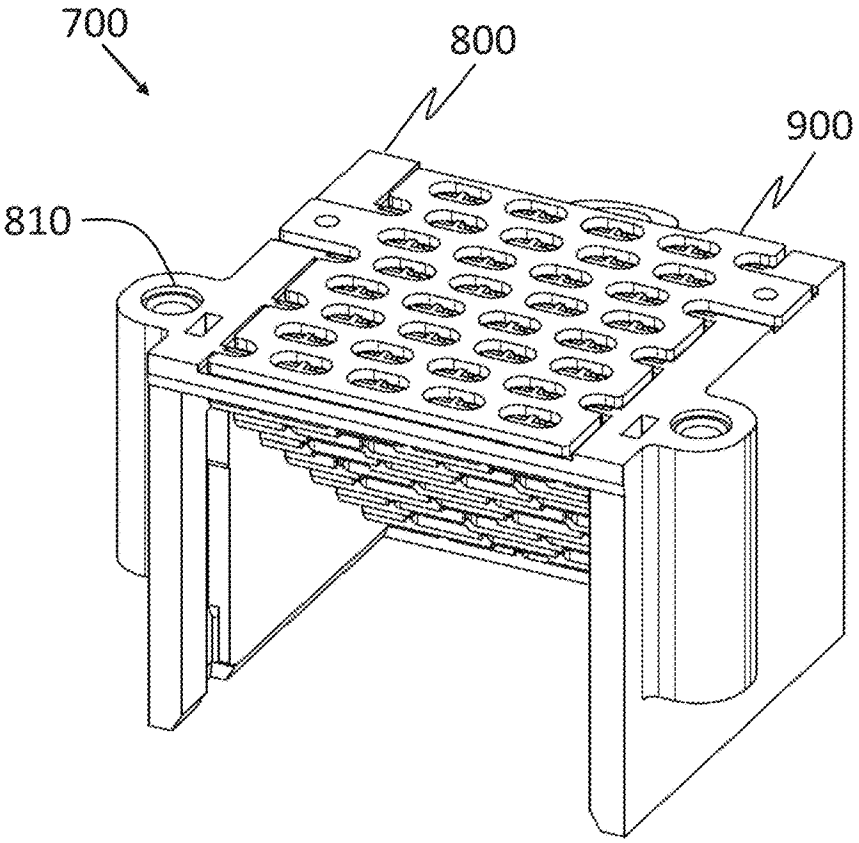
FIG. 7A is a perspective view of a portion of the right angle orthogonal connector of FIG. 2A, illustrating a rear housing and a mounting interface shield, according to some embodiments.

FIG. 7A depicts a perspective view of a portion of the right angle orthogonal connector 200, illustrating the rear housing 800 and the compressible shield 900, according to some embodiments. In the illustrated embodiment, rear housing 800 includes separators, as with front housing 600. The separators of the rear housing, however, are perpendicular to the separators of the front housing when the first and rear housings are engaged. Slots between the separators of the rear housing similarly position portions of the leadframe assemblies. In this example, the separators of the rear housing aid in positioning the vertical portions of the leadframe assemblies.

Figure 8B:
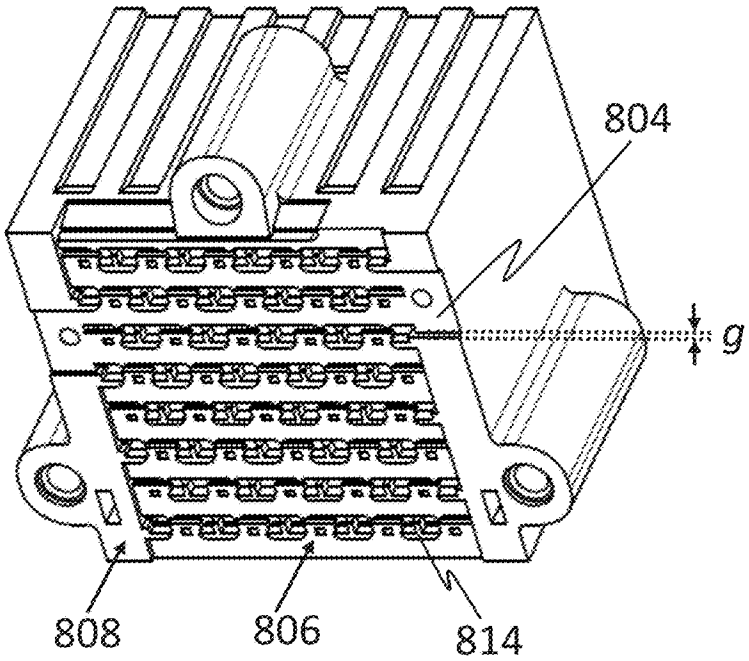
FIG. 8B is a perspective view of the rear housing of FIG. 8A, illustrating a mounting end, according to some embodiments.
Figure 8A:
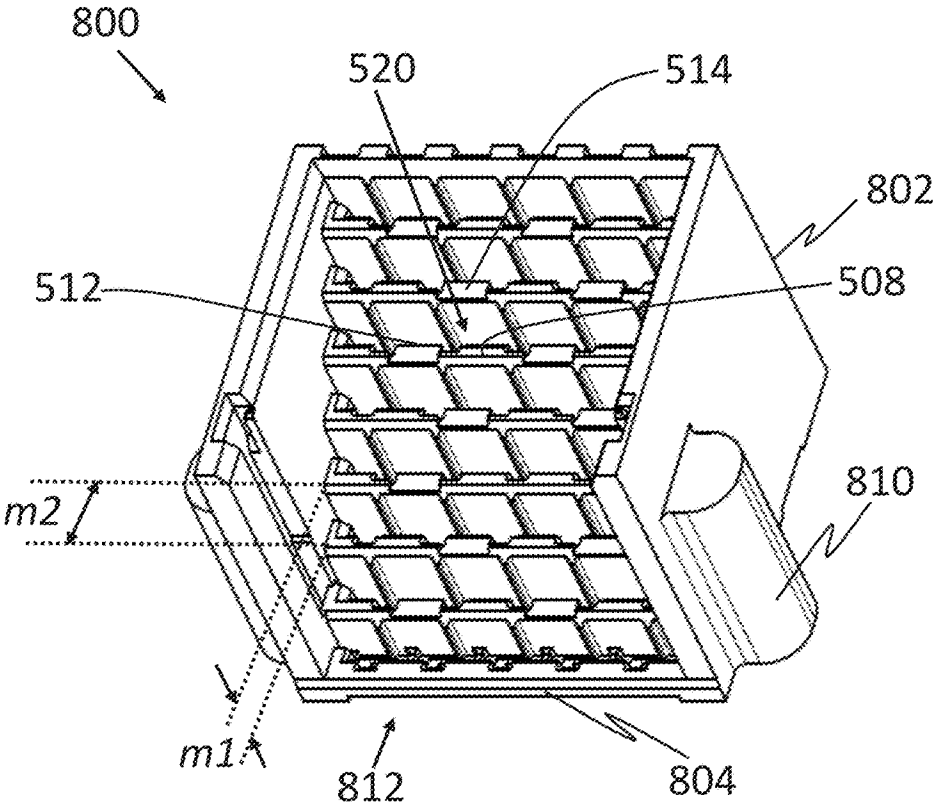
FIG. 8A is a perspective view of the rear housing of FIG. 7A, illustrating a receiving end for leadframe assemblies, according to some embodiments.

FIG. 7B is an enlarged view of a portion of the mounting interface 106 of the right angle orthogonal connector 200 within the circle marked as "7B" in FIG. 2B, according to some embodiments. FIG. 8A is a perspective view of the rear housing 800, illustrating a receiving end for leadframe assemblies, according to some embodiments. FIG. 8B is a perspective view of the rear housing 800, illustrating a mounting end, according to some embodiments.

The rear housing 800 may include a body portion 802 and an organizer 804 at the mounting face of the rear housing. The body and organizer may be integrally formed, such as may result from forming the entire rear housing in a molding operation. The body portion 802 of the rear housing 800 may include an opening end 812 configured to be closed by the front housing 600 when the front housing and rear housing are engaged. The body portion 802 of the rear housing 800 may include slots (e.g., slot 520) divided by separators (e.g., separators 512 and 514). The separators may include recesses 508 sized and positioned to form spaces with respective separators of the front housing 600.

The adjacent separators may be offset from each other in a direction perpendicular to the mating direction by a distance m1. The distance m1 may be configured to correspond to the row-to-row pitch p1 (FIG. 2A). The adjacent separators may be spaced from each other in the mating direction by a distance m2. The distance m2 may be configured to correspond to the row-to-row pitch p2 (FIG. 2B).

The organizer 804 may be configured to receive mounting ends of the leadframe assemblies. The organizer 804 may include standoffs 814 configured to separate adjacent signal mounting ends and prevent the adjacent signal mounting ends from accidentally making contact.

In some embodiments, the body portion 802 and the organizer 804 are molded separately and assembled together. In some embodiments, the body portion 802 and the organizer 804 are molded as a single component.

In some embodiments, a lower face of organizer 804 may have a recess 806, which may be recessed, by a distance g, from a plane defined by the lower-most surface 808 of the body portion 802 of the rear housing 800. In some embodiments, the compressible shield 900 may be shaped to partially fit with the recessed surface 806. Between 50-75% of the compressible shield 900 may fit within the recess 806, for example. Between 20-50% or 30-40% in some embodiments, of the compressible shield 900 may extend beyond the lower-most surface 808 when the connector 200 is not attached to a board. When connector 200 is mounted on a printed circuit board, the extending portions of compressible shield 900 may be compressed, ensuring that electrical connection is made to conductive surfaces on the printed circuit board.

Connector 200 may include or be used with features that hold the connector 200 against a surface of a board with compressible shield 900 compressed. Pressfits of the signal conductive elements and leadframe shields may provide some retention force. In other embodiments, retention force may be provided by or augmented by fasteners. In some embodiments, the body portion 802 of the rear housing 800 may include screw receivers 810, which may be configured to be attached to a board by screws (e.g., thread forming screws).

Figure 9B:
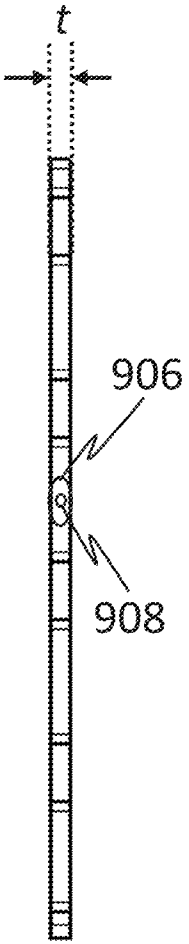
FIG. 9B is a side view of the mounting interface shield of FIG. 9A, according to some embodiments.
Figure 9A:
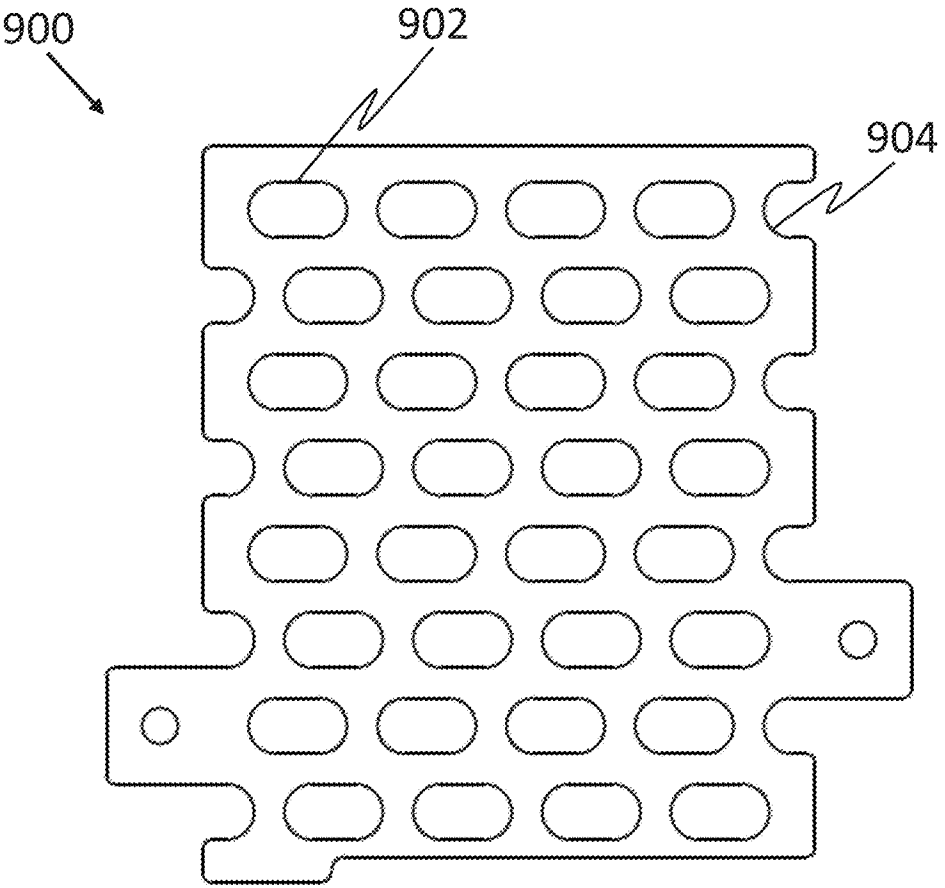
FIG. 9A is a top, plan view of the mounting interface shield of FIG. 7A, according to some embodiments.

FIG. 9A depicts a top, plan view of the compressible shield 900, according to some embodiments. FIG. 9B depicts a side view of the compressible shield 900, according to some embodiments. The compressible shield 900 may include openings 902 configured for signal mounting ends to pass therethrough. The compressible shield 900 may include notches 904 configured for signal mounting ends at the ends of columns to pass therethrough.

In some embodiments, the compliant shield 900 may be made from a sheet of a foam material by selectively cutting the sheet or otherwise removing material from the sheet to form openings 902 and recesses 904. Alternatively or additionally, the foam may be molded in a desired shape. In some embodiments, the compliant shield 900 may include only openings 902 and recesses 904 configured for signal mating ends to pass therethrough. Ground mating ends may pierce through the compliant shield 900 when the compliant shield 900 is assembled to the connector 900, which simplifies the manufacturing process of the compliant shield. Alternatively or additionally, slits may be cut in compliant shield 900 to facilitate ground mating ends passing through the compliant shield. Ground mating ends passing through the compliant shield 900 may be electrically connected to it, whereas mounting ends of signal conductive elements may be electrically insulated from it.

In an uncompressed state, the compliant shield may have a first thickness t. In some embodiments, the first thickness t may be larger than the recess distance g. In some embodiments, the first thickness may be about 20 mil, or in other embodiments between 10 and 30 mils. In some embodiments, the first thickness t may be greater than the gap between the mounting end of the internal shields of the connector and the mounting surface of the PCB. Because the first thickness of the compliant shield is greater than the gap, when the connector is pressed onto a PCB engaging the contact tails, the compliant conductive member is compressed by a normal force (a force normal to the plane of the PCB). As used herein, "compression" means that the material is reduced in size in one or more directions in response to application of a force. In some embodiments, the compression may be in the range of 3% to 40%, or any value or subrange within the range, including for example, between 5% and 30% or between 5% and 20% or between 10% and 30%, for example. Compression may result in a change in height of the compliant shield in a direction normal to the surface of a printed circuit board (e.g., the first thickness).

The compression of the compliant shield can accommodate a non-flat reference pad on the PCB surface. In some embodiments, the compression of the compliant shield may cause lateral forces within the compliant shield that laterally expand the compliant shield to press against the surfaces of the internal shields and/or the ground contact tails. In this manner, the gap between the mounting end of the internal shields of the connector and the mounting surface of the PCB can be avoided.

In some embodiments, a reduction in size of a compliant shield may result from displacement of the material. In some embodiments, the change in height in one dimension may result from a decrease in volume of the compliant shield, such as when the compliant shield is made from an open-cell foam material from which air is expelled from the cells when a force is applied to the material. The cells 906 of the foam may be open sideways (e.g., openings 908) such that the thickness of the foam may be adjusted with respect to the gap between the mounting ends of the ground shields and the mounting surface of the PCB when the connector is pressed onto the PCB. In some embodiments, foam material may be formed of cells 906. It should be appreciated that although a single cell is shown for illustration purpose, the present application is not limited in this regard.

In some embodiments, a compliant shield may be configured to fill the gap with a force between 0.5 gf/mm$^2$ and 15 gf/mm$^2$, such as 10 gf/mm$^2$, 5 gf/mm$^2$, or 1.4 gf/mm$^2$. A compliant shield made of an open-cell foam may require a lower application force to fill the gap than that a compliant shield made of rubber may require, for example, two to four times lower application force. In some embodiments, an open-cell foam, compliant shield may require 2 pound-force per square inch (psi) to exhibit a reduction in size substantially similar to that a rubber, compliant shield may require 4 psi to exhibit. Further, different from a rubber, compliant shield, which may reduce in one dimension (e.g., a dimension normal to the plane of the PCB) but correspondingly expand in other dimensions (e.g., a dimension parallel to the plane of the PCB), an open-cell foam, compliant shield may change in one dimension (e.g., a dimension normal to the plane of the PCB) while substantially maintain its dimensions in other dimensions (e.g., a dimension parallel to the plane of the PCB). As a result, the open-cell foam, compliant shield may avoid the risk to inadvertently short to adjacent signal tails.

A suitable compliant shield may have a volume resistivity between 0.001 and 0.020 Ohm-cm. Such a material may have a hardness on the Shore A scale in the range of 35 to 90. Such a material may be a conductive elastomer, such as a silicone elastomer filled with conductive particles such as particles of silver, gold, copper, nickel, aluminum, nickel coated graphite, or combinations or alloys thereof. Alternatively or additionally, such a material may be a conductive open-cell foam, such as a Polyethylene foam or a Polyurethane foam, plated with conductive material (e.g., silver, gold, copper or nickel) within the cells and/or on the outside of the cells. Non-conductive fillers, such as glass fibers, may also be present.

Alternatively or additionally, the complaint shield may be partially conductive or exhibit resistive loss such that it would be considered a lossy material as described herein. Such a result may be achieved by filling all or portions of an elastomer, an open-cell foam, or other binder with different types or different amounts of conductive particles so as to provide a volume resistivity associated with the materials described herein as "lossy." In some embodiments a compliant shield may be die cut from a sheet of conductive complaint material having a suitable thickness, electrical, and other mechanical properties. In some embodiments, the compliant shield may have an adhesive backing such that it may stick to the plastic organizer. In some implementations, a compliant shield may be cast in a mold.

Figure 10:
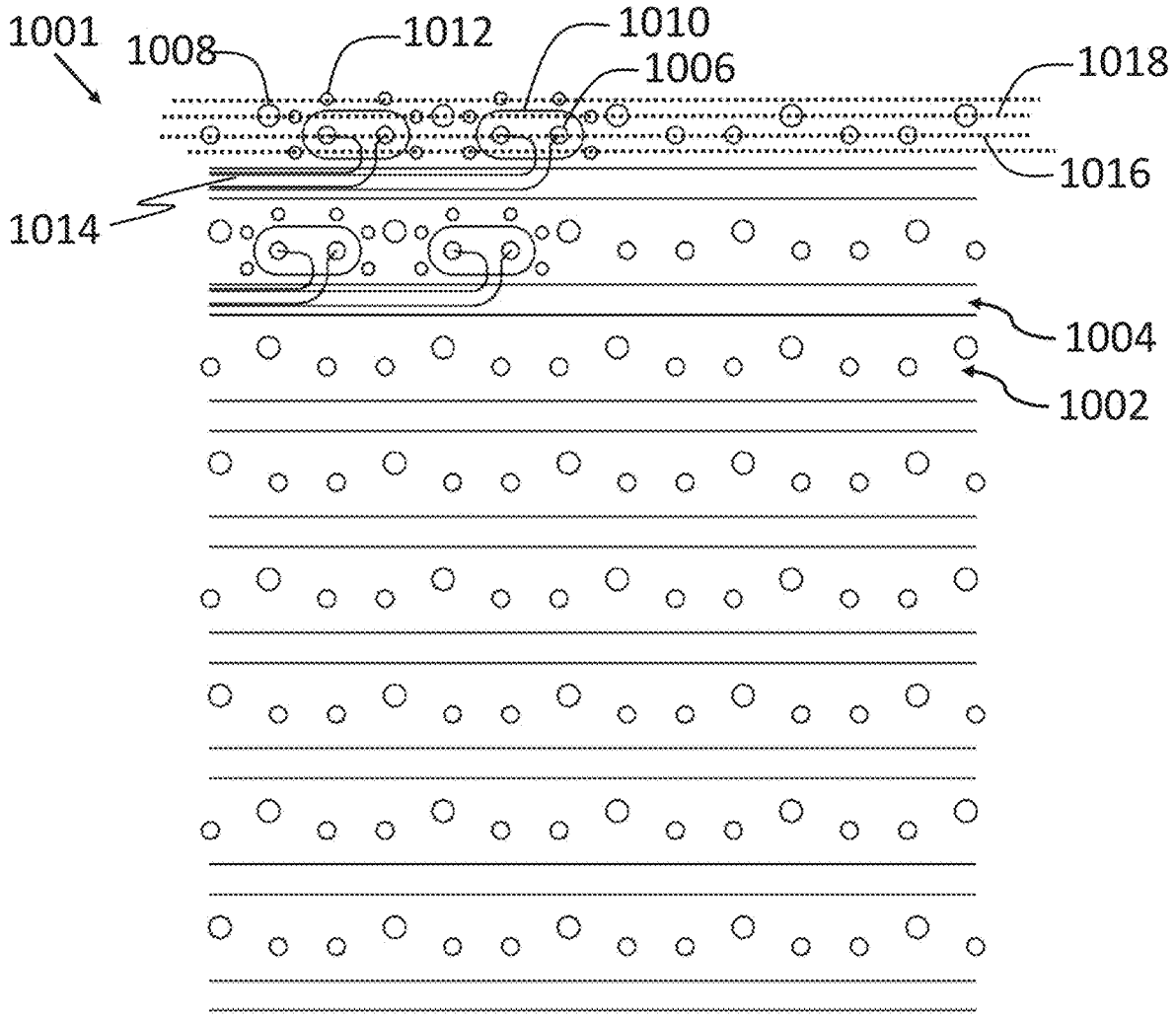
FIG. 10 is a top, plan view of a footprint for the right angle orthogonal connector of FIG. 2B, according to some embodiments.

FIG. 10 depicts a top, plan view of a footprint 1001 on a surface of the printed circuit board 1000 for the right angle orthogonal connector 200, according to some embodiments. The footprint 1001 may include columns of footprint patterns 1002 separated by routing channels 1004. A footprint pattern 1002 may be configured to receive mounting structures of a leadframe assembly 400, including vias to receive mounting ends of signal conductive elements of the leadframe assembly and mounting ends of a leadframe shield.

The footprint pattern 1002 may include signal vias 1006 aligned in a column 1016 and ground vias 1008 aligned to a column 1018. The ground vias 1008 may be connected to a ground plane at an inner layer of the printed circuit board 1000. The column 1018 may be offset from the column 1016 because the ground vias 1008 may be configured to receive ground mating ends 412B that extends from a ground shield 412 without jogging (FIG. 4A).

The signal vias 1006 may be configured to receive signal mating ends (e.g., mating ends 402B). The signal vias 1006 may be surrounded by respective anti-pads 1010 formed in the ground planes of the PCB. Each anti-pad 1010 may surround a respective signal via such that it can prevent the electrically conductive material of a ground layer of the PCB from being placed in electrical communication with the electrically conductive surface of the respective ones of the signal vias. In some embodiments, a differential pair of signal conductive elements may share one anti-pad.

The via pattern 1002 may include shadow vias 1012 configured to enhance electrical connection between internal shields of the connector to the ground structure of the PCB, without receiving ground contact tails. In some embodiments, the shadow vias may be compressed against by the compliant shield 900 and/or may connect to a surface ground plane of the PCB.

In the illustrated example, a first portion of the shadow vias 2010 are aligned in a row 1016. Each row 1016 of signal vias 1006 has two rows 1016 of shadow vias 1016 on opposite sides. A second portion of the shadow vias 2020 are aligned in a row 1012. The shadow vias in the second portion are aligned with respective signal vias in a direction perpendicular to the row 1016.

It should be appreciated that although some structures such as the antipads 1010, interconnections 1014, and shadow vias 1012 are illustrated for some of the signal vias 1006, the present application is not limited in this regard. For example, each signal via may have corresponding breakouts such as interconnections 1014.

Although details of specific configurations of conductive elements, housings, and shield members are described above, it should be appreciated that such details are provided solely for purposes of illustration, as the concepts disclosed herein are capable of other manners of implementation. In that respect, various connector designs described herein may be used in any suitable combination, as aspects of the present disclosure are not limited to the particular combinations shown in the drawings.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. As a specific example of a possible variation, lossy material is described only in a daughter card connector. Lossy material may alternatively or additionally be incorporated into either connector of a mating pair of connectors. That lossy material may be attached to ground conductors or shields, such as the shields in backplane connector 104.

As an example of another variation, the connector may be configured for a frequency range of interest, which may depend on the operating parameters of the system in which such a connector is used, but may generally have an upper limit between about 15 GHz and 224 GHz, such as 25 GHz, 30 GHz, 40 GHz, 56 GHz, 112 GHz, or 224 GHz, although higher frequencies or lower frequencies may be of interest in some applications. Some connector designs may have frequency ranges of interest that span only a portion of this range, such as 1 to 10 GHz or 5 to 35 GHz or 56 to 112 GHz.

The operating frequency range for an interconnection system may be determined based on the range of frequencies that can pass through the interconnection with acceptable signal integrity. Signal integrity may be measured in terms of a number of criteria that depend on the application for which an interconnection system is designed. Some of these criteria may relate to the propagation of the signal along a single-ended signal path, a differential signal path, a hollow waveguide, or any other type of signal path. Two examples of such criteria are the attenuation of a signal along a signal path or the reflection of a signal from a signal path.

Other criteria may relate to interaction of multiple distinct signal paths. Such criteria may include, for example, near end cross talk, defined as the portion of a signal injected on one signal path at one end of the interconnection system that is measurable at any other signal path on the same end of the interconnection system. Another such criterion may be far end cross talk, defined as the portion of a signal injected on one signal path at one end of the interconnection system that is measurable at any other signal path on the other end of the interconnection system.

As specific examples, it could be required that signal path attenuation be no more than 3 dB power loss, reflected power ratio be no greater than −20 dB, and individual signal path to signal path crosstalk contributions be no greater than −50 dB. Because these characteristics are frequency dependent, the operating range of an interconnection system is defined as the range of frequencies over which the specified criteria are met.

Designs of an electrical connector are described herein that improve signal integrity for high frequency signals, such as at frequencies in the GHz range, including up to about 25 GHz or up to about 40 GHz, up to about 56 GHz or up to about 60 GHz or up to about 75 GHz or up to about 112 GHz or higher, while maintaining high density, such as with a spacing between adjacent mating contacts on the order of 3 mm or less, including center-to-center spacing between adjacent contacts in a column of between 1 mm and 2.5 mm or between 2 mm and 2.5 mm, for example. Spacing between columns of mating contact portions may be similar, although there is no requirement that the spacing between all mating contacts in a connector be the same.

Manufacturing techniques may also be varied. For example, embodiments are described in which the rear housing of connector 200 includes an integrally formed surface at the mounting face of the connector that may serve as an organizer for the mounting ends of a plurality of wafers inserted into the housing. In some embodiments, the mounting face of the connector may be fully or partially open. In those embodiments, a separate organizer may be used.

As another example, an embodiment was illustrated in which a connection was formed between a conductive material of a core member and one leadframe shield. In other embodiments, a core shield may connect to a shield of each leadframe assembly aligned with that core member.

Connector manufacturing techniques were described using specific connector configurations as examples. A right angle connector, suitable for mounting on printed circuit board in an orthogonal system configuration, were illustrated for example. The techniques described herein for forming mating and mounting interfaces of connectors are applicable to connectors in other configurations, such as backplane connectors, cable connectors, stacking connectors, mezzanine connectors, I/O connectors, chip sockets, etc.

In some embodiments, contact tails were illustrated as press fit "eye of the needle" compliant sections that are designed to fit within vias of printed circuit boards. However, other configurations may also be used, such as surface mount elements, solderable pins, etc., as aspects of the present disclosure are not limited to the use of any particular mechanism for attaching connectors to printed circuit boards.

Further, connector features were described, for simplicity of explanation, as upward or downward. Such orientations need not be referenced to gravity or other fixed coordinate system and may indicate relative position or orientation. In some scenarios, upward or downward may be relative to a mounting face of the connector, configured for mounting against a printed circuit board. Similarly, terms such as horizontal or vertical may define relative orientation and, in some scenarios, may indicate orientation relative to a face of the connector configure for mounting against a printed circuit board. Likewise, some connector features were described as forward, or front, or the like. Other connector features were described as rearward, or back, or the like. These terms too, are relative terms, not fixed to any orientation in a fixed coordinate system. In some scenarios, these terms may be relative to a mating face of the connector, with the mating face being at the front of the connector.

Further, a linear array of conductive elements extending parallel to a face of the connector configured for mounting against a printed circuit board were referred to as rows of the connector. Columns were defined to be orthogonal to the row direction. In a mounting interface, a linear array of vias extending perpendicular to an edge of a printed circuit board to which a connector is intended to be mounted are referred to as columns, whereas a linear array parallel to the edge was referred to as a row. It should be appreciated, however, that these terms signify relative orientation and may refer to linear arrays extending in other directions.

The present disclosure is not limited to the details of construction or the arrangements of components set forth in the foregoing description and/or the drawings. Various embodiments are provided solely for purposes of illustration, and the concepts described herein are capable of being practiced or carried out in other ways. Also, the phraseology and terminology used herein are for the purpose of description and should not be regarded as limiting. The use of "including," "comprising," "having," "containing," or "involving," and variations thereof herein, is meant to encompass the items listed thereafter (or equivalents thereof) and/or as additional items.

The invention claimed is:

1. An electrical connector comprising:

a housing comprising a plurality of grooves and a plurality of separators;

a plurality of leadframe assemblies disposed on opposite sides of the plurality of separators of the housing, the plurality of leadframe assemblies each comprising a shield; and a plurality of core members each comprising a feature engaging one groove of the plurality of grooves, the plurality of core members each electrically connecting the shields of the leadframe assemblies disposed on opposite sides of a corresponding separator.

2. The electrical connector of claim 1, wherein:

the plurality of core members comprise conductive material and insulative material selectively overmolded with insulative material, and for each core member, the feature engaging the one groove of the plurality of grooves comprises an insulative feature.

3. The electrical connector of claim 2, wherein:

for each core member, the feature engaging one groove of the plurality of grooves comprises a conductive feature.

4. The electrical connector of claim 1, wherein:

every other separator of the plurality of separators comprises a forward edge shaped with a feature that one core member of the plurality of core members engages.

5. The electrical connector of claim 4, wherein:

the plurality of core members each comprises a complementary feature engaging the feature that the forward edge of the every other separator of the plurality of separators are shaped with.

6. The electrical connector of claim 5, wherein:

the plurality of core members comprise conductive material and insulative material selectively overmolded with insulative material, and for each core member, the complementary feature is conductive.

7. The electrical connector of claim 1, wherein:

the plurality of separators are spaced from each other by a distance that corresponds to a row-to-row pitch.

8. An electrical connector, comprising:

a plurality of mating ends;

a plurality of mounting ends opposite the plurality of mating ends; and a housing comprising front and rear, top and bottom, and two sides, the front of the housing comprising a cavity that exposes the plurality of mating ends, the bottom comprising an organizer that the plurality of mounting ends extending therethrough, the rear and two sides of the housing each comprising a screw receiver extending to and open at the bottom, the rear of the housing comprising a recess, the screw receiver of the rear disposed adjacent the recess and comprising a sloped surface.

9. The electrical connector of claim 8, wherein:

the bottom of the housing comprises a lower-most surface and a recessed surface from the lower-most surface by a distance, and the electrical connector comprises a compressible shield disposed on the recessed surface of the bottom of the housing.

10. The electrical connector of claim 9, wherein:

the compressible shield extends beyond the lower-most surface of the bottom of the housing.

11. The electrical connector of claim 8, wherein:

the housing comprises a front portion and a rear portion having complementary features such that the front portion and the rear portion are held together.

12. The electrical connector of claim 11, wherein:

the front portion comprises the front and top of the housing, and the rear portion comprises the rear, bottom and two sides of the housing.

13. The electrical connector of claim 11, wherein:

the front portion comprises a plurality of separators aligned in the front and offset from each other in the rear.

14. The electrical connector of claim 11, wherein:

the front portion comprises a plurality of separators aligned in the bottom and offset from each other in the top.

15. A leadframe assembly, comprising:

a plurality of conductive elements, each of the plurality of conductive element comprising a mating end, a mounting end opposite the mating end, and an intermediate portion extending between the mating end and the mounting end, the mating ends of the plurality of conductive elements aligned in a first row, the mounting ends of the plurality of conductive elements aligned in a second row parallel to the first row;

a leadframe assembly housing holding the intermediate portions of the plurality of conductive elements; and a shield separated from the plurality of conductive elements by the leadframe assembly housing, the shield comprising a plurality of mounting ends aligned in a third row that is parallel to and offset from the second row.

16. The leadframe assembly of claim 15, wherein:

the shield comprises a plurality of mating ends aligned in the first row.

17. The leadframe assembly of claim 15, wherein:

the plurality of mounting ends of the shield are offset from the mounting ends of the plurality of conductive elements in a direction parallel to the second row.

18. The leadframe assembly of claim 15, wherein:

the intermediate portions of the plurality of conductive elements are bent so as to provide first segments parallel to the mating ends and second segments parallel to the mounting ends.

19. The leadframe assembly of claim 18, wherein the leadframe assembly housing comprises a first portion holding the first segments of the plurality of conductive elements and a second portion holding the second segments of the plurality of conductive elements.

20. The leadframe assembly of claim 19, wherein:

the shield has features complementary to features of the first portion of the leadframe assembly housing and features of the second portion of the leadframe assembly housing, respectively, such that the shield is attached to the first portion of the leadframe assembly housing and the second portion of the leadframe assembly housing.

* * * * *